US007951516B2

(12) United States Patent
Inagaki et al.

(10) Patent No.: US 7,951,516 B2
(45) Date of Patent: May 31, 2011

(54) ELECTROPHOTOGRAPHIC PHOTORECEPTOR, METHOD OF PRODUCING THE SAME, PROCESS CARTRIDGE, AND IMAGE-FORMING APPARATUS

(75) Inventors: Tomotake Inagaki, Kanagawa (JP); Kazuyuki Tada, Kanagawa (JP); Tomomasa Sato, Kanagawa (JP); Naoki Morita, Kanagawa (JP); Kenji Ikeda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 843 days.

(21) Appl. No.: 11/806,055

(22) Filed: May 29, 2007

(65) Prior Publication Data

US 2008/0102389 A1 May 1, 2008

(30) Foreign Application Priority Data

Oct. 27, 2006 (JP) ..... 2006-292798

(51) Int. Cl.
*G03G 5/047* (2006.01)

(52) U.S. Cl. ..... 430/59.6; 430/133; 430/134; 430/58.7; 399/159

(58) Field of Classification Search ..... 430/59.6, 430/58.7, 133, 134; 399/159
See application file for complete search history.

(56) References Cited

U.S. PATENT DOCUMENTS

| | | | | |
|---|---|---|---|---|
| 5,298,617 | A | 3/1994 | Nukada et al. | |
| 5,312,708 | A * | 5/1994 | Terrell et al. | 430/59.6 |
| 5,786,118 | A * | 7/1998 | Terrell et al. | 430/59.6 |
| 6,156,466 | A * | 12/2000 | Tamura et al. | 430/57.3 |
| 6,245,475 | B1 * | 6/2001 | Scharfe et al. | 430/133 |
| 7,060,404 | B2 * | 6/2006 | Kami et al. | 430/58.05 |
| 7,642,025 | B2 * | 1/2010 | Tada et al. | 430/133 |
| 2004/0053152 | A1 | 3/2004 | Nagai et al. | |
| 2005/0196690 | A1 * | 9/2005 | Kinomoto | 430/133 |
| 2005/0238989 | A1 * | 10/2005 | Kakui et al. | 430/133 |
| 2006/0057479 | A1 * | 3/2006 | Niimi et al. | 430/134 |
| 2006/0099525 | A1 * | 5/2006 | Yu et al. | 430/59.6 |
| 2006/0286471 | A1 * | 12/2006 | Mishra et al. | 430/58.8 |
| 2007/0082282 | A1 * | 4/2007 | Mishra et al. | 430/59.6 |
| 2007/0141488 | A1 * | 6/2007 | Yu | 430/59.6 |
| 2007/0141489 | A1 * | 6/2007 | Mishra et al. | 430/58.8 |

(Continued)

FOREIGN PATENT DOCUMENTS

JP A-47-030330 11/1972

(Continued)

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

(Continued)

*Primary Examiner* — Christopher RoDee
(74) *Attorney, Agent, or Firm* — Oliff & Berridge, PLC

(57) ABSTRACT

The electrophotographic photoreceptor of the present invention includes a cylindrical support; a charge-generating layer and a charge-transporting layer that are layered onto the cylindrical support in this sequence from the cylindrical support side. The charge-transporting layer includes a charge transport material, and resins including a curable resin and a thermoplastic resin. The proportion of the content of the curable resin with respect to the total amount of the resins in the charge-transporting layer increases in the layer thickness direction with distance from the charge-generating layer side.

17 Claims, 15 Drawing Sheets

U.S. PATENT DOCUMENTS

2008/0063959 A1 3/2008 Nagai et al.

FOREIGN PATENT DOCUMENTS

| | | |
|---|---|---|
| JP | A-04-189873 | 7/1992 |
| JP | A-4-324451 | 11/1992 |
| JP | A-05-043813 | 2/1993 |
| JP | A-05-098181 | 4/1993 |
| JP | A-05-140472 | 6/1993 |
| JP | A-05-140473 | 6/1993 |
| JP | A-05-263007 | 10/1993 |
| JP | A-05-279591 | 10/1993 |
| JP | A-08-176293 | 7/1996 |
| JP | A-08-208820 | 8/1996 |
| JP | A-2002-006527 | 1/2002 |
| JP | A-2002-40683 | 2/2002 |
| JP | A-2002-082469 | 3/2002 |
| JP | A-2003-186234 | 7/2003 |
| JP | A-2004-29134 | 1/2004 |
| JP | A-2004-70271 | 3/2004 |
| JP | A-2005-301244 | 10/2005 |
| JP | A-2006-227400 | 8/2006 |

OTHER PUBLICATIONS

Nov. 2, 2010 Japanese Office Action issued in Japanese Patent Application No. 2006-292798 (with translation).

* cited by examiner

ELECTROPHOTOGRAPHIC PHOTORECEPTOR, METHOD OF PRODUCING THE SAME, PROCESS CARTRIDGE, AND IMAGE-FORMING APPARATUS

CROSS-REFERENCE TO RELATED APPLICATION

This application claims priority under 35 U.S.C 119 from Japanese Patent Application No. 2006-292798 filed Oct. 27, 2006.

BACKGROUND

1. Technical Field

The present invention relates to an electrophotographic photoreceptor, a method of producing the same, a process cartridge provided with the electrophotographic photoreceptor, and an image-forming apparatus.

2. Related Art

A xerographic image forming apparatus is provided with an electrophotographic photoreceptor (sometimes referred to below as "photoreceptor"), charging device, exposing device, developing device and a transfer unit, and forms images by an electrophotographic process using the devices.

The xerographic image forming apparatuses has been advancing from the view point of high-speed image forming and life time of the image forming apparatus by developing the technology employed in each of the components and systems. Along with this trend, there are even greater demands than before for the applicability to high speed processing, and for the high reliability, of each of the subsystems.

In particular, the demands for high speed applicability and high reliability are even greater for photoreceptors that are used for writing images thereon, and cleaner for cleaning the photoreceptors, since they both receive considerably stress from the sliding motion therebetween, and image defects readily occur due to scratches, abrasion, and other such defects.

There are also strong demands for higher image qualities. Considering such demands, toners that have smaller size particles, tighter particle distributions, increased sphericity and the like are being sought. As a method of producing toners that meet these qualities, chemical toners, which are manufactured in a solution containing water as a main component thereof, has been actively developed. As a result of this, it has recently become possible to obtain photo-like quality images.

Furthermore, it has been demanded strongly to increase longevity of image-forming apparatuses. In order to realize such increases in longevity of image-forming apparatuses, increased durability of photoreceptors is being sought, and photoreceptors with protective layers that use cross-linking resin materials are proposed.

SUMMARY

According to a first aspect of the present invention, there is provided an electrophotographic photoreceptor having a cylindrical support, a charge-generating layer and an charge-transporting layer that are layered on or above the cylindrical support in this sequence; the charge-transporting layer comprising a charge transport material, and resins that comprise a curable resin and a thermoplastic resin; and the proportion of the content of the curable resin with respect to the total amount of the resins in the charge-transporting layer increasing in the layer thickness direction with distance from a side of the charge-generating layer.

BRIEF DESCRIPTION OF THE DRAWINGS

Exemplary embodiments of the present invention will be described in detail based on the following Figures, wherein.

DETAILED DESCRIPTION

The electrophotographic photoreceptor of the present exemplary embodiment includes a cylindrical support; a charge-generating layer and an charge-transporting layer that are layered on or above the cylindrical support in this sequence from the cylindrical support side. The charge-transporting layer includes a charge transport material, and resins that comprise a curable resin and a thermoplastic resin. the proportion of the content of the curable resin with respect to the total amount of the resins in the charge-transporting layer increases in the layer thickness direction with distance from a side of the charge-generating layer.

Figure 1:
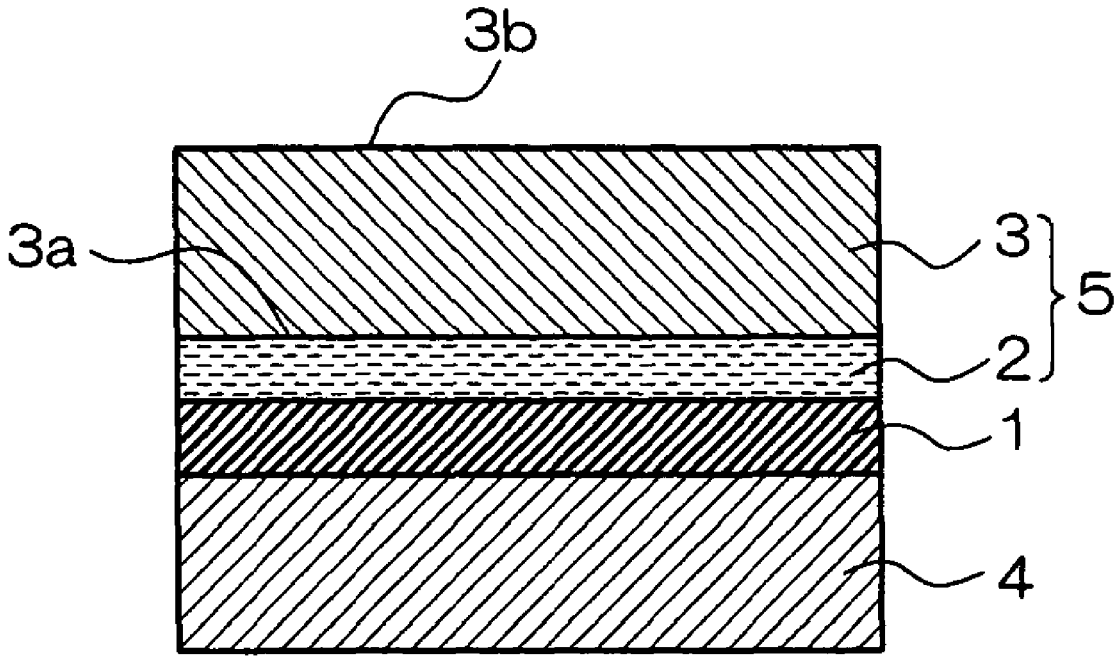
FIG. 1 is a cross sectional view of an electrophotographic photoreceptor in accordance with an preferable exemplary embodiment.

Such a photoreceptor layer of the present exemplary embodiment has a layer configuration in which the functions of the charge-generating layer and the charge-transporting layer are separated, and functionality of a so-called protecting layer is imparted to the charge-transporting layer. FIG. 1 is pattern diagram showing a cross-section of an electrophotographic photoreceptor according to the present exemplary embodiment.

In FIG. 1 there is an undercoat layer 1 provided on a cylindrical support 4, and a photo receptor layer 5, configured by a charge-generating layer 2 and by a charge-transporting layer 3 imparted with the functionality of a protecting layer, provided thereon. In the present exemplary embodiment the undercoat layer 1 may be, or may not be, provided. By the layered configuration of the charge-generating layer 2 and the charge-transporting layer 3, which is a mixed layer of charge-transport layer material and protecting layer material, high functionality may be realized, since the functionality of each of the layers may be separated.

In the following, the "interface of the charge-generating layer 2 and the charge-transporting layer 3" refers to the "interface 3*a*", and the "surface of the charge-transporting layer 3 on the side that is furthest from the charge-generating layer 2" refers to the "external surface 3*b*".

In the present exemplary embodiment, the charge-transporting layer 3 and the protecting layer are integrated together into a composite layer, and from right from the start there is no interface between the charge-transporting layer 3 and such a protecting layer. Furthermore, curable resin is included such that the amount thereof increases to the side of the external surface 3*b*. As well as this, the charge-transporting layer 3 is designed such that there is an increasing amount of thermoplastic resin toward the interface 3*a* with the charge-generating layer 2.

In the present exemplary embodiment, "ghosting" means the phenomenon of exposure history (exposure image) from the print exposure of a previous cycle remaining for the following cycle. When the history from the previous cycle results in print image output that is denser than a reference image density then it is called a positive ghost, and when it results in output that is less dense than a reference image density it is called a negative ghost, and in each case it appears prominently with intermediate gradation images. Normally ghosting evaluation is carried out by visional evaluation, comparing the printed image with reference images.

Also, in the present exemplary embodiment, "graininess" means the grainy variations in the density of an image when a half-tone image is output. For an image that gives a good graininess, there is substantially no variation in the density of a half-tone image, and there is uniform image density across the surface. On the other hand, for an image that has a bad graininess, there is a variation in the density of a half-tone image, and the image is one in which variations in density difference appear as a pattern that looks like minute droplets.

The present exemplary embodiment is also a process cartridge and an image-forming apparatus that are equipped with the above photoreceptor. By being equipped with the above photoreceptor, the process cartridge and image-forming apparatus of the present exemplary embodiment may be provided with increased resistance to abrasion, the occurrence of delamination and of ghosting may be suppressed, and the graininess may also be suppressed.

Below, explanation will first be given of the charge-transporting layer 3 and a method of producing the same, then explanation will be given of the photoreceptor having the charge-transporting layer 3, and then explanation will further be given of a process cartridge and an image-forming apparatus equipped with the photoreceptor.

<Charge-Transporting Layer 3>

The charge-transporting layer 3 according to the present exemplary embodiment is a layer having composite functionality, with the functionality of a charge-transporting layer to which the functionality of a protecting layer is also imparted.

The charge-transporting layer 3 of the present exemplary embodiment has what is referred to as the functionality of the charge-transporting layer 3 onto which the functionality of a protecting layer has been imparted, and therefore includes charge transport materials as well as including as resins a thermoplastic resin and a curable resin. Furthermore, in the charge-transporting layer 3, the proportion of the curable resin with respect to the total resin within the charge-transporting layer increases toward the external surface 3*b*.

The charge-transporting layer 3 of the present exemplary embodiment includes at least charge transport material and, as resins, a thermoplastic resin and a curable resin.

1. Resin

The charge-transporting layer 3 according to the present exemplary embodiment includes a thermoplastic resin and a curable resin, and it is a composite layer in which the charge-transporting layer 3 and a protecting layer are integrated together.

Furthermore, in the charge-transporting layer 3, the proportion of the curable resin with respect to the total resin within the charge-transporting layer increases toward the external surface 3*b*.

1-1. Thermoplastic Resin

Thermoplastic resins that may be used in the charge-transporting layer 3 include polycarbonate resins, polyester resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, and styrene-alkyd resins. These thermoplastics may be used singly or in combination two or more thereof.

Preferable examples for use as the thermoplastic resin of the charge-transporting layer 3 include: polycarbonate resins, polyester resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers and the like. Polycarbonate resins are particularly suitably applied as they have superior electrostatic properties and environmental stability, and high quality images may be obtained therewith.

1-2. Curable Resin

As the curable resin, a resin that hardens due to an external stimulus, such as having thermosetting ability, light curability (including ultraviolet light and the like), radiation curability or the like, may be used.

Specifically, for the curable resin, examples that may be mentioned include: phenol resins, epoxy resins, urethane resins, urea resins, siloxane resins, and the like. Amongst these particularly preferable examples are resins with phenolic hydroxyl group(s) having charge transport properties. Specifically novolac type phenol resins, resol type phenol resins, epoxy resins which have a phenolic hydroxyl group or the like is preferable, and phenol derivatives which have at least a methylol group, for example, resol type phenol resins, are more preferable.

Phenol derivatives which have a methylol group include: resorcin, bisphenol and the like; substituted phenols containing one hydroxyl group, such as phenol, cresol, xylenol, p-alkylphenol, p-phenylphenol, and the like; substituted phenols containing two hydroxyl groups, such as catechol, resorcinol, and hydroquinone; bisphenols, such as bisphenol A and Bisphenol Z; biphenols; monomers of monomethylol phenols, dimethylol phenols, and trimethylol phenols that are the reaction products of reacting compounds with phenolic hydroxyl group(s) together with formaldehyde, paraformaldehyde or the like, using an acid or an alkali catalyst; mixtures of such monomers; oligomers made from these monomers; and monomer and oligomer mixtures. Here, oligomer refers to relatively large molecules with between 2 and 20 repeating units in their molecule structure, and smaller molecules are referred to as monomers.

Acid catalysts which may be used for the above reaction include, for example, acid catalysts which may be used include, for example, inorganic acid catalysts, such as sulfuric acid, phosphoric acid, and the like, organic acid catalysts p-toluene sulfonic acid, benzoic acid, fumaric acid, maleic acid, and the like; alkali catalysts which may be used include, for example, alkali metal or an alkaline earth metal hydroxide compounds, such as NaOH, KOH, and $Ca(OH)_2$, and amine based catalysts. As amine based catalysts there are ammonia, hexamethylenetetramine, trimethylamine, triethylamine, triethanolamine, and the like, but catalysts are not limited thereto. It is preferable that, when a basic catalyst is used, inactivation or removal is carried out by acid neutralization or contacting with adsorbents, such as silica gel, or an ion exchange resin, or the like. Moreover, a catalyst may be used in coating liquid production, in order to promote curing. The above catalysts may be used when curing, but it is preferable that the addition amount of such a catalyst is below about 5 wt % with respect to the total amount of solids in the outermost surface layer.

It is preferable that the amount contained of the thermoplastic resin with respect to the total resin at the external surface 3*b* of the charge-transporting layer 3 is about 10 wt % or less, and more preferably about 5 wt % or less, with less than about 1 wt % being even more preferable.

In contrast, at the interface 3*a* to the charge-generating layer it is preferable that the amount contained of the curable resin with respect to the total resin is about 10 wt % or less, and more preferably about 5 wt % or less, with less than about 1 wt % being even more preferable.

Figure 2A:
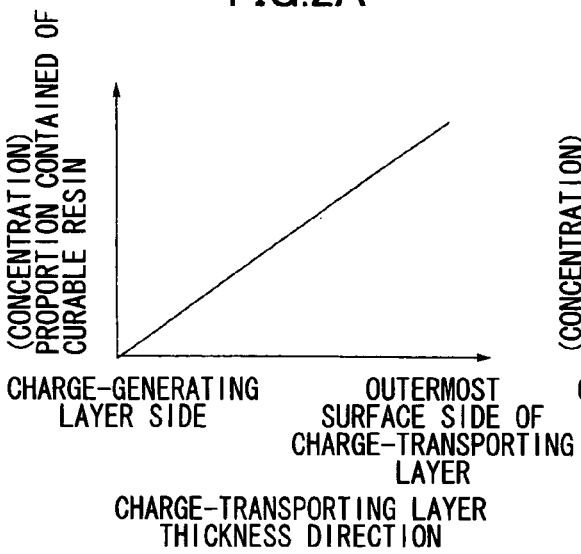
FIGS. 2A to 2E are graphs explaining a change in the proportion of the content of a curable resin in the layer thickness direction of a charge-transporting layer.
Figure 2B:
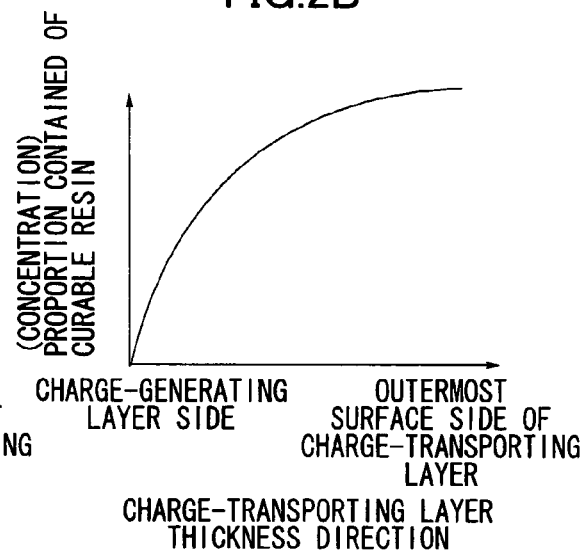
Figure 2C:
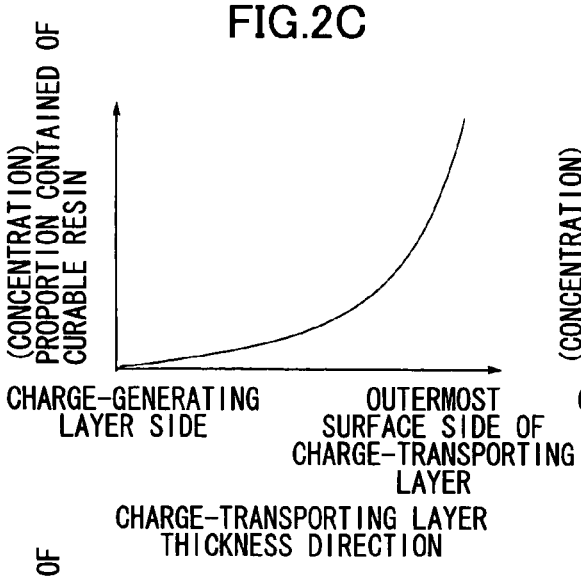

In the present exemplary embodiment, as long as the proportion of the content of the curable resin of the charge-transporting layer 3 increases in the layer thickness direction with the distance from charge-generating layer side toward the external surface 3*b*, the proportion of the content of the curable resin may be as in the case shown in FIG. 2A where there is a first order linear increase, or it may be, as in the cases shown in FIG. 2B and FIG. 2C, where there is a curved increase.

Figure 2D:
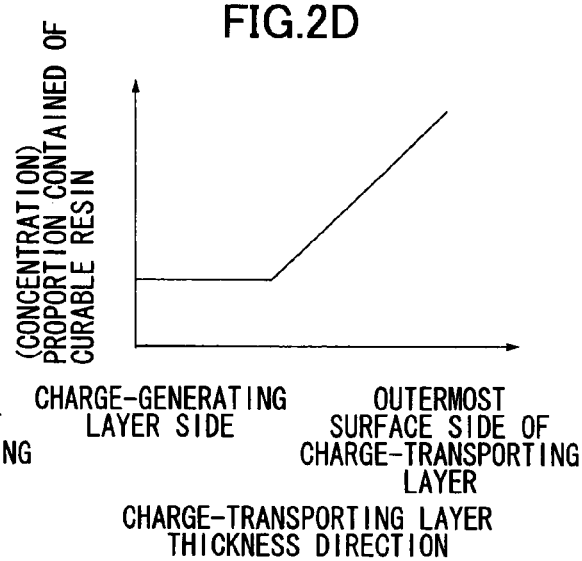
Figure 2E:
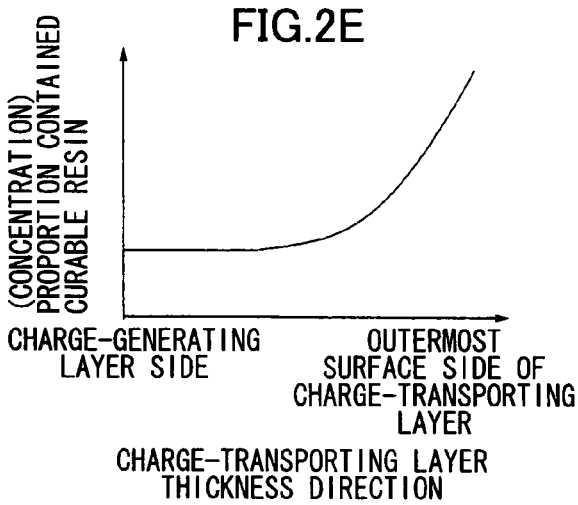

Furthermore, if an charge-transporting layer 3 that is thinner than the target thickness if formed in advance, by dip coating or the like, and then inkjet coating with a coating liquid that has a different concentration of curable resin is carried out, the concentration gradients as shown in FIGS. 2D and 2E are formed, and these embodiments are also suitable. That is to say, the part where the proportion of the content of the curable resin increases in the layer thickness direction from the charge-generating layer side toward the surface of the charge-transporting layer 3, may be only a portion of the charge-transporting layer 3 in the layer thickness direction.

2. Charge Transport Material

There are no particular limitations to materials that may be used as the charge transport material, as long as they have a charge-transporting functionality, and they may be used as applicable.

The charge transport material includes electron transport compounds, for example quinone compounds such as p-benzoquinone, chloranil, bromanil or anthraquinone; tetracyanoquinodimethane compounds; fluorenone compounds such as 2,4,7-trinitrofluorenone; xanthone compounds; benzophenone compounds; cyanovinyl compounds and ethylene compounds. The charge transport material includes hole transport compounds such as triaryl amine compounds, benzidine compounds, aryl alkanes compound, aryl-substituted ethylene compounds, stilbene compounds, anthracene compounds and hydrazone compounds.

These charge transport materials may be used alone or in combination of two or more thereof, and the charge transport material is not limited thereto. These charge transport materials are preferably those having structures represented by the following formulae:

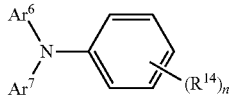

wherein $R^{14}$ represents a hydrogen atom or a methyl group; n indicates 1 or 2; $Ar^6$ and $Ar^7$ each independently represent a substituted or unsubstituted aryl group, $—C_6H_4—C(R^{18})=C(R^{19})(R^{20})$ or $—C_6H_4—CH=CH—CH=C(Ar)_2$, and the substituent for these is a halogen atom, an alkyl group having from 1 to 5 carbon atoms, an alkoxy group having from 1 to 5 carbon atoms, or a substituted amino group substituted with an alkyl group having from 1 to 3 carbon atoms; Ar represents a substituted or unsubstituted aryl group; and $R^{18}$, $R^{19}$ and $R^{20}$ each independently represent a hydrogen atom, a substituted or unsubstituted alkyl group, or a substituted or unsubstituted aryl group.

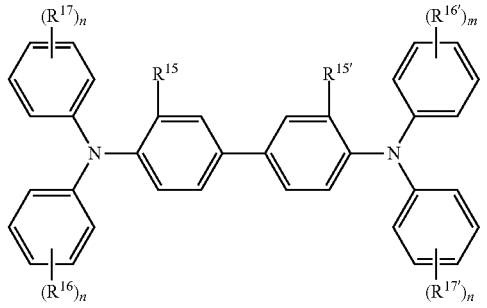

In the above formula, $R^{15}$ and $R^{15'}$ may be the same or different, and each independently represent a hydrogen atom, a halogen atom, an alkyl group having from 1 to 5 carbon atoms, or an alkoxy group having from 1 to 5 carbon atoms; $R^{16}$, $R^{16'}$, $R^{17}$ and $R^{17'}$ may be the same or different, and each independently represent a hydrogen atom, a halogen atom, an alkyl group having from 1 to 5 carbon atoms, an alkoxy group having from 1 to 5 carbon atoms, an amino group substituted with an alkyl group having 1 or 2 carbon atoms, a substituted or unsubstituted aryl group, $—C(R^{18})=C(R^{19})(R^{20})$, or $—CH=CH—CH=C(Ar)_2$; $R^{18}$, $R^{19}$ and $R^{20}$ each independently represent a hydrogen atom, a substituted or unsubstituted alkyl group, a substituted or unsubstituted aryl group; Ar represents a substituted or unsubstituted aryl group; and each of m and n each independently represent an integer of from 0 to 2.

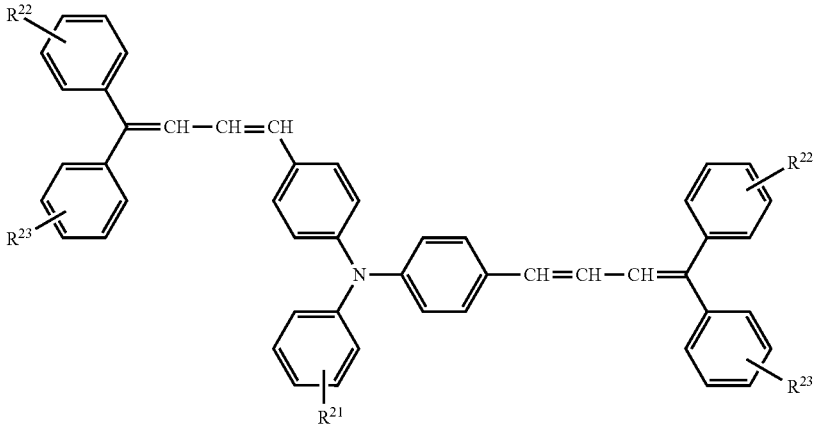

In the formula, $R^{21}$ represents a hydrogen atom, an alkyl group having from 1 to 5 carbon atoms, an alkoxy group having from 1 to 5 carbon atoms, a substituted or unsubstituted aryl group, or —CH═CH—CH═C(Ar)$_2$; Ar represents a substituted or unsubstituted aryl group; $R^{22}$ and $R^{23}$ may be the same or different and each independently represent a hydrogen atom, a halogen atom, an alkyl group having from 1 to 5 carbon atoms, an alkoxy group having from 1 to 5 carbon atoms, an amino group substituted with an alkyl group having 1 or 2 carbon atoms, or a substituted or unsubstituted aryl group.

Polymer charge transport materials may also be included in the charge-transporting layer 3, in place of the above low molecular weight charge transport materials.

Known materials with charge-transporting ability, such as, for example, poly-N-vinylcarbazole, and polysilanes, may be used as a polymer charge transport material. Particularly favorable are the polyester based polymer charge transport materials that have high charge-transporting ability described in JP-A Nos. 8-176293 and 8-208820.

When a polymer charge transport material is included then the amount of the thermoplastic resin that is used may be reduced.

It is also preferable that, in addition to the above low molecular weight charge transport materials and polymer charge transport materials, a charge-transporting substance is used that is able to carry out a cross-linking reaction.

In the present exemplary embodiment, the low molecular weight charge transport materials and the polymer charge transport materials will be referred to as "non-curable type charge transport materials", and charge-transporting substances having a group that is able to carry out a cross-linking reaction will be referred to as "curable type charge transport materials". Examples that may be given of such a reactive group include a hydroxy group, a carboxyl group, a thiol group, an epoxy group, an alkoxy group, a vinyl group, an amino group, an ether group, and the like.

Examples that may be given of substances for a cross-linkable charge-transporting substance include those represented by the Formulas (I) to (V) below, and for specific examples of the structure thereof, the following, for example, may be used.

$$F—((X^1)_n—R^1\text{-}A)_m \qquad \text{Formula (I)}$$

In Formula (I): F represents an organic group that has a hole-transporting ability; $R^1$ represents an alkylene group; m represents an integer of 1 to 4; $X^1$ represents an oxygen atom or a sulfur atom; n is 0 or 1; and A represents a hydroxyl group, a carboxyl group or a thiol group.

$$F—[(X^2)_{n1}—(R^2)_{n2}—(Z^2)_{n3}\text{-}G]_{n4} \qquad \text{Formula (II)}$$

In Formula (II): F represents an organic group that has a hole-transporting ability; $X^2$ represents an oxygen or a sulfur atom; $R^2$ represents an alkylene group; $Z^2$ represents an alkylene group, an oxygen atom, a sulfur atom, NH, or COO; G represents an epoxy group; n1, n2 and n3 are each independently 0 or 1; and n4 represents an integer from 1 to 4.

Formula (III)

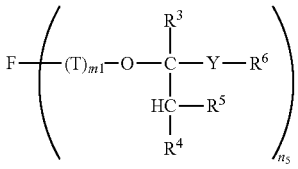

In Formula (III): F represents an n5 valency organic group that has a hole-transporting ability; T represents a divalent group; Y represents an oxygen atom or a sulfur atom; $R^3$, $R^4$ and $R^5$ each independently represents a hydrogen atom or a monovalent organic group; $R^6$ represents a monovalent organic group; m1 is 1 or 0; and n5 represents an integer from 1 to 4, wherein $R^5$ and $R^6$ may link together to form a hetero ring with Y as the hetero atom.

Formula (IV)

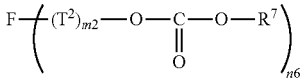

In Formula (IV): F represents an n6 valency organic group that has a hole-transporting ability; $T^2$ represents a divalent group; $R^7$ represents a monovalent organic group; m2 is 1 or 0; and n6 represents an integer from 1 to 4.

Formula (V)

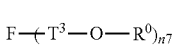

In Formula (V): F represents an n7 valency organic group that has a hole-transporting ability; $T^3$ represents a divalent alkylene group; $R^0$ represents a monovalent organic group; and n7 represents an integer from 1 to 4.

Specific examples of compounds are shown below, but there is no limitation to these.

Specific Examples Represented by Formula (I)
I-1
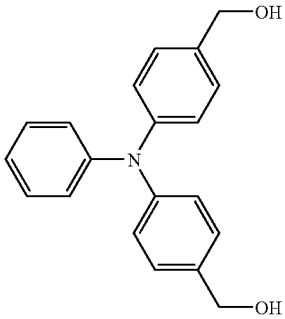
I-2
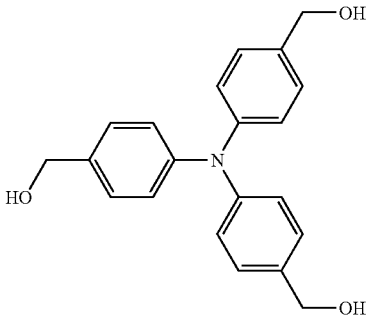
I-3
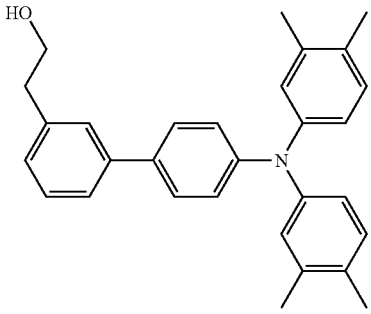
I-4
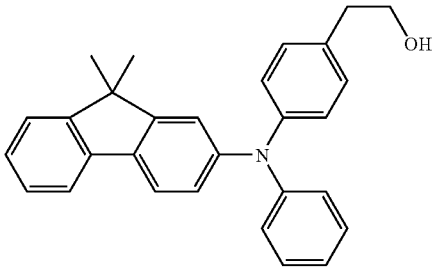
I-5
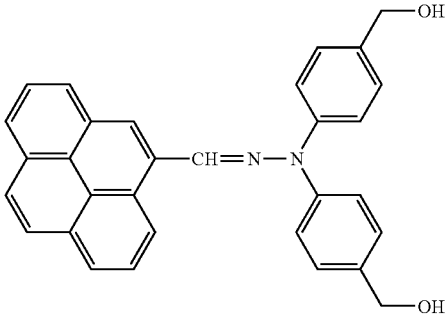
-continued
I-6
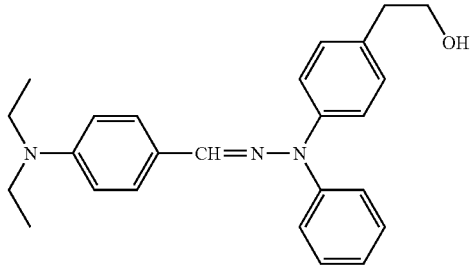
I-8
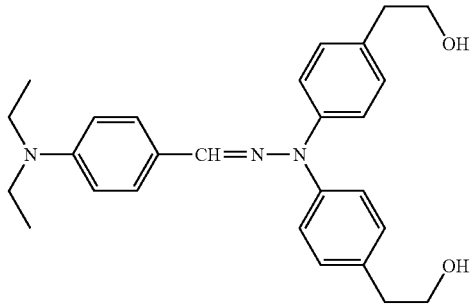
I-9
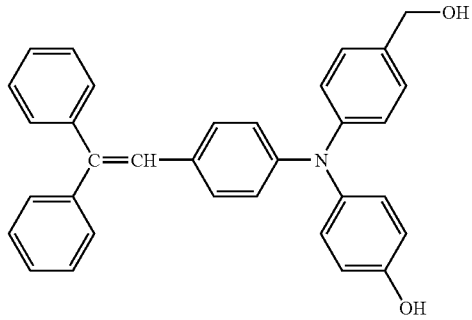
I-10
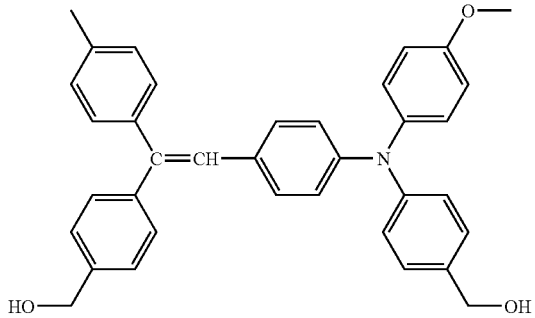
I-11
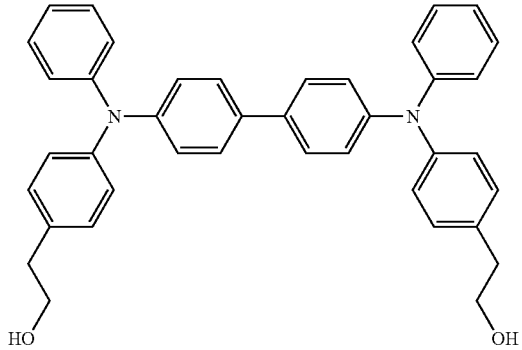

-continued
I-12
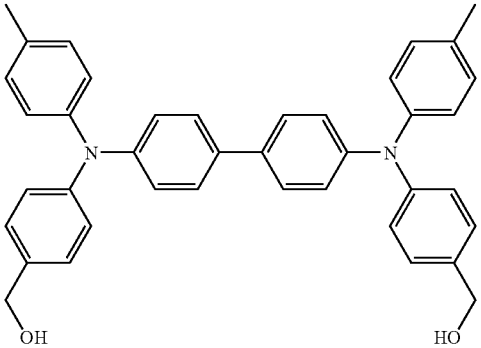
I-13
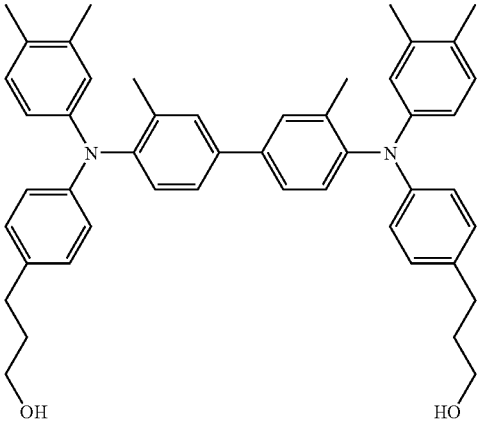
I-14
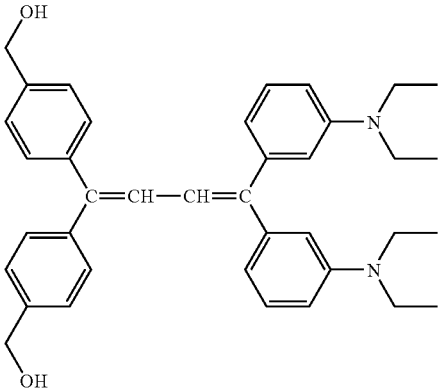
I-15
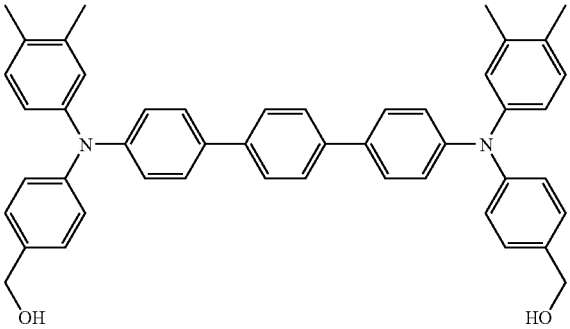
-continued
I-16
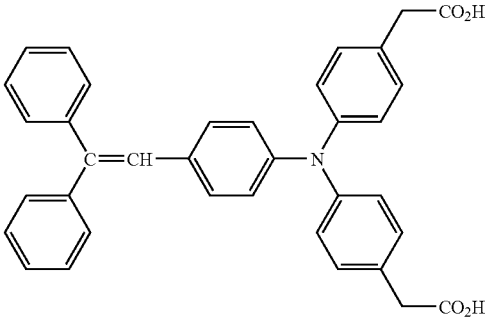
I-17
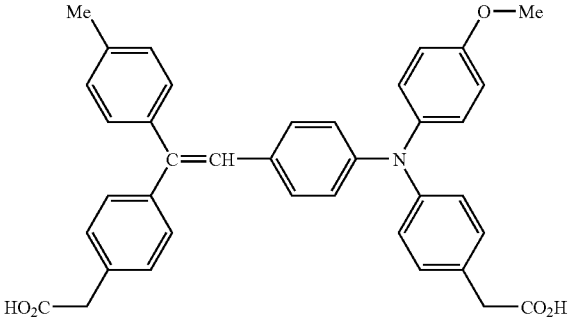
I-18
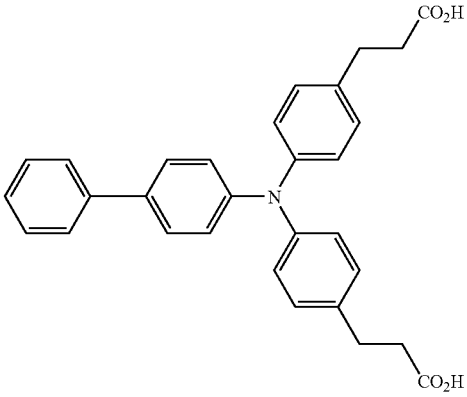
I-19
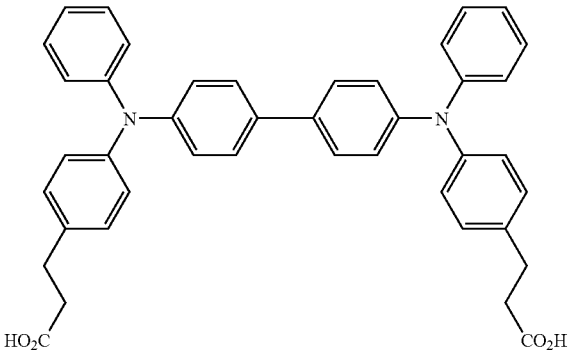

-continued
I-20
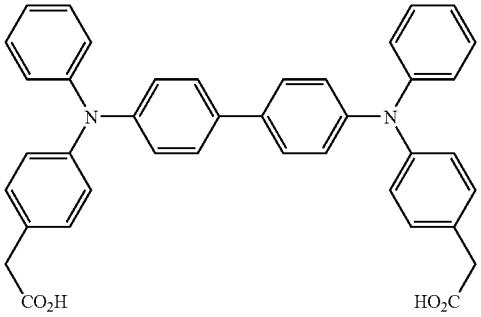
I-21
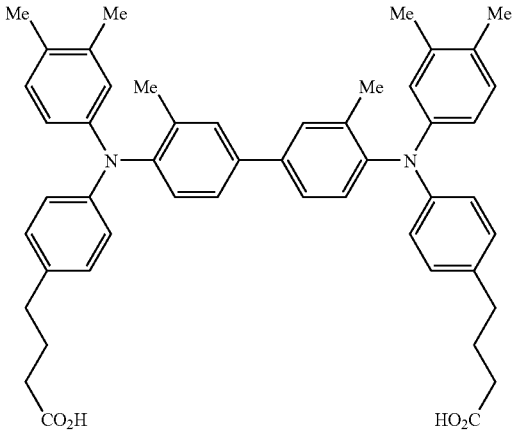
I-22
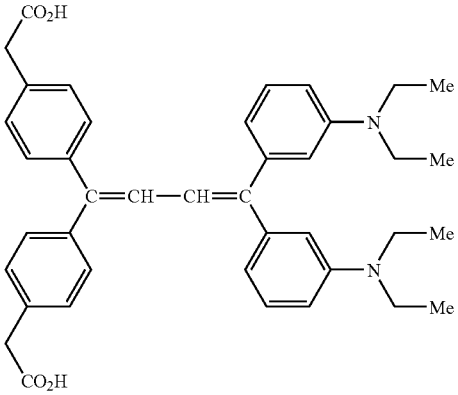
I-23
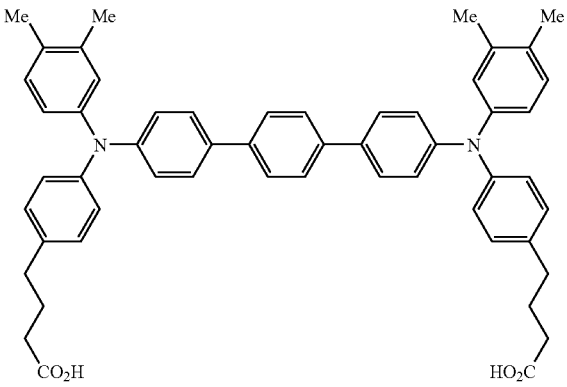
-continued
I-24
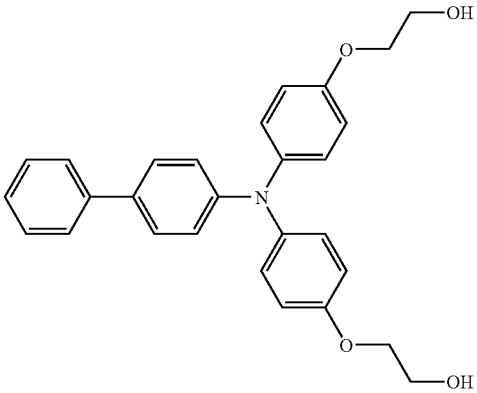
I-25
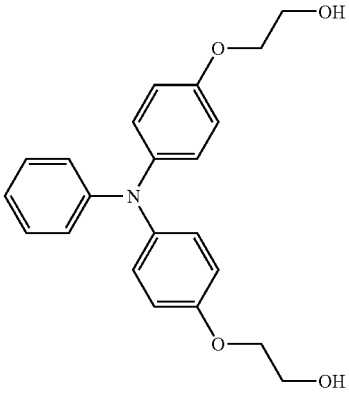
I-26
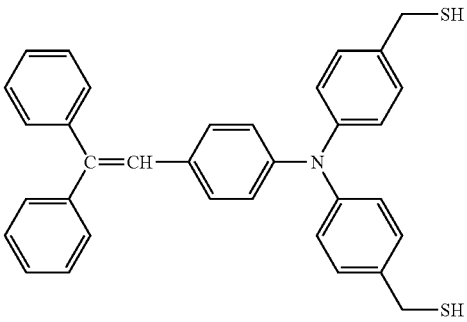
I-27
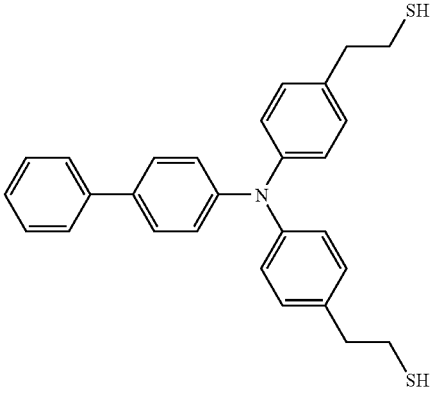

-continued
I-28
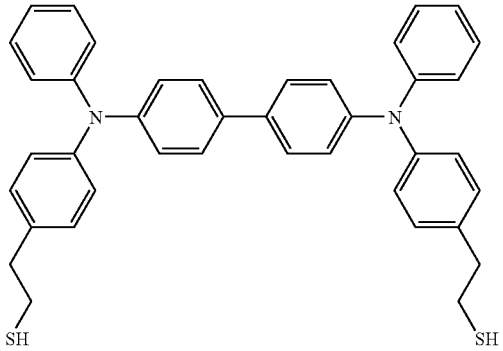
I-29
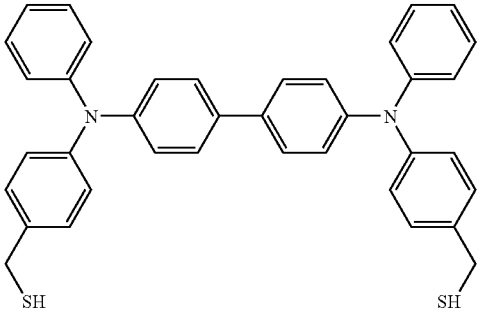
I-30
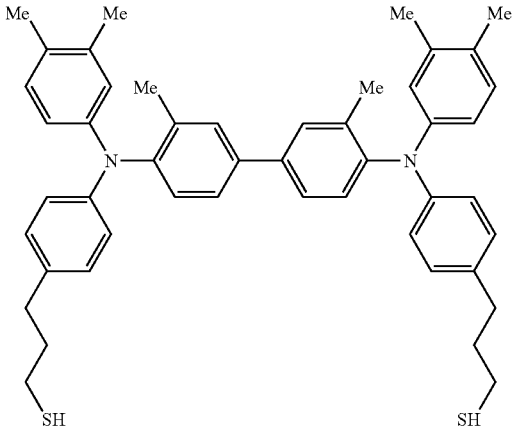
Specific Examples Represented by Formula (II)
II-1
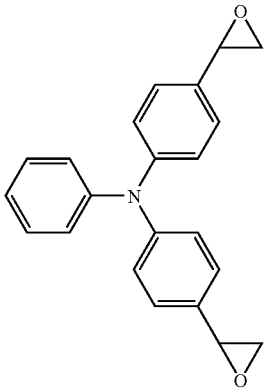
-continued
II-2
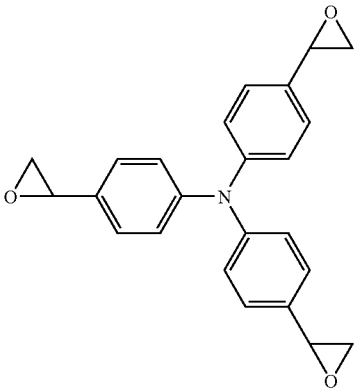
II-3
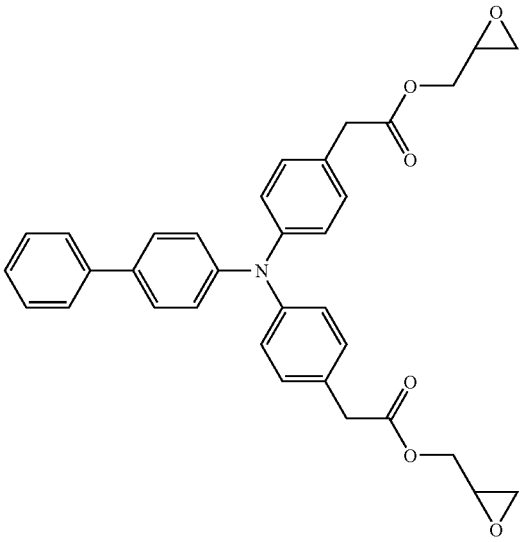
II-4
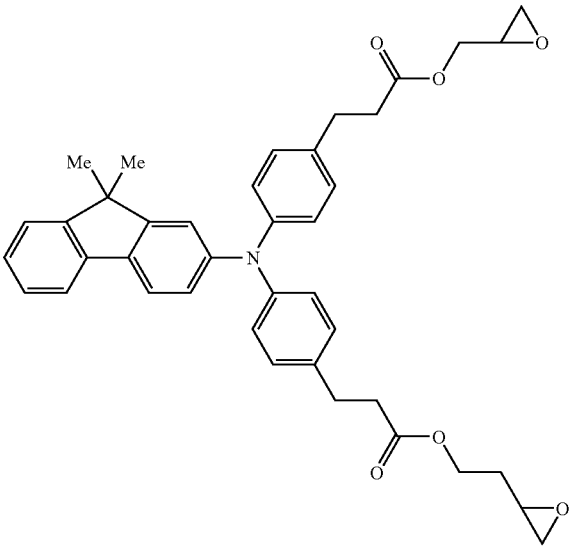

II-5
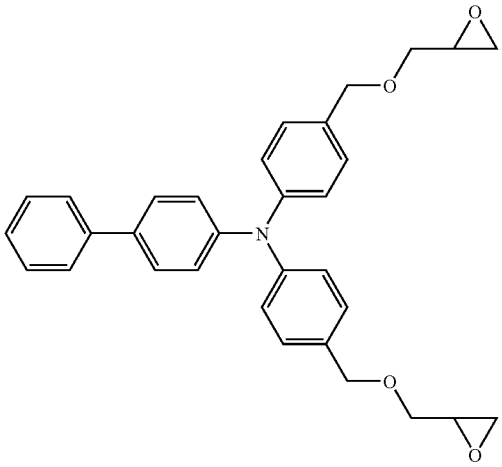
II-6
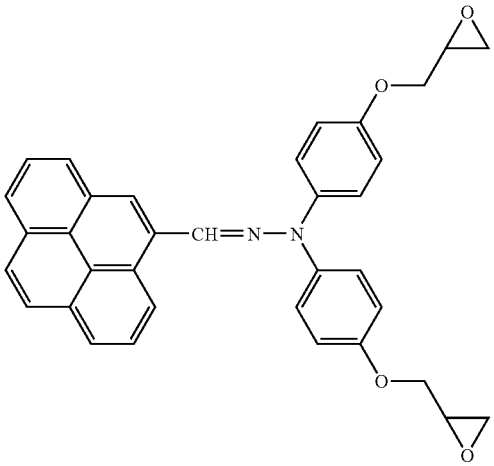
II-7
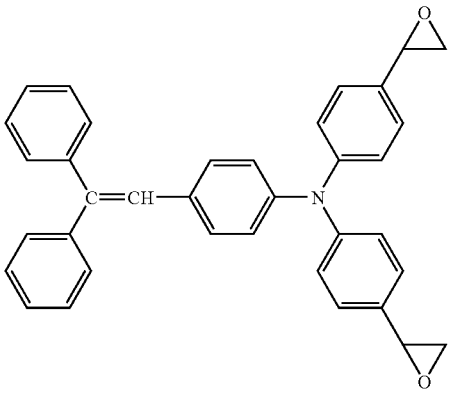
II-8
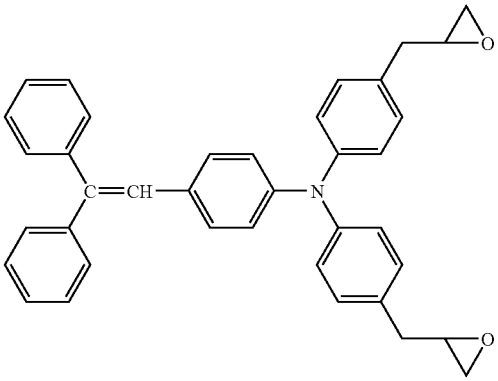
II-9
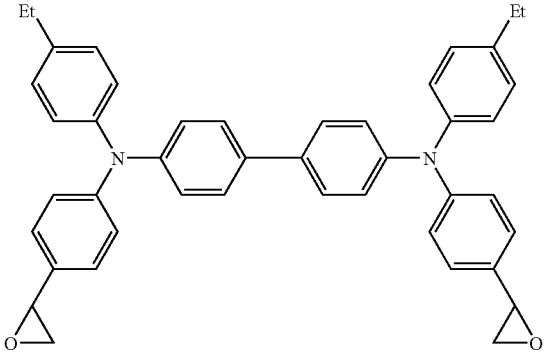
II-10
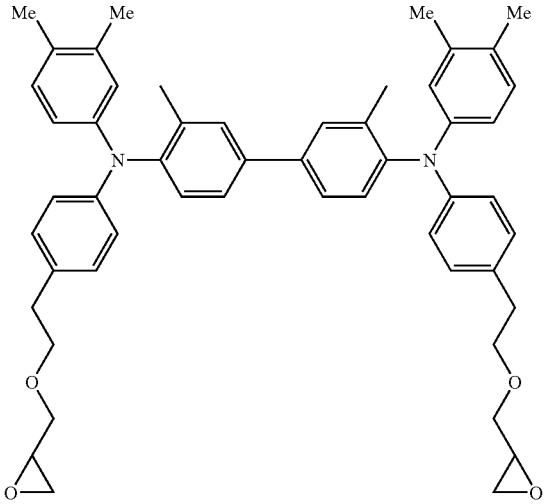

-continued
II-11
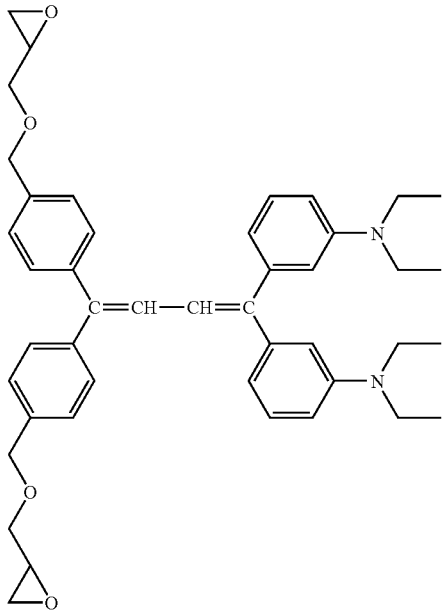
II-12
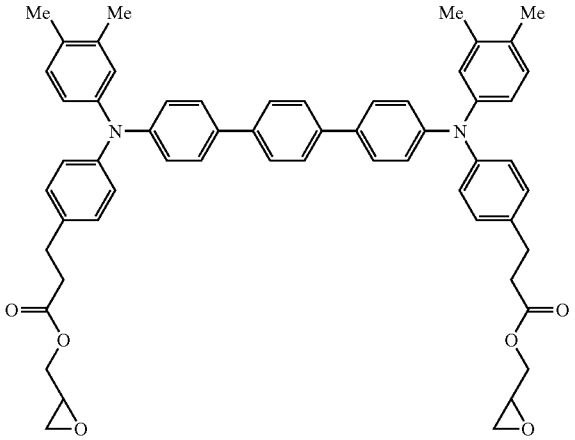
II-13
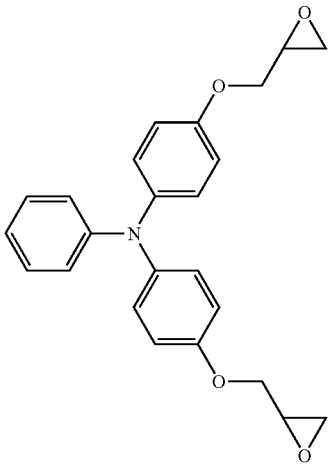
-continued
II-14
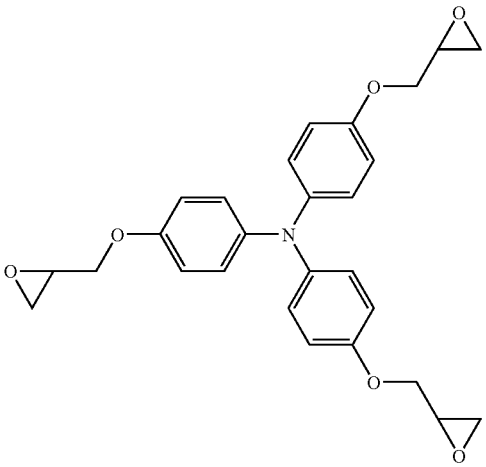
II-15
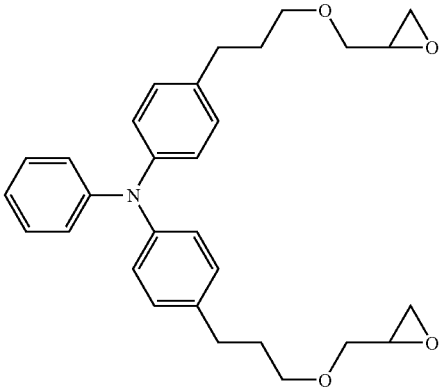
II-16
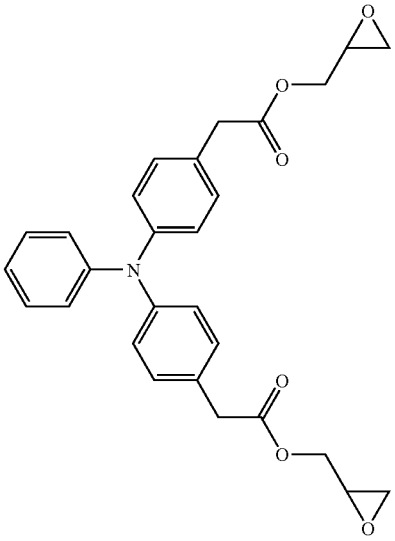

II-17
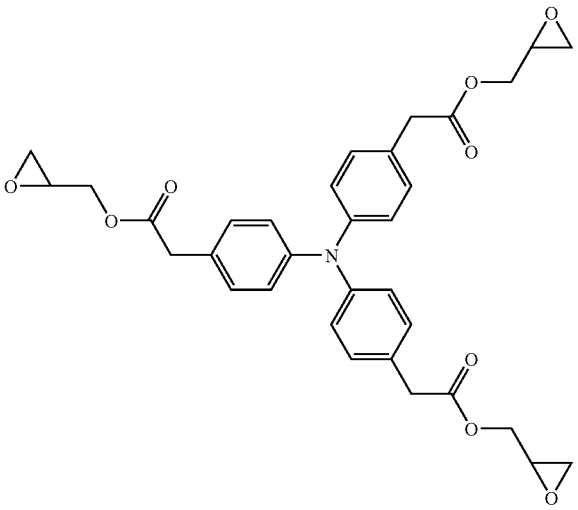
II-18
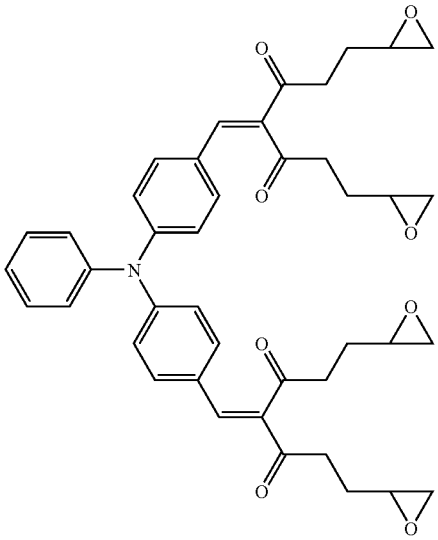
II-19
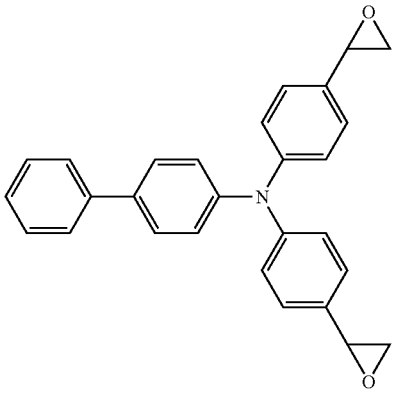
II-20
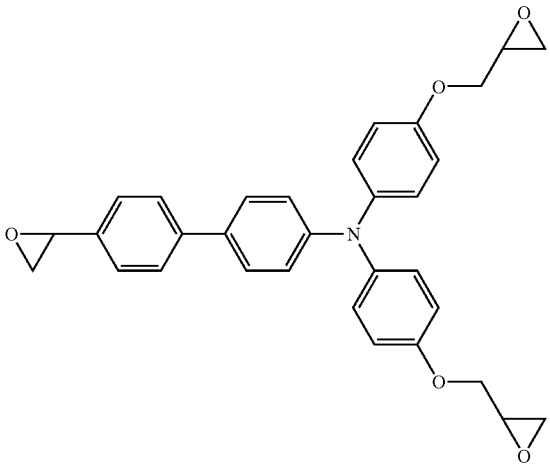
II-21
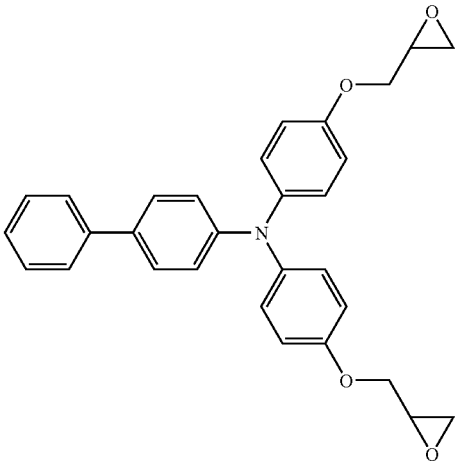
II-22
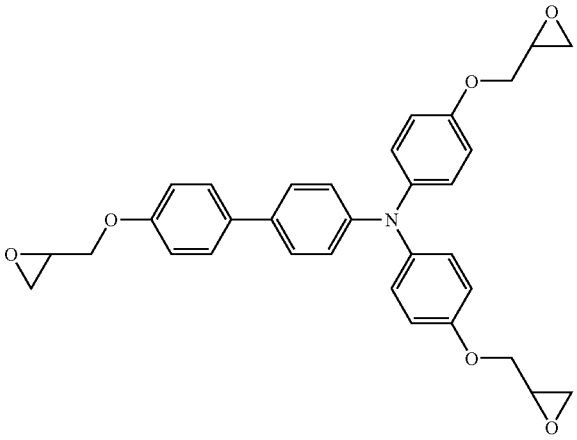

II-23
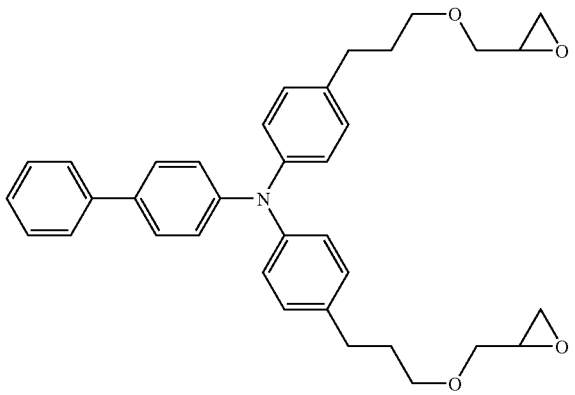
II-24
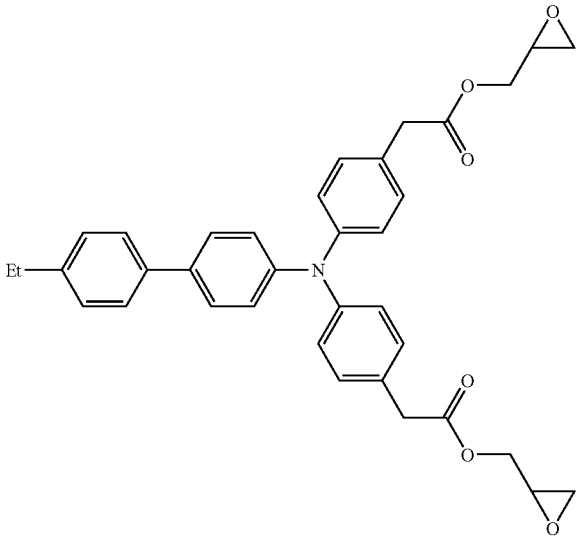
II-25
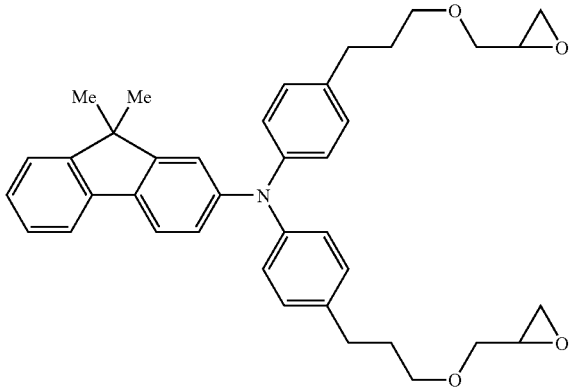
II-26
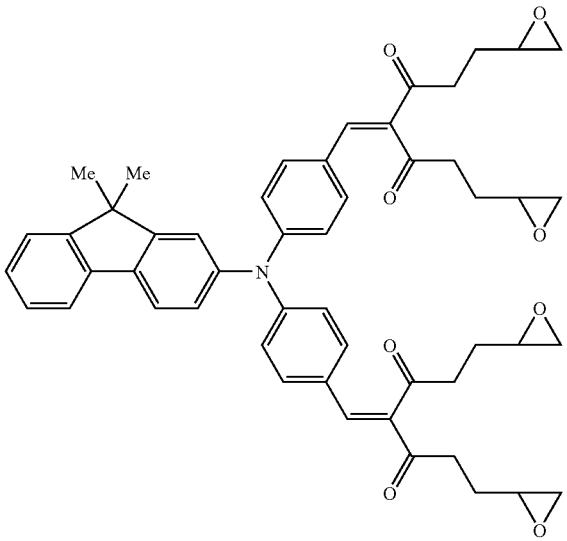
II-27
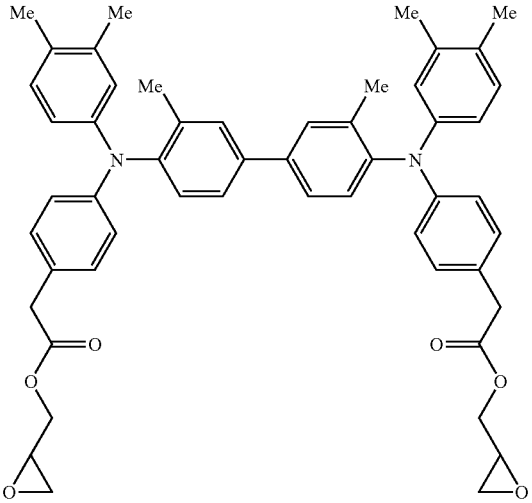
II-28
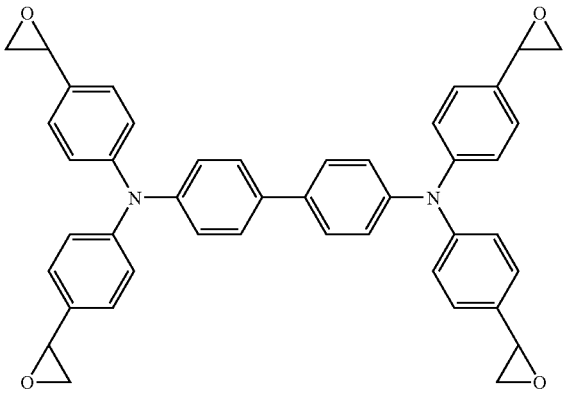

-continued
II-29
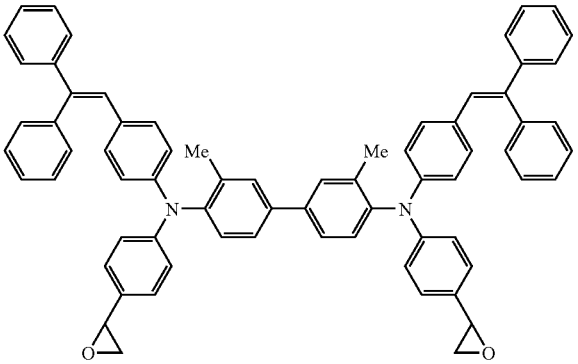
II-30
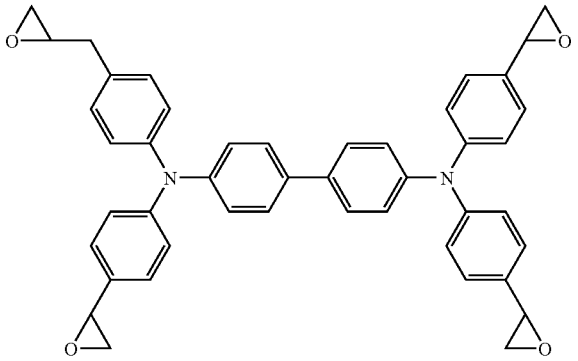
II-31
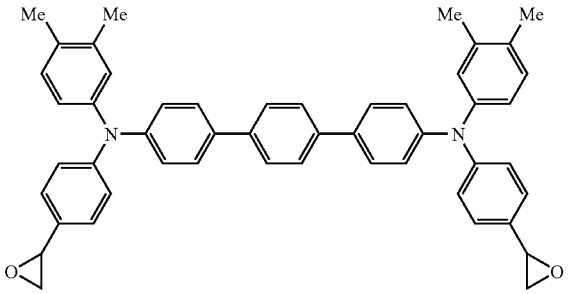
II-32
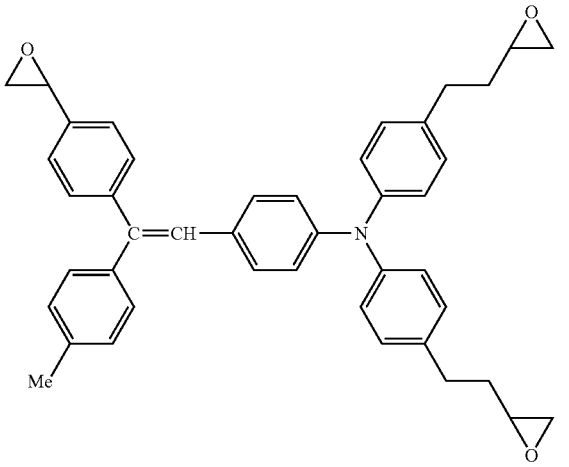
-continued
II-33
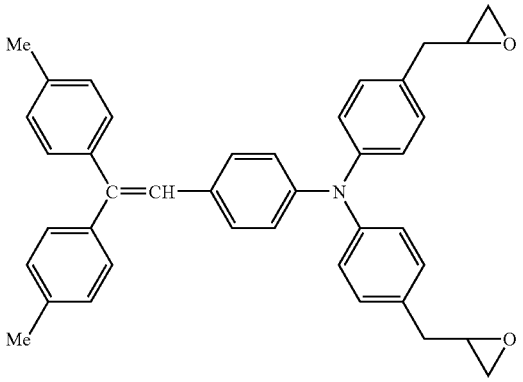
II-34
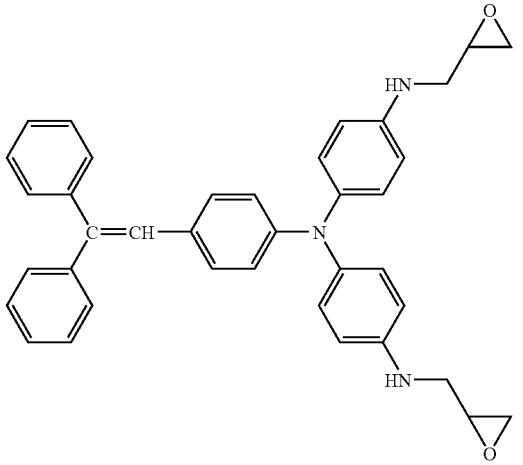
II-35
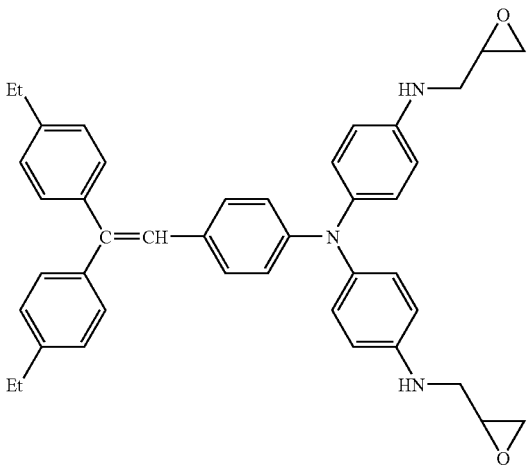

-continued
II-36
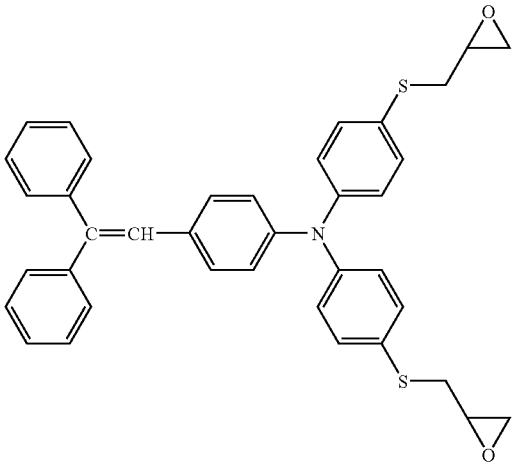
II-37
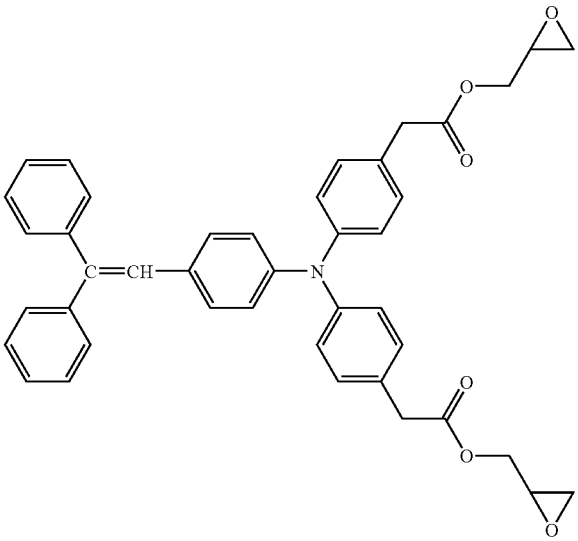
II-38
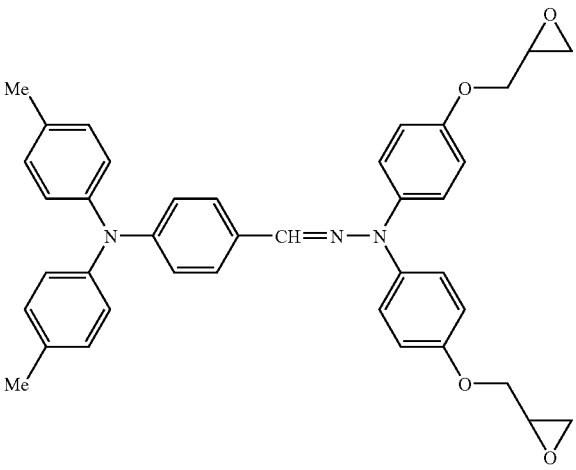
-continued
II-39
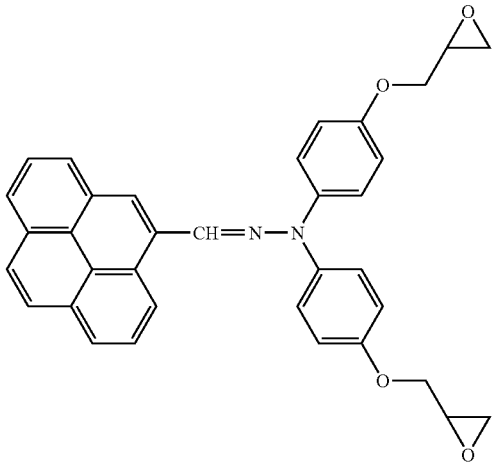
II-40
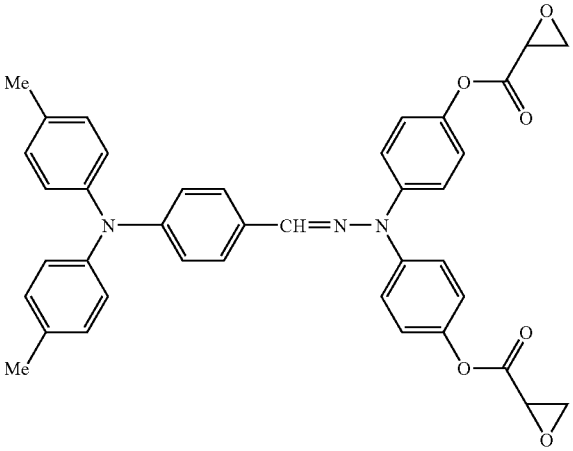
II-41
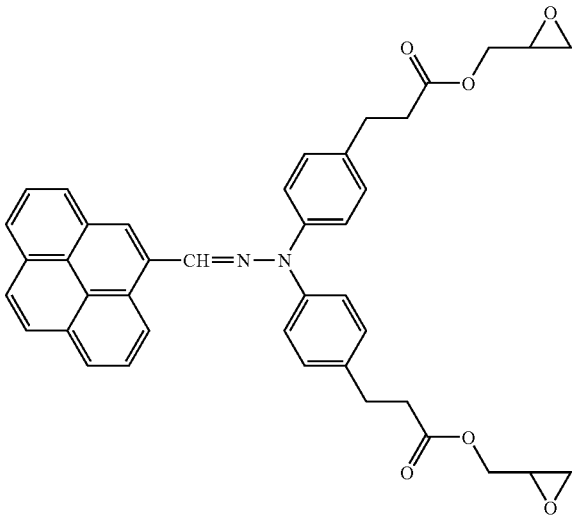

-continued
II-42
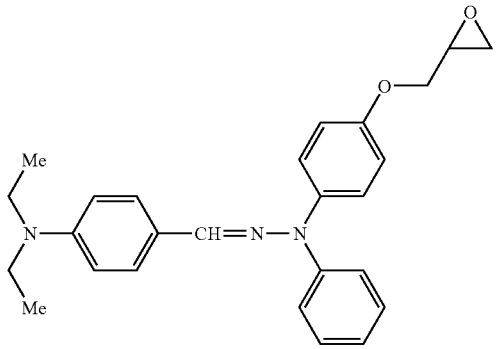
II-43
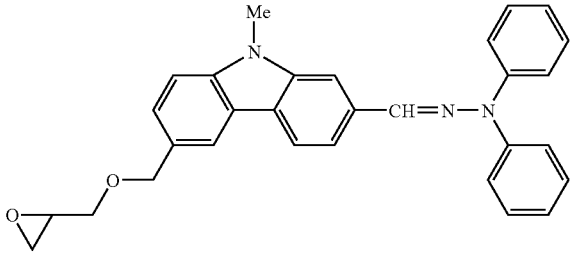
II-44
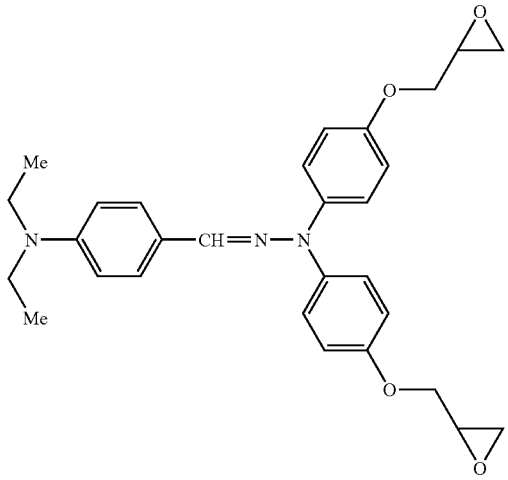
-continued
II-45
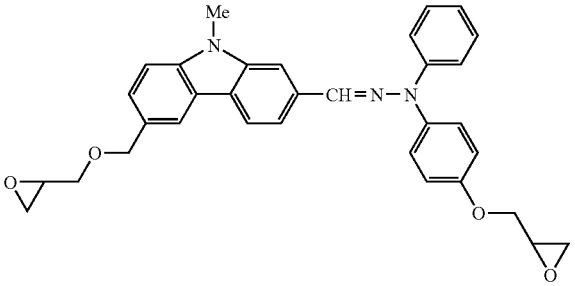
II-46
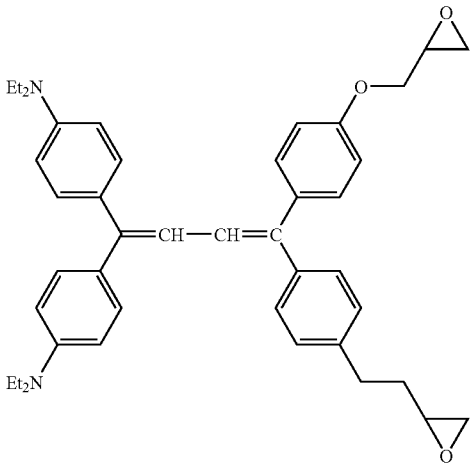
II-47
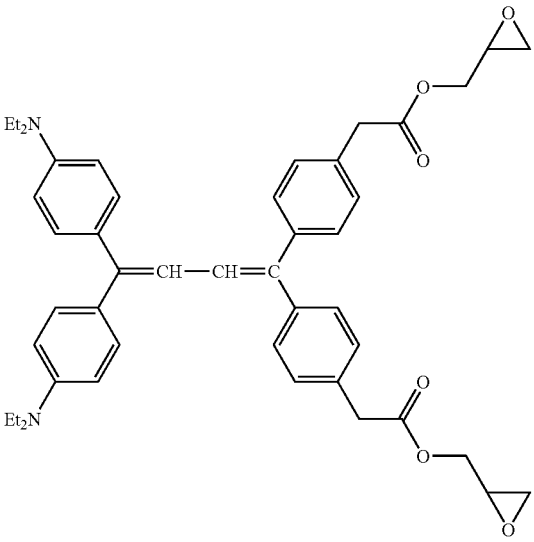

Specific Examples Represented by Formula (III)
III-1
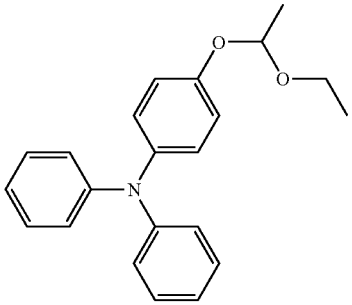
III-2
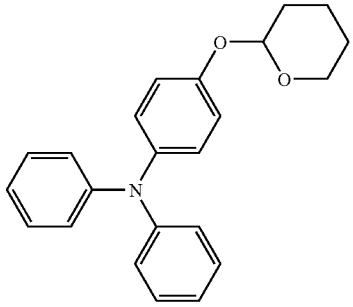
III-3
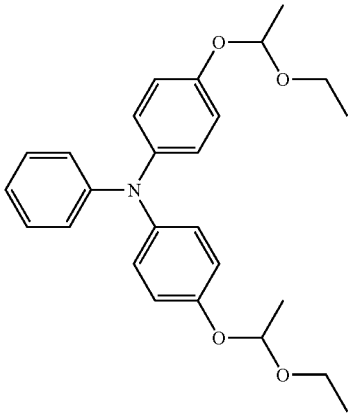
III-4
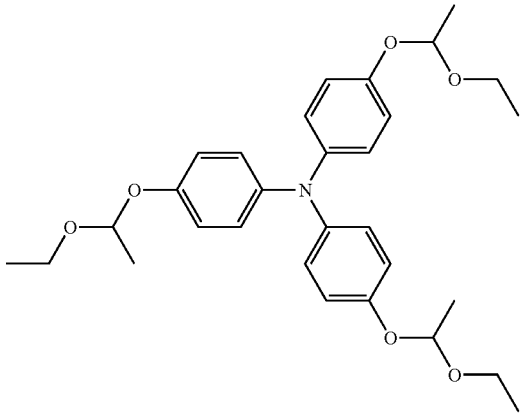
III-5
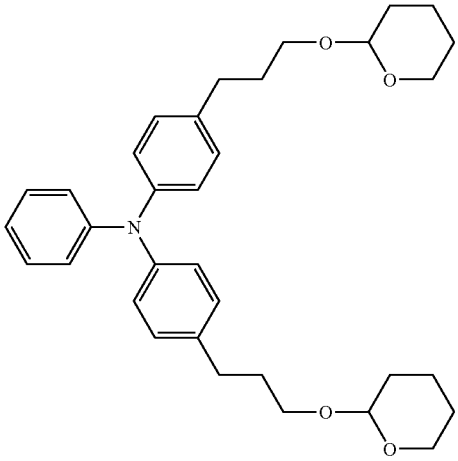
III-6
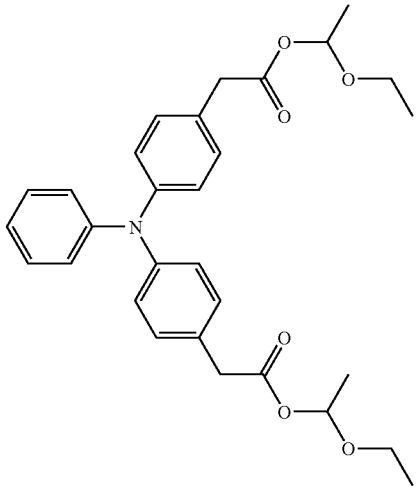

-continued
III-7
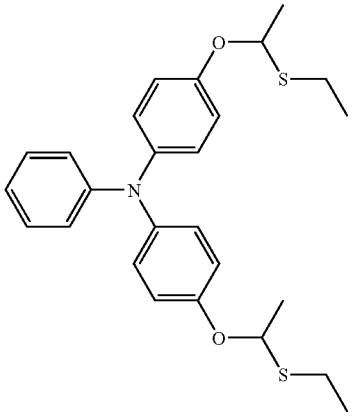
III-8
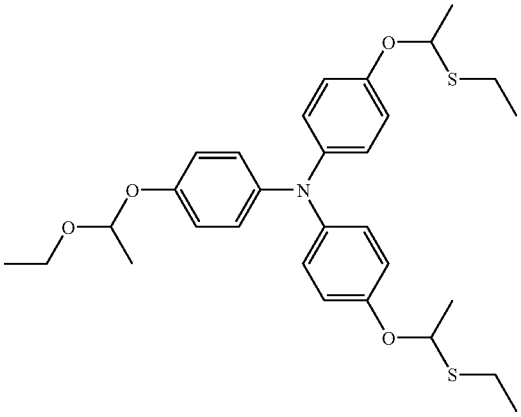
III-9
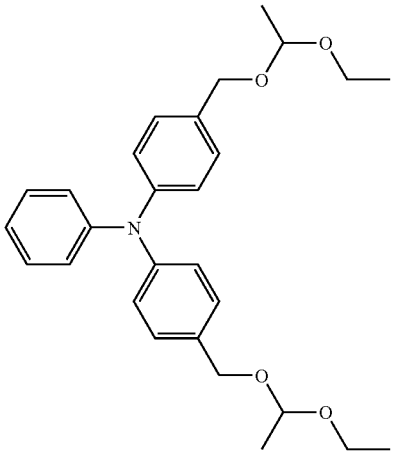
III-10
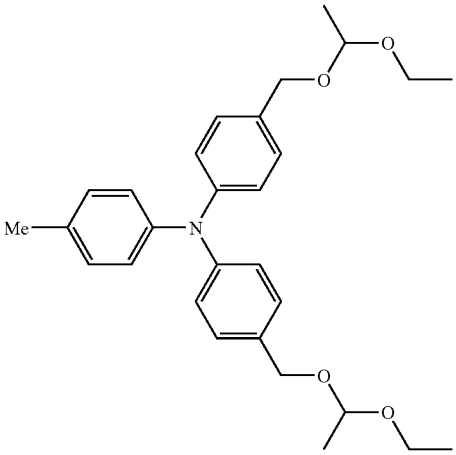
III-11
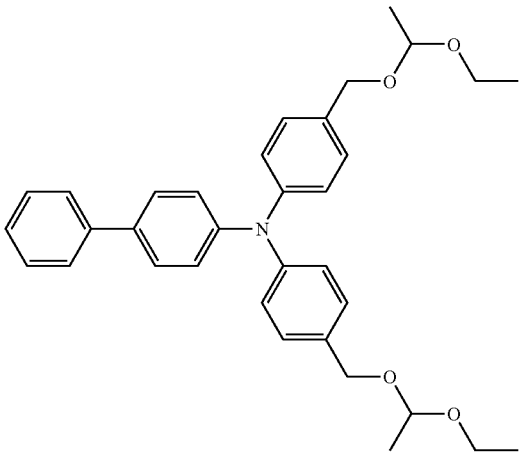
III-12
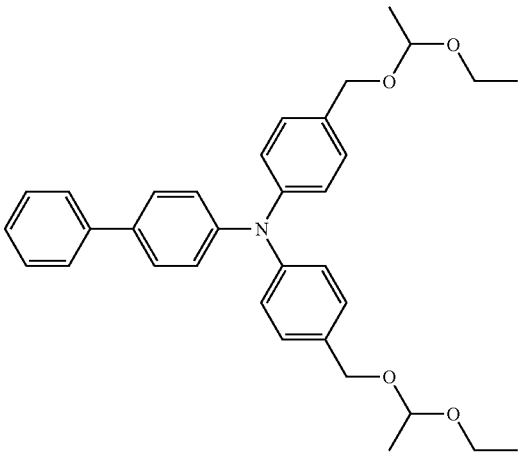

-continued
III-13
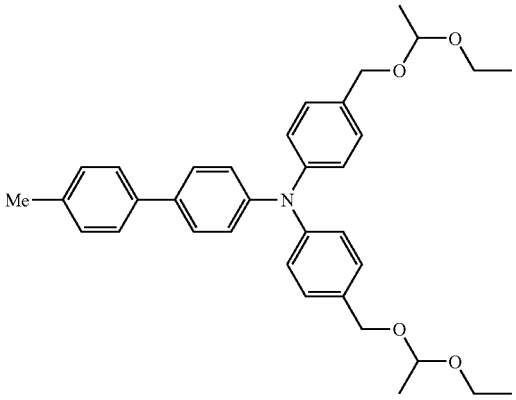
III-14
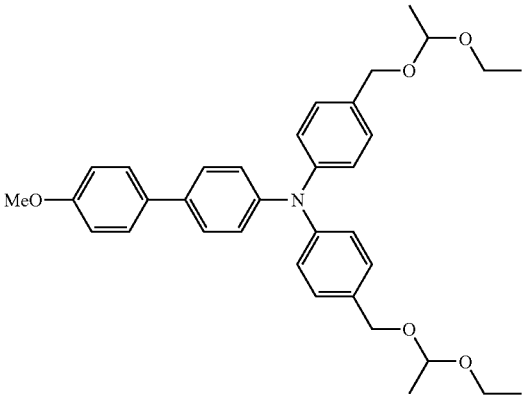
III-15
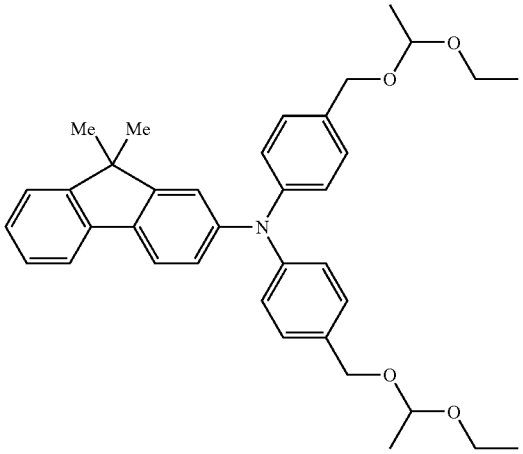
III-16
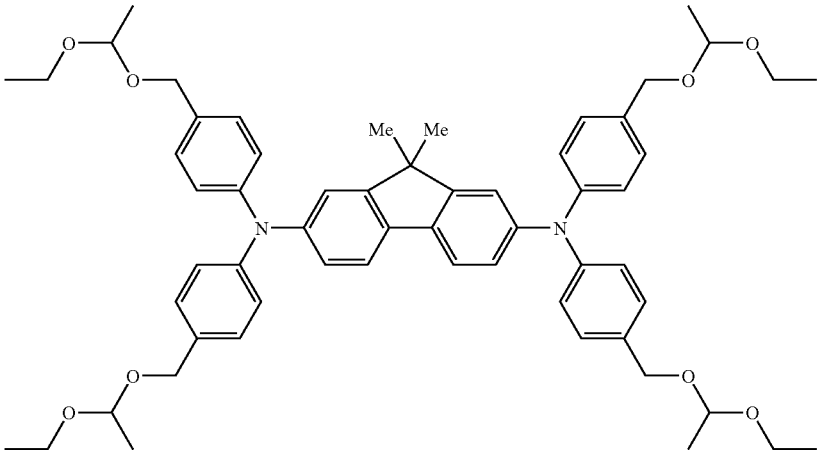

-continued
III-17
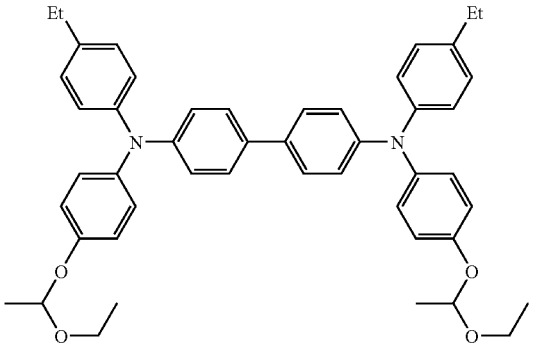
III-18
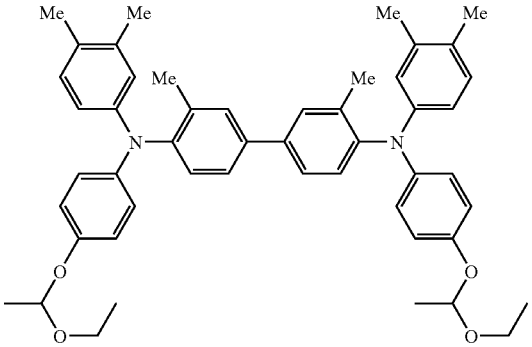
III-19
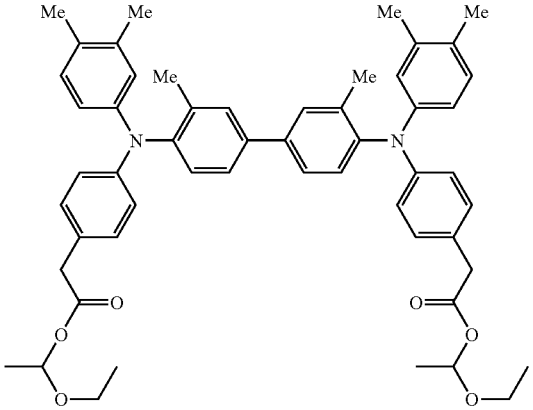
III-20
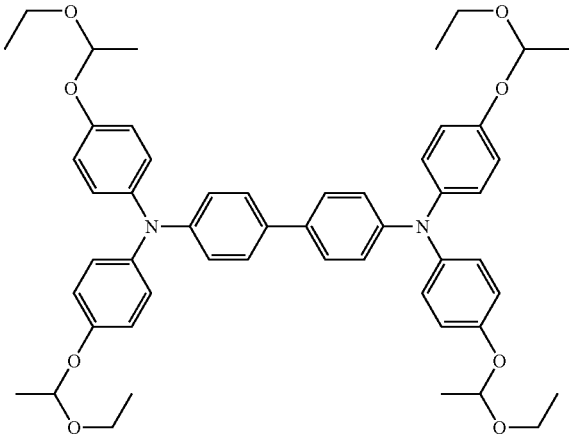
III-21
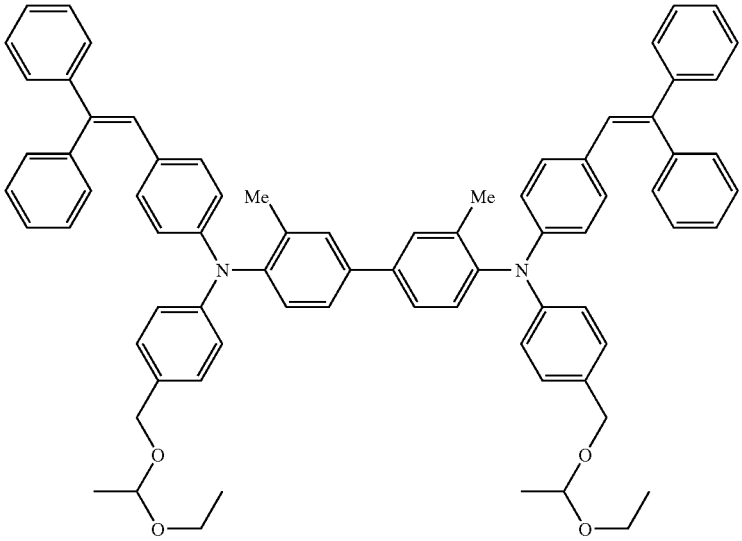

-continued
III-22
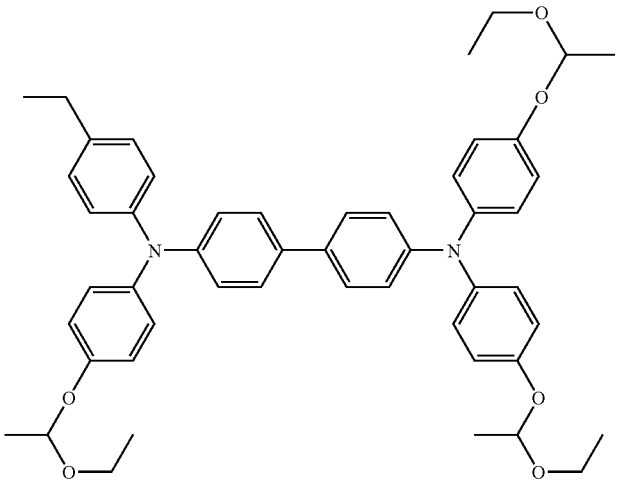
III-23
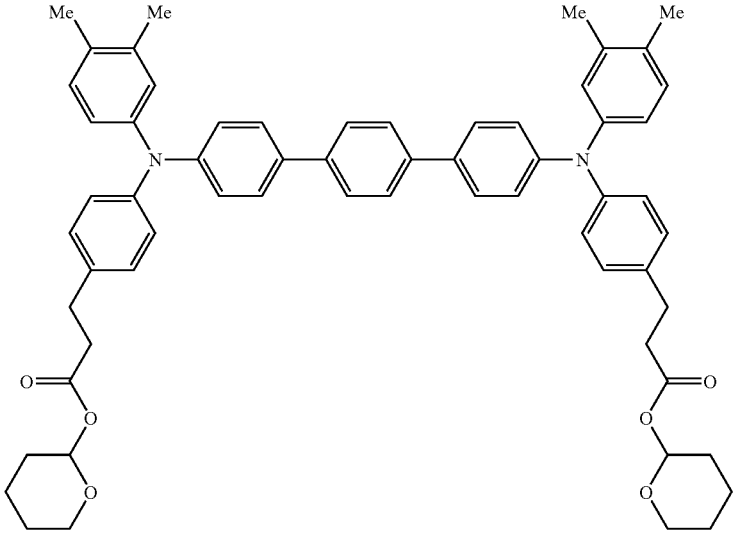
III-24
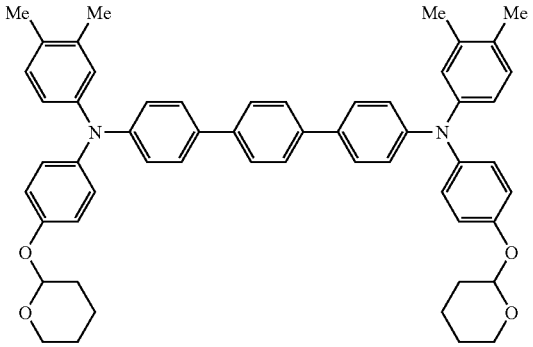
III-25
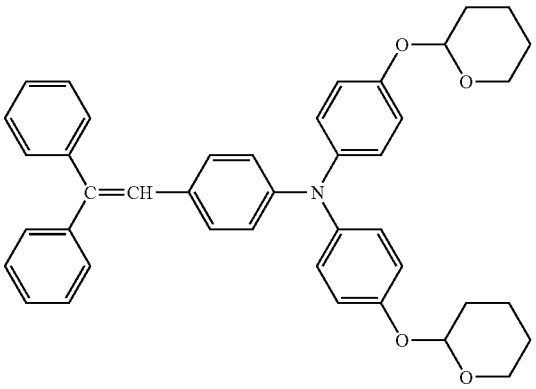

-continued
III-26
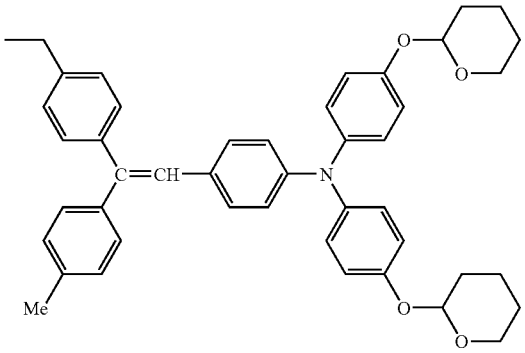
III-27
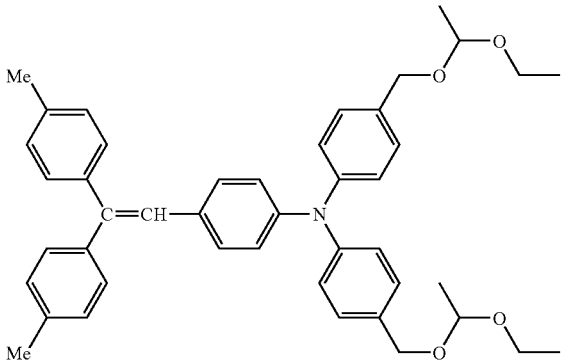
III-28
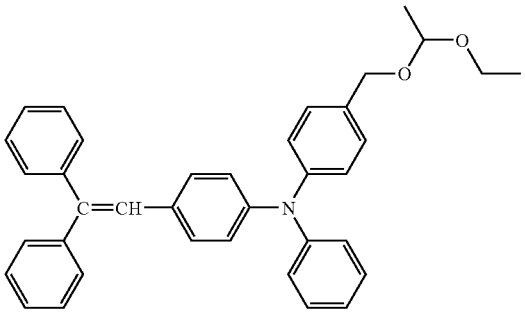
III-29
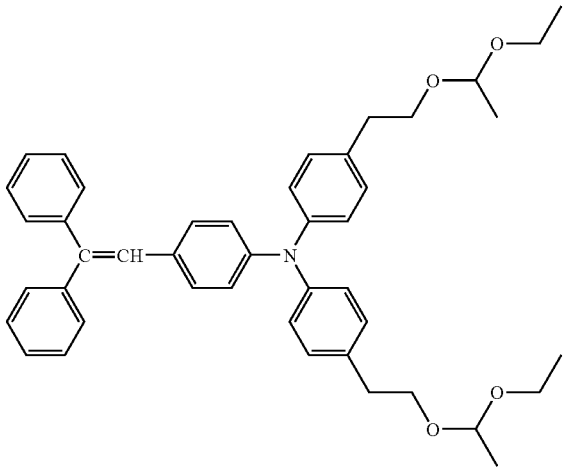
III-30
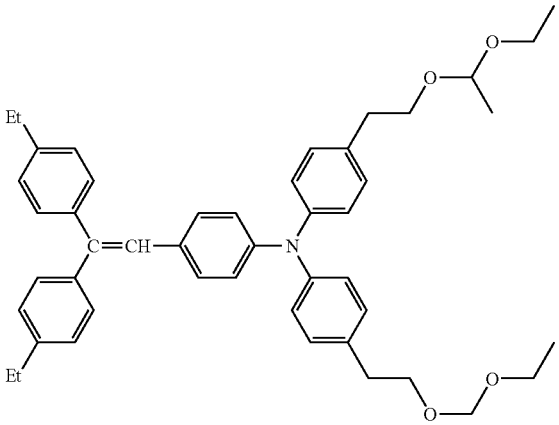
III-31
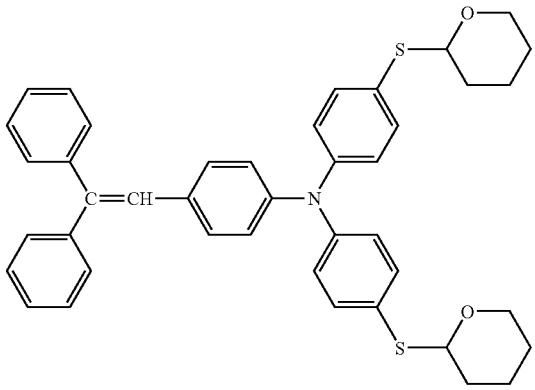

-continued
III-32
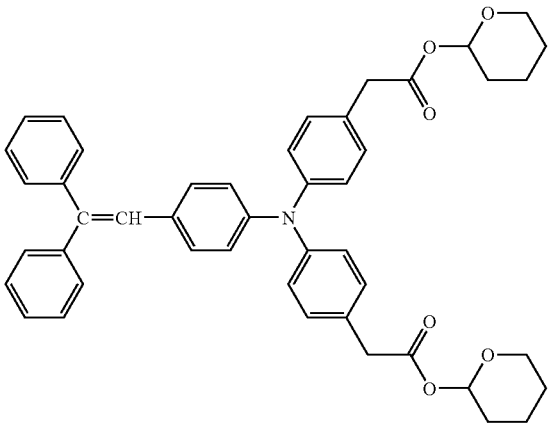
III-33
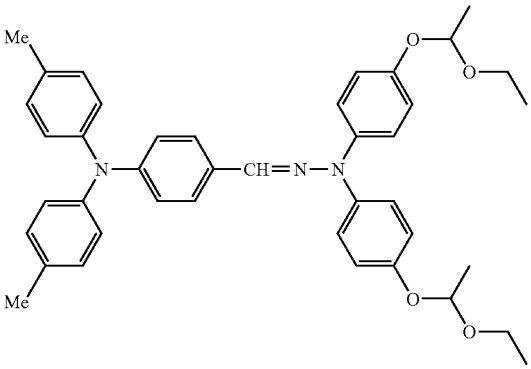
III-34
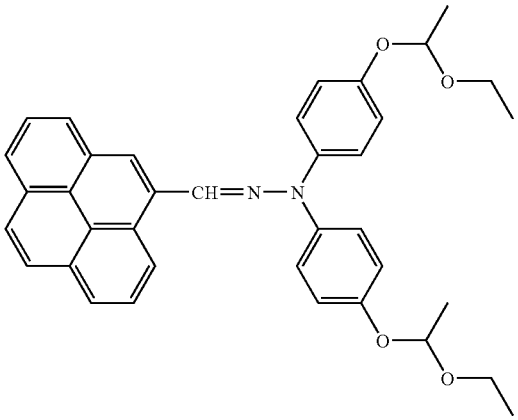
III-35
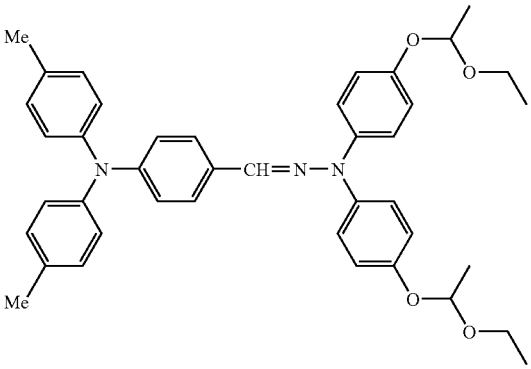
III-36
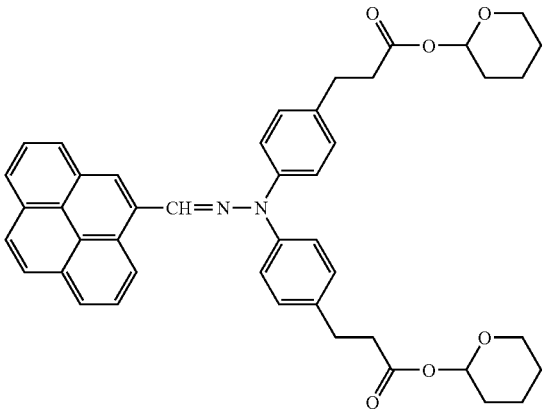
III-37
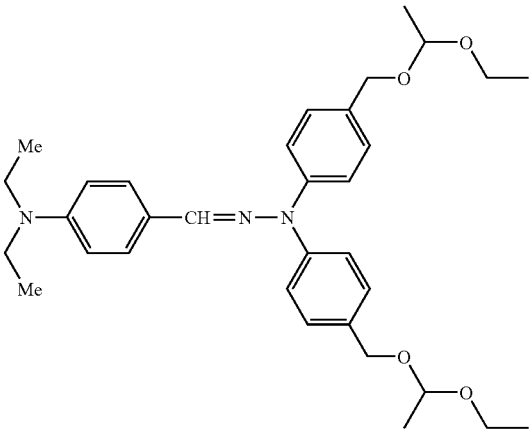

-continued
III-38
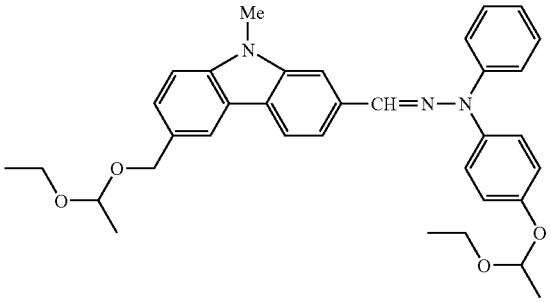
III-39
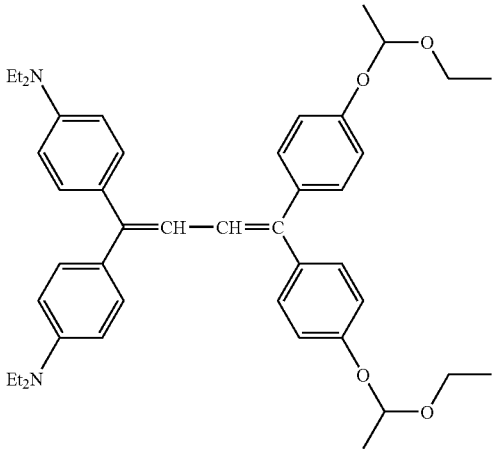
III-40
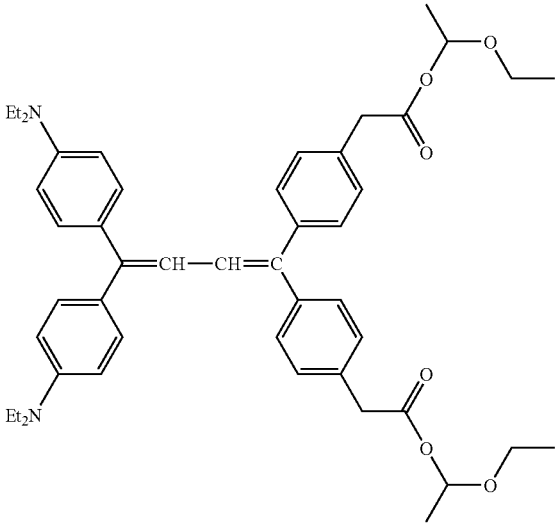
Specific Examples Represented by Formula (IV)
IV-1
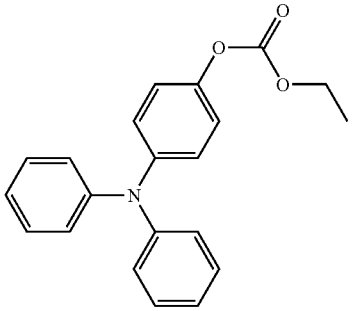
-continued
IV-2
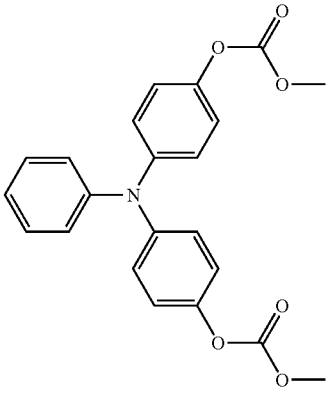

-continued
IV-3
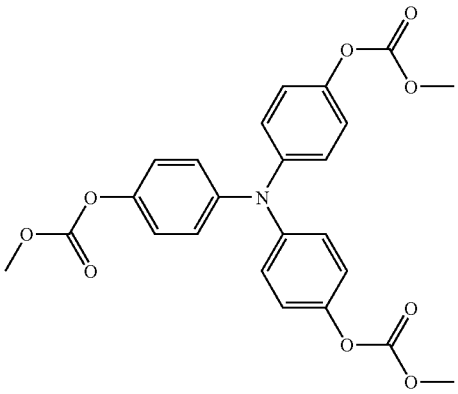
IV-4
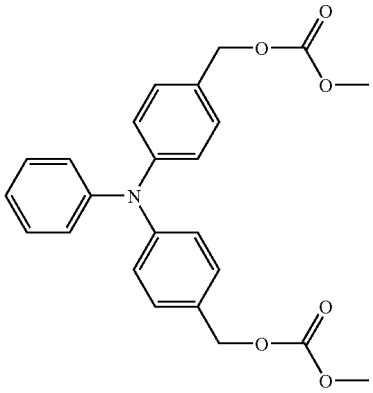
IV-5
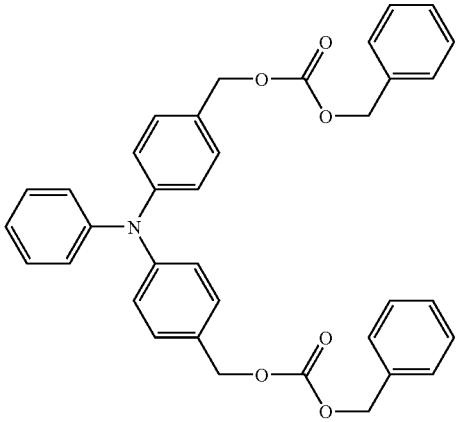
IV-6
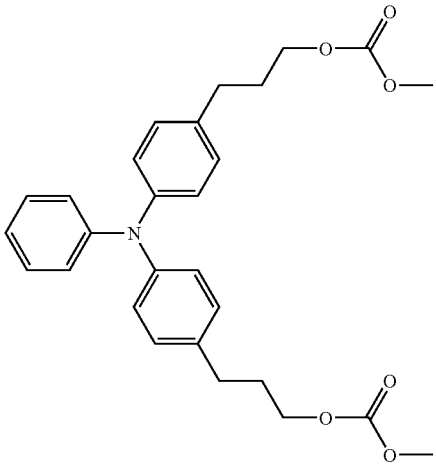
-continued
IV-7
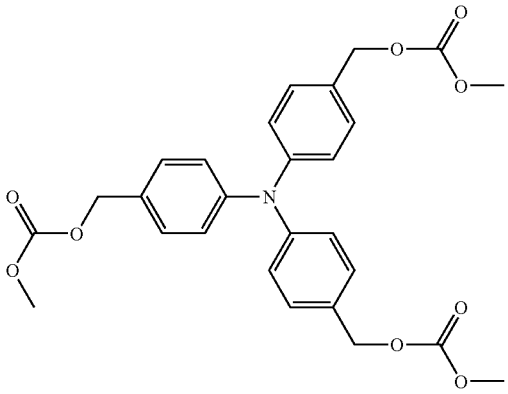
IV-8
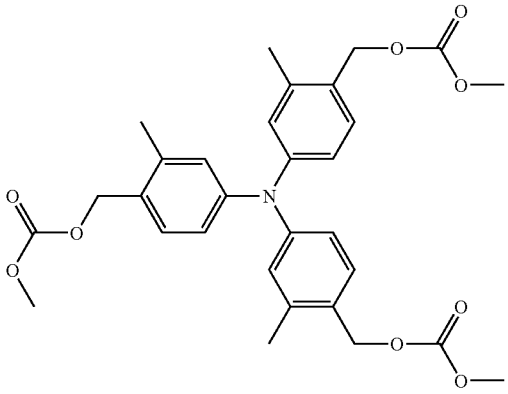
IV-9
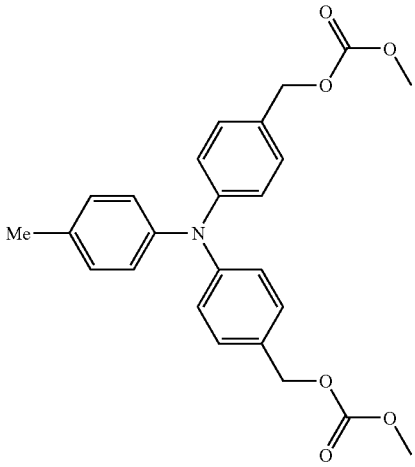

-continued
IV-10
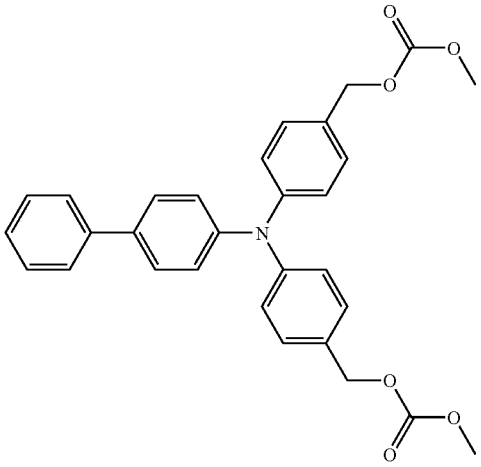
IV-11
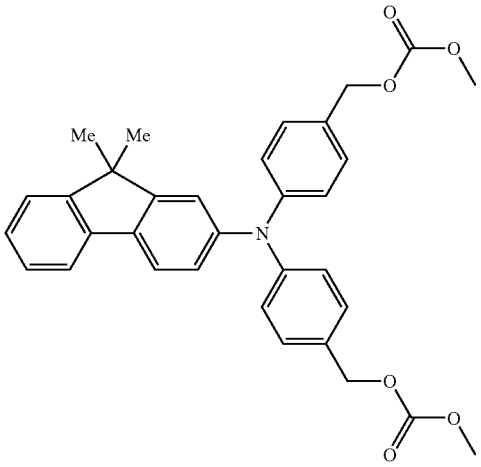
IV-12
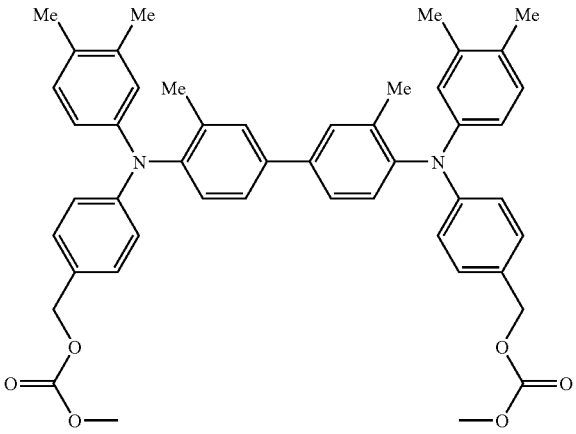
-continued
IV-13
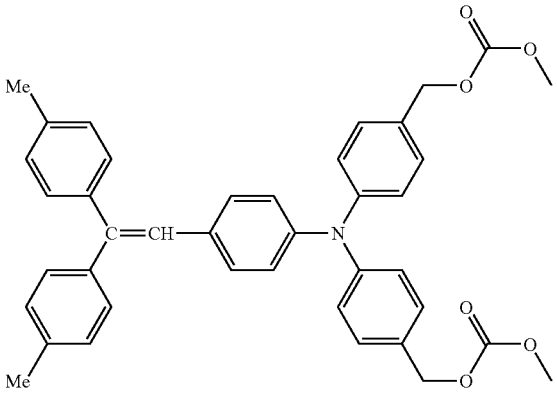
Specific Examples Represented by Formula (V)
V-1
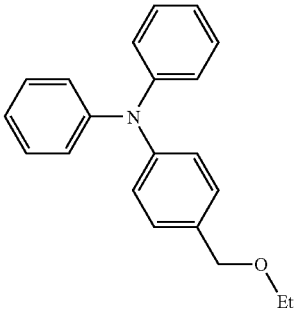
V-2
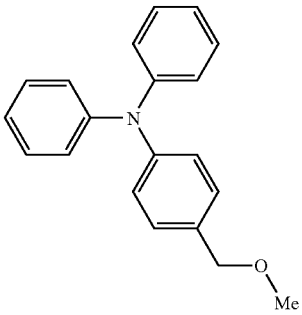
V-3
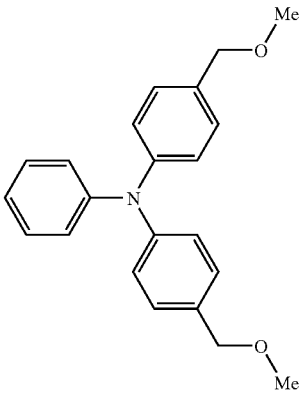

-continued
V-4
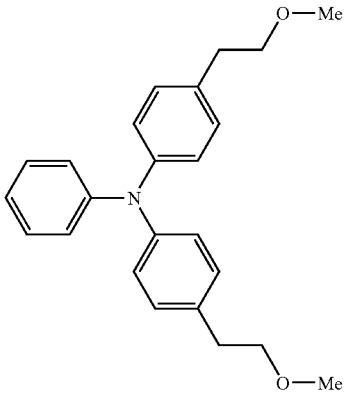
V-5
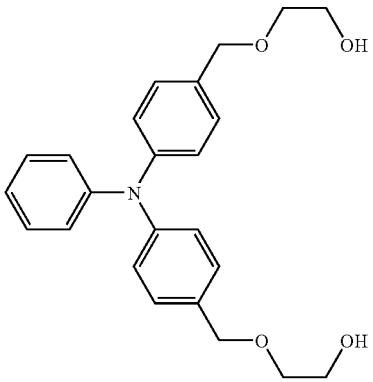
V-6
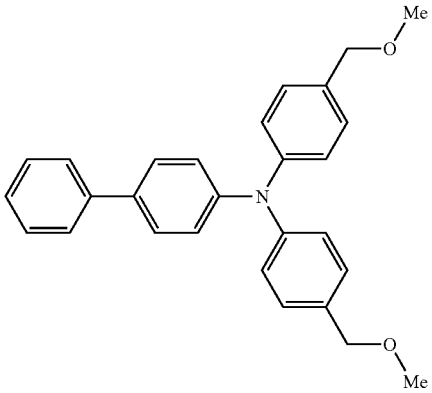
V-7
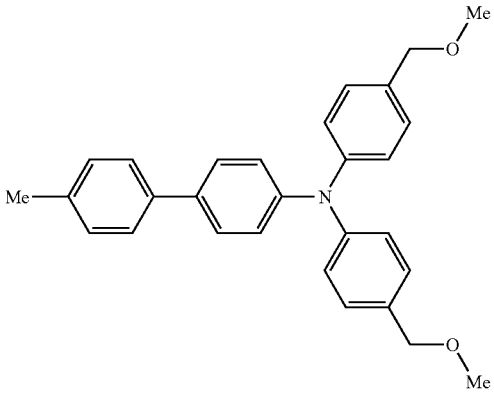
-continued
V-8
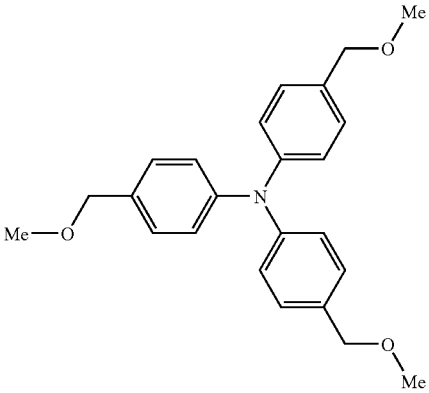
V-9
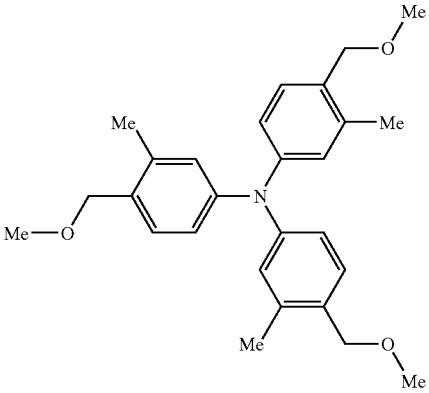
V-10
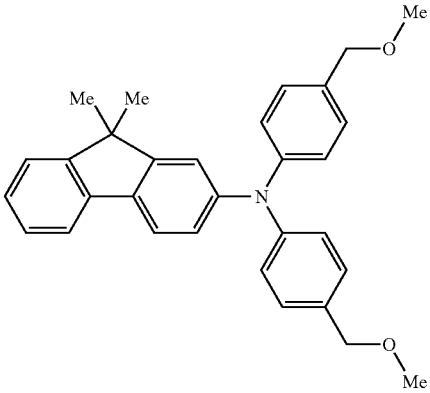
V-11
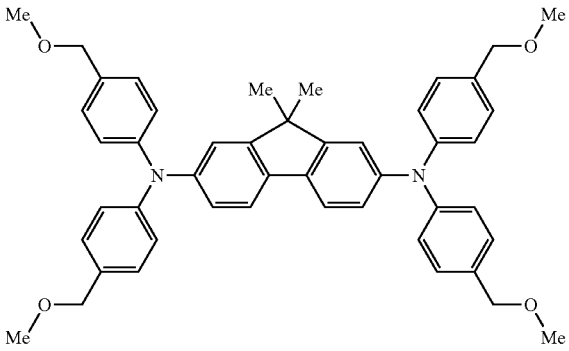

-continued

V-12

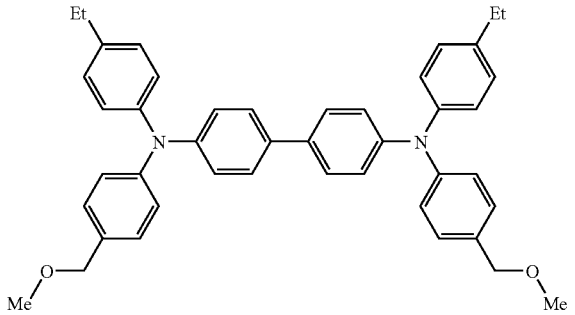

V-13

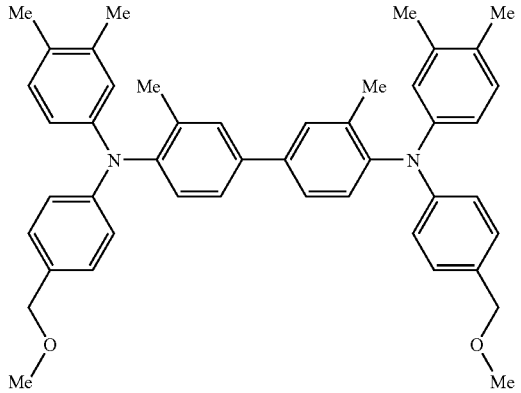

V-14

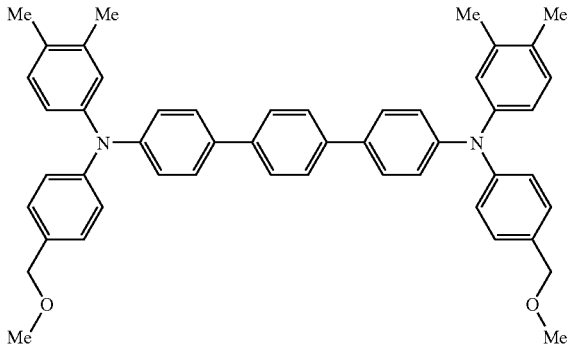

V-15

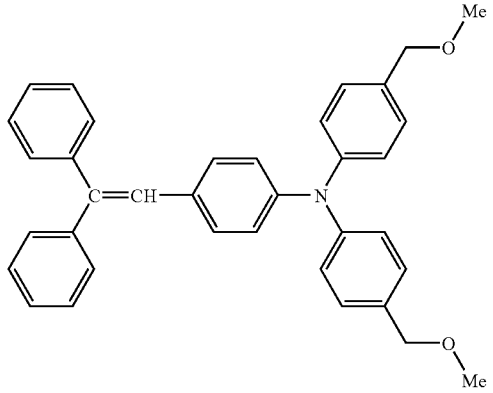

-continued

V-16

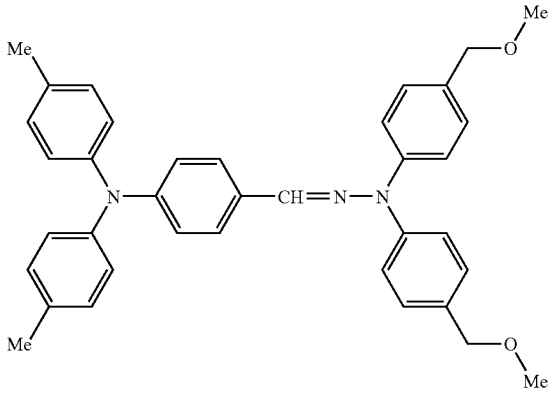

V-17

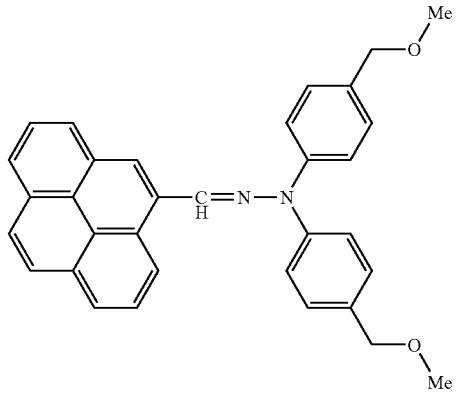

In the charge-transporting layer 3 of the present exemplary embodiment, from the point of view of raising the mechanical strength of the surface of the photoreceptor, it is preferable that, in the charge-transporting layer 3, the proportion of the content of the curable charge transport material with respect to the total amount of the charge transport material increases in the layer thickness direction, from the charge-generating layer toward the external surface 3*b* side.

It is preferable that at the external surface 3*b* of the charge-transporting layer 3 the proportion of the content of charge transport material that is non curable with respect to the total charge transport material is about 10 wt % or less, and more preferably about 5 wt % or less, with less than about 1 wt % being even more preferable.

In contrast, at the interface 3*a* to the charge-generating layer it is preferable that the amount contained of curable charge transport material with respect to the total charge transport material is about 10 wt % or less, and more preferably about 5 wt % or less, with less than about 1 wt % being even more preferable.

In the present exemplary embodiment, it is preferable that, in the charge-transporting layer 3, the proportion of the content of the curable charge transport material with respect to the total amount of charge transport material increases in the layer thickness direction from the charge-generating layer toward the external surface 3*b*, and with regard to the shape of the concentration gradient of the curable charge transport material in the layer thickness direction, examples thereof are as shown in the FIGS. 2A to 2E—but with the text "curable resin" replaced with the text "curable charge transport material". That is to say, the curable charge transport material may increase with single order linearity in the layer thickness direction, or may increase in a curve, or the part having a concentration gradient may be only a portion of the charge-transporting layer 3 in the layer thickness direction.

In the charge-transporting layer 3 of the present exemplary embodiment it is preferable that the fraction that is the total charge transport material (the amount by weight of the sum of the curable charge transport material and the non curable charge transport material) with respect to the total resin (the amount by weight of the sum of the curable resin and thermoplastic resin) is about 20 wt % to about 75 wt %, with about 25 wt % to about 70 wt % being more preferable, and about 30 wt % to about 60 wt % being even more preferable.

3. Other Additives

Additives such as antioxidants, light stabilizers, heat stabilizers, and the like, may be added to the charge-transporting layer 3. Examples that may be given of such antioxidants include, for example, hindered phenols, hindered amines, paraphenylenediamine, aryl alkanes, hydroquinones, spirochromans, spiroindanones and derivatives thereof, organosulfur compounds, organophosphorus compounds, and the like. Examples of light stabilizers include, for example, derivatives, such as benzophenone, benzotriazol, dithiocarbamate, and tetramethylpiperidine.

Furthermore, the charge-transporting layer 3 may be made to contain one or more type of electron-accepting substance. The following may be used as such an electro-accepting substance, for example, succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitro anthraquinone, trinitro fluorenone, picric acid, o-nitrobenzoic acid, p-nitrobenzoic acid, phthalic acid, and the like. Among these, fluorenone based derivatives, quinone based derivatives, and benzene derivatives having electron withdrawing substituents such as Cl, CN, and $NO_2$, are particularly preferable.

Furthermore, mixtures of other coupling agents and fluorine compounds may also be use in the charge-transporting layer 3. Various silane coupling agents and commercial silicone based hard coat agents may be used for these compounds.

Silane coupling agents include, for example, vinyl trichlorosilane, vinyl trimethoxy silane, vinyl triethoxy silane, γ-glycidoxy propyl methyl diethoxy silane, γ-glycidoxy propyl trimethoxy silane, γ-glycidoxy propyl triethoxy silane, γ-aminopropyl triethoxy silane, γ-aminopropyl trimethoxy silane, γ-aminopropyl methyl dimethoxy silane, N-β(aminoethyl) γ-aminopropyl triethoxy silane, tetramethoxy silane, methyl trimethoxy silane, dimethyl dimethoxy silane, or the like.

The commercial hard coating agents include, for example, KP-85, X-40-9740, X-40-2239 (manufactured by Shin-Etsu Chemical Co., Ltd), AY42-440, AY42-441 or AY49-208 (manufactured by Dow Corning Toray). For conferring water repellency etc., fluorine-containing compounds such as (tridecafluoro-1,1,2,2-tetrahydrooctyl) triethoxy silane, (3,3,3-trifluoropropyl) trimethoxy silane, 3-(heptafluoroisopropoxy) propyl triethoxy silane, 1H,1H,2H,2H-perfluoroalkyl triethoxy silane, 1H,1H,2H,2H-perfluorodecyl triethoxy silane and 1H,1H,2H,2H-perfluoroctyl triethoxy silane may be added.

It is preferable that the amount contained of a fluorine containing compound is 0.25 times by weight the amount of the non-fluorine containing compound or less. If the amount used exceeds this amount then a problem may arise in the film forming characteristics of the curing layer.

Moreover, a resin that dissolves in an alcohol may also be added to the charge-transporting layer 3. The following examples may be given of such alcohol soluble resins, for example, polyvinyl butyral resins, polyvinyl formal resins, polyvinyl acetal resins such as partially acetalized polyvinyl acetal resin, in which a portion of the butyral is denatured by formal, acetoacetal, or the like (for example, the S-LEC B, K manufactured by Sekisui Chemical Co., Ltd.), polyamide resins, cellulosic resins, polyvinyl phenol resins and the like. Polyvinyl acetal resins and polyvinyl phenol resins are particularly preferable in view of their electrical properties.

The weight average molecular weight of the resin is preferably from about 2,000 to about 100,000 and more preferable from about 5,000 to about 50,000. It is preferable that the amount added of such a resin is from about 1 wt % to about 40 wt %, more preferably from about 1 wt % to about 30 wt %, and further preferably from about 5 wt % to about 20 wt % with respect to the amount of total solids of the charge-transporting layer 3.

It is preferable that an antioxidant is added to the charge-transporting layer 3. By raising the mechanical hardness of the surface of the photoreceptor, the life of the photoreceptor is extended, and, since the photoreceptor might be in contact with oxidizing gases for a long period of time, stronger resistance to oxidation than before has been required.

As an antioxidant, a hindered phenol based or a hindered amine based antioxidant is preferable, and well-known organic sulfur based antioxidants, phosphite based antioxidants, dithiocarbamate based antioxidants, thiourea based antioxidants, benzimidazole based antioxidants, and the like may be used. It is preferable that the addition amount of an antioxidant is about 20 wt % or less, with about 10 wt % or less being more preferable.

For hindered phenolic antioxidants the following examples may be given, including, for example, 2,6-di-t-butyl-4-methyl phenol, 2,5-di-t-butylhydroquinone, N,N'-hexamethylene bis(3,5-di-t-butyl-4-hydroxyhydrocinnamide) 3,5-di-t-butyl-4-hydroxy-benzylphosphonate-diethylester, 2,4-bis [(octylthio) methyl]-o-cresol, 2,6-di-t-butyl-4-ethylphenol, 2,2'-methylenebis(4-methyl-6-t-butyl phenol) 2,2'-methylenebis (4-ethyl-6-t-butyl phenol), 4,4'-butylidenebis(3-methyl-6-t-butyl phenol) 2,5-di-t-amylhydroquinone, 2-t-butyl-6-(3-butyl-2-hydroxy-5-methylbenzyl)-4-methylphenylacrylate, 4,4'-butylidenebis(3-methyl-6-t-butyl phenol), and the like.

Furthermore, various particles may also be added to the charge-transporting layer 3. Examples that may be given of such particles are particles that contain silicon. Silicon containing particles are particles which contain silicon in their constituent elements, and, specific examples thereof which may be given include colloidal silica, silicone particles or the like.

Colloidal silica used as the silicon containing particles may be suitably selected from silica particles, having a mean particle diameter of from about 1 nm to about 100 nm, and preferably from about 10 nm to about 30 nm, in acidic or alkali aqueous dispersions, or in organic solvent dispersions, such as alcohol, ketone, or esters, and generally available colloidal silicas may be used.

Although the solid content of the colloidal silica in the charge-transporting layer 3 is not particularly limited, in view of the film forming ability, electrical properties, and hardness, the amount used is preferably in the range from about 0.1 wt % to about 50 wt % with respect to the amount of total solids of the charge-transporting layer 3, and the amount used is more preferably from about 0.1 wt % to about 30 wt %.

As silicone particles used for the silicon containing particles, these may be selected from silicone resin particles, silicone rubber particles, and silicone-surface-treated silica particles, and generally available particles may be used therefore. These silicone particles are substantially spherical, and preferably have a mean particle diameter of from about 1 nm to about 500 nm, and more preferably from about 10 nm to about 100 nm.

The amount contained of the silicone particles in the charge-transporting layer 3 is preferably about 0.1 wt % to about 30 wt % with respect to the amount of total solids of the charge-transporting layer 3, and is more preferably from about 0.5 wt % to about 10 wt %.

Examples of other particles are fluorine-containing particles of ethylene tetrafluoride, ethylene trifluoride, propylene hexafluoride, vinyl fluoride or vinylidene fluoride; resin particles of a copolymer of fluororesin and hydroxyl group-containing monomer described in Preprint for 8th Polymer Material Forum Meeting, p. 89; and metal oxides such as $ZnO—Al_2O_3$, $SnO_2—Sb_2O_3$, $In_2O_3—SnO_2$, $ZnO_2—TiO_2$, $ZnO—TiO_2$, $MgO—Al_2O_3$, $FeO—TiO_2$, $TiO_2$, $SnO_2$, $In_2O_3$, ZnO or MgO.

These may be used independently, or in combinations of two or more types. When using combinations of two or more types, they may be simply mixed together, or they may be made into forms of solid solutions or fused together. It is preferable that the mean particle diameter of the particles is about 0.3 μm or smaller, and it is particularly preferably about 0.1 μm or smaller.

Moreover, oils, such as silicone oils, may also be added to the charge-transporting layer 3. Examples that may be given of silicone oils, include, for example: silicone oils, such as dimethylpolysiloxane, diphenylpolysiloxane, and phenylmethyl siloxane; reactive silicone oils, such as amino-denatured polysiloxane, epoxy-denatured polysiloxane, carboxyl-denatured polysiloxane, carbinol-denatured polysiloxane, methacryl-denatured polysiloxane, mercapto-denatured polysiloxane, and phenol-denatured polysiloxane; cyclic dimethylcyclosiloxanes, such as hexamethylcyclotrisiloxane, octamethylcyclotetrasiloxane, decamethylcyclopentasiloxane, dodecamethylcyclohexasiloxane; cyclic methylphenylcyclosiloxanes, such as 1,3,5-trimethyl-1,3,5-triphenylcyclotrisiloxane, 1,3,5,7-tetramethyl-1,3,5,7-tetraphenylcyclotetrasiloxane, 1,3,5,7,9-pentamethyl-1,3,5,7,9-pentaphenylcyclopentasiloxane; cyclic phenylcyclosiloxanes such as hexaphenylcyclotrisiloxane; fluorine-containing cyclosiloxanes, such as (3,3,3-trifluoropropyl) methylcyclotrisiloxane; hydrosilyl group containing cyclosiloxanes, such as methylhydrosiloxane mixtures, pentamethylcyclopentasiloxane and phenylhydrocyclosiloxane; vinyl group containing cyclosiloxanes, such as pentavinylpentamethylcyclopentasiloxane.

The thickness of the charge-transporting layer 3 is preferably from about 5 μm to about 50 μm, is more preferably from about 10 μm to about 40 μm, and is even more preferably from about 15 μm to about 35 μm.

4. Method of Producing the Charge-Transporting Layer 4-1. Coating Method

Since charge-transporting layer 3 of the present exemplary embodiment has a continuous gradient (concentration distribution) of the proportion of the content of the curable resin in the layer thickness direction within the single charge-transporting layer 3, it is preferable to form the coating layer using an inkjet method.

In the liquid droplets ejected from a liquid droplet discharge head in an inkjet method, the solids concentration thereof increases during the flight as the liquid droplets reach the base material. The liquid droplets coalesce with each other on the base material and leveling occurs to form a liquid film, and a dry coating film is formed by further drying and solidifying. An indicator L showing the ease of leveling is a function of the surface tension of the coating film, the wet layer thickness, the viscosity and the wavelength. The contribution of the wavelength is the greatest, and the leveling properties are raised by increasing the resolution at the time of impact.

Therefore, by using an inkjet method, which may eject to the target position liquid droplets with a small variation in liquid droplet diameter, a thin layer may be formed with precisely controlled concentration distribution and layer thickness distribution.

For the ejecting method of an inkjet method, there are generally used continuous methods and intermittent methods (such as piezo-type (using piezo electric elements), thermal-type (using heat element), and electrostatic-type). A piezo continuous or intermittent method is preferable, and a piezo intermittent method is more preferable.

The FIGS. 3 to 12 below, are explanatory diagrams of a scanning intermittent inkjet method, but the charge-transporting layer 3 of the present exemplary embodiment is not limited to being formed by this method. A scanning method is a method in which liquid coating is carried out by ejecting liquid droplets while scanning a liquid droplet discharge head in a direction that is parallel to the axial direction of a cylindrical support.

Figure 3:
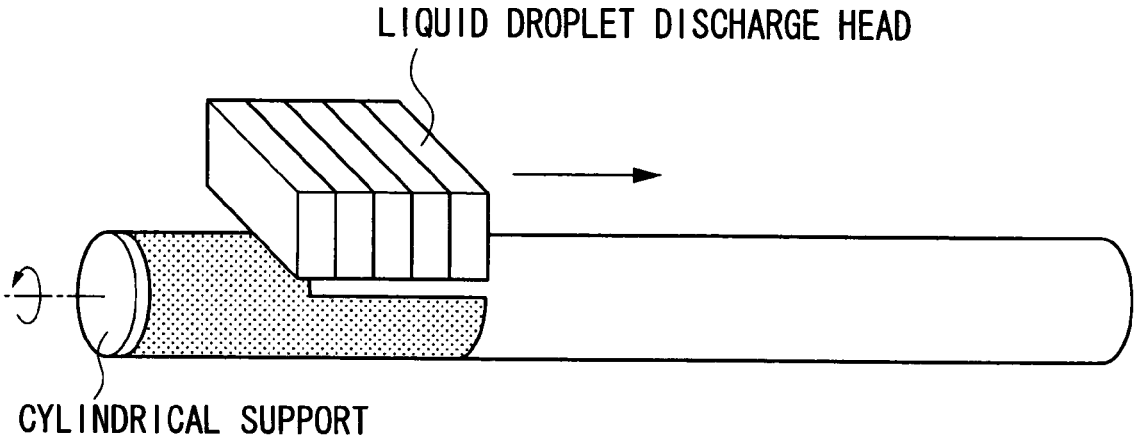
FIG. 3 is an illustration showing an example of an inkjet method in the case where two or more droplet discharge heads are arranged in a matrix.

FIG. 3 is an example of an inkjet method using a liquid droplet discharge head of a normal inkjet printer, and this liquid droplet discharge head has plural nozzles along the length direction thereof, with plural liquid droplet discharge heads arranged in a matrix. In the figure there is a simple syringe illustrated for supplying liquid. When the axis of a cylindrical support is placed in the horizontal, then coating is generally carried out of a cylindrical support while the support is being rotated. The resolution of the ejecting, which has an influence on the quality of the coating film, is determined by the angle of the nozzle rows to the scanning direction.

Figure 4:
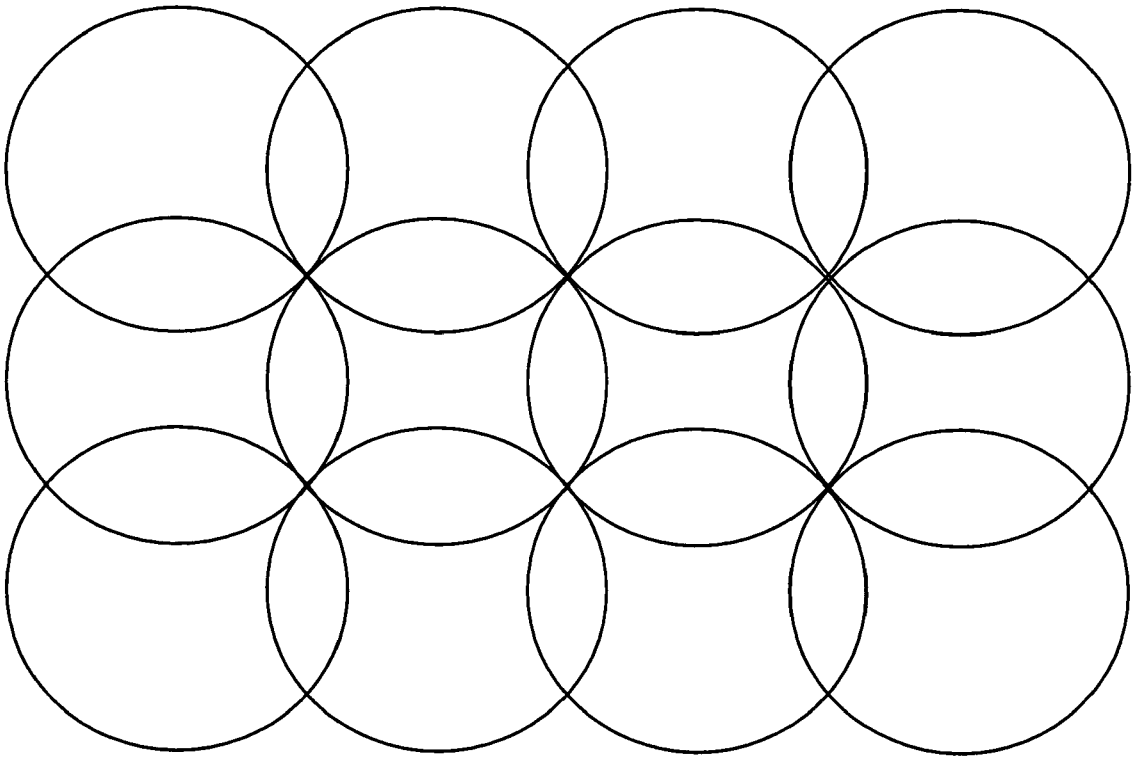
FIG. 4 is an explanatory diagram of the appearance of liquid droplets of application liquid on impact with an inkjet method.

It is preferable that the resolution of the ejecting liquid droplets (number of pixels of coating liquid per inch) is adjusted such that, as is shown in FIG. 4, after the liquid droplets have impacted, the liquid droplets spread out and neighboring liquid droplets touch each other, so that finally a film is formed. Coating may be carried out with consideration to the surface tension of the base material, and way in which the liquid droplets spread out on impact, the size of the liquid droplets at ejecting, the concentration of coating solvent and the type of coating solvent, which are influences on the speed of solvent evaporation and the like. These conditions are determined according to the type of material and material composition of the coating liquid, and the physical properties of the surface to be coated, and it is preferable that they are adjusted.

Figure 5A:
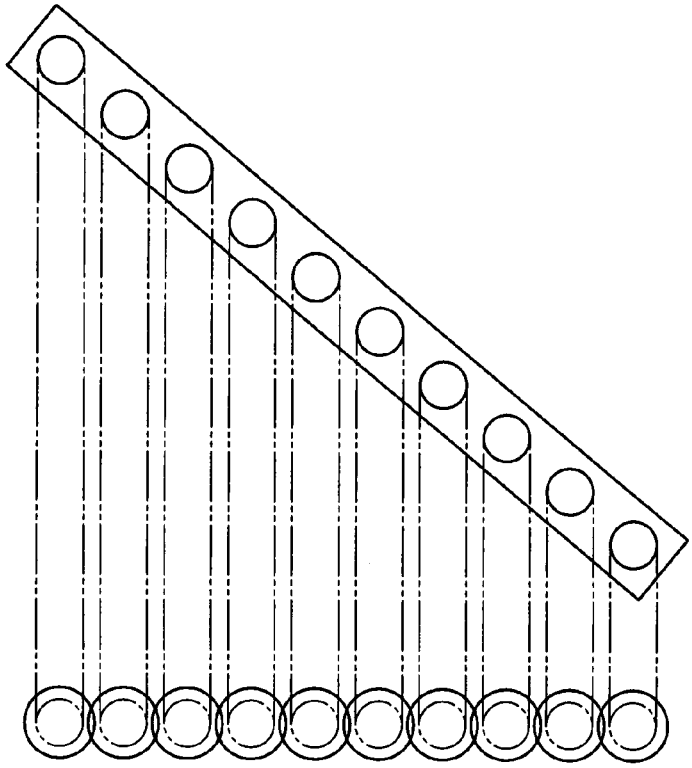
FIGS. 5A and 5B are illustrations showing methods of forming a charge-generating layer by an inkjet method.
Figure 5B:
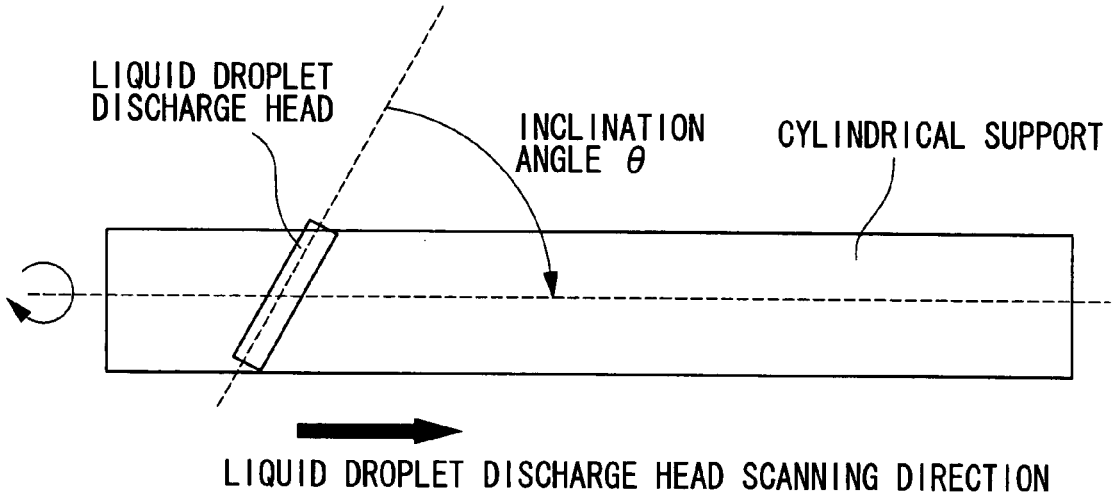

However, since it is difficult to reduce the distance between nozzles in the above piezo-type inkjet liquid droplet discharge head and to raise the resolution, it is preferable that the nozzle arrangement spacing is considered, and each of the liquid droplet discharge heads are placed at an angle to the axis of the photoreceptor, as shown in FIGS. 5A and 5B, so that after liquid droplets have been ejected and impacted, neighboring liquid droplets touch each other, as shown in FIG. 4, this giving a higher resolution appearance. As is shown in FIG. 5A, the diameters of the liquid droplets on just ejecting, shown by dotted lines, are of the same order as the diameter of the nozzles, but after impacting on the surface of the cylindrical support the liquid droplets spread out to touch neighboring liquid droplets, as shown by the solid lines, and form a layer.

Figure 6:
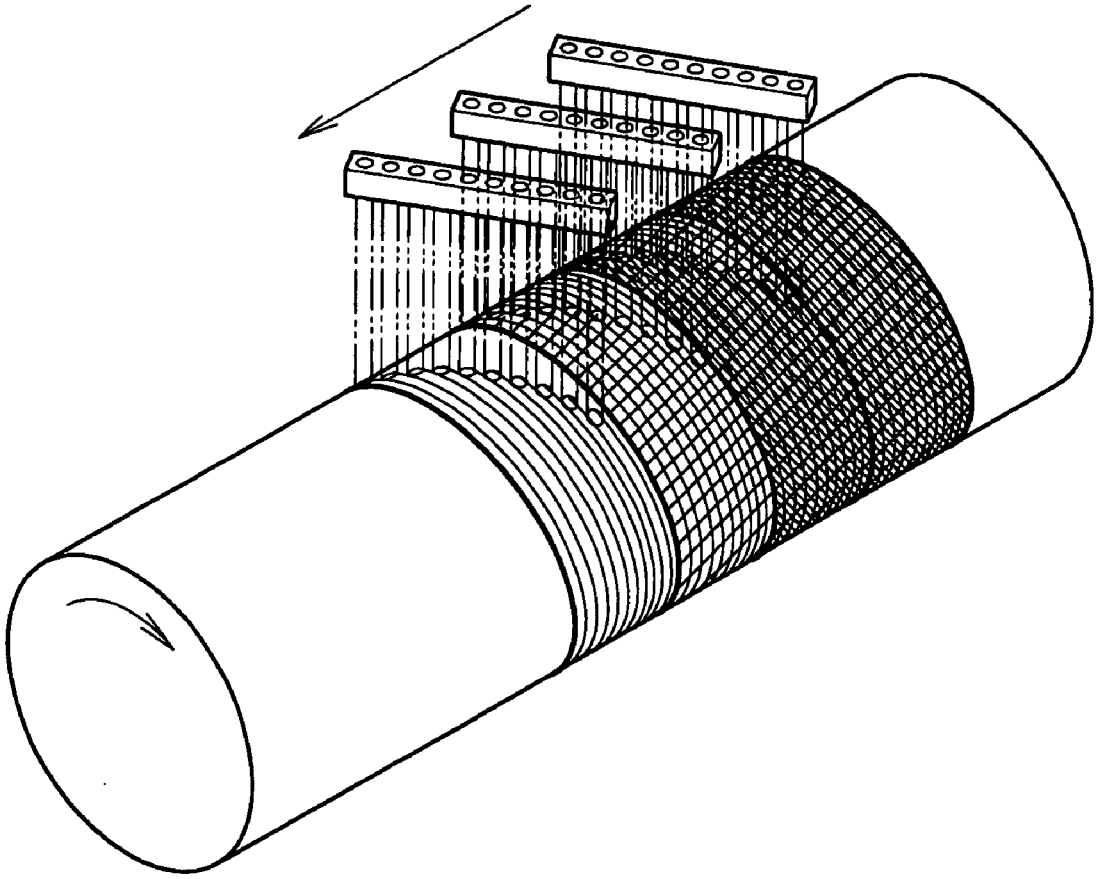
FIG. 6 is an illustration showing a method of a forming a charge-transporting layer using an inkjet method.

In this state, the cylindrical support is rotated, and coating liquid is ejected from the nozzles, and, the liquid droplet discharge heads are horizontally moved from the one end portion of the cylindrical support to the opposite end portion thereof, as shown in FIG. 6. Superimposed coating is carried out to make the thickness of the charge-transporting layer thicker.

Specifically, the cylindrical support is mounted in a device that is able to rotate the cylindrical support horizontally, and liquid droplet discharge heads that have been filled with charge-transporting layer coating liquid are disposed so that liquid droplets are ejected onto the cylindrical support. Since the radius of the cylinder on to which ejecting takes place is small, it is preferable that the nozzles that do not cause liquid droplets to impact onto the cylinder are closed off, from the point of view of reducing the amount of waste liquid.

In this case a base material to be coated that is in the shape of a cylinder has been shown, however, relative movement may be made of a base material and liquid droplet discharge heads for a base material to be coated that has a flat surface.

Figure 7:
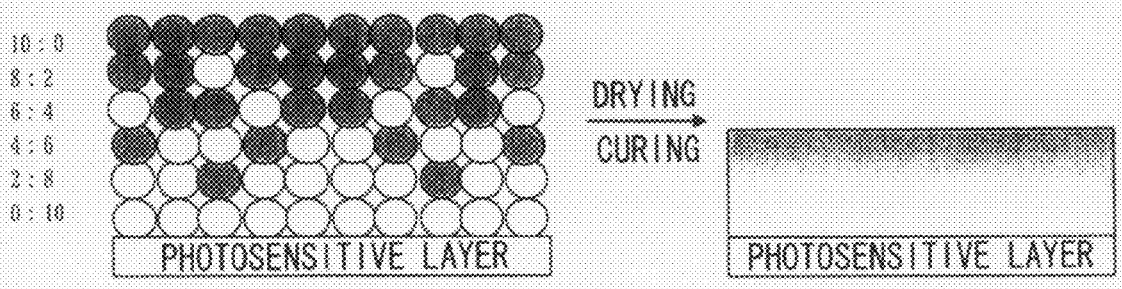
FIG. 7 is a representational diagram showing an exemplary embodiment when forming a charge-transporting layer according to the present invention by an inkjet method.

The concentration gradient of the curable resin in the layer thickness direction of the charge-transporting layer 3 may be formed, for example, when there is a coating liquid A that has a high concentration of curable resin and a coating liquid B that has a low concentration of curable resin, by gradually changing the proportions ejected of coating liquid A and coating liquid B, for example from 0:5, to 1:4, to . . . 4:1, to 5:0, as shown in FIG. 7. With this method, a concentration gradient of the curable resin may be formed by a minimum of two coating liquids.

Figure 8:
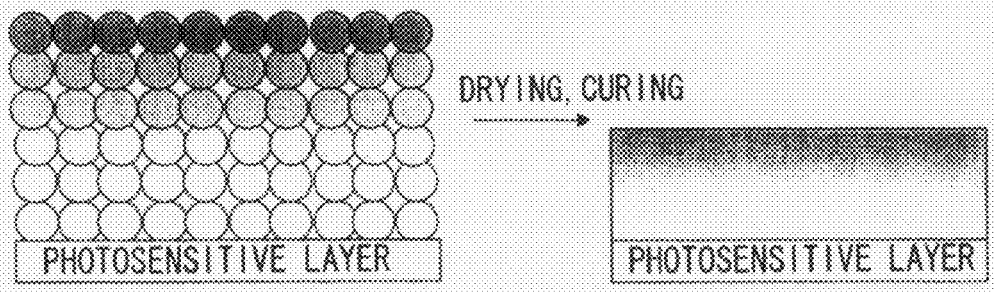
FIG. 8 is a representational diagram showing another exemplary embodiment when forming a charge-transporting layer according to the present invention by an inkjet method.

Furthermore, by providing plural inkjet liquid droplet discharge heads, arranged in order according to the concentration of plural kinds of coating liquid of different concentrations of curable resin, then, as shown in FIG. 8, an inclined concentration gradient layer may be formed by ejecting coating liquids in sequence such that the concentration of the curable resin increases. In this method, a concentration gradient of the curable resin may even be formed simply by changing the kind of the coating liquid, without the need to change the control conditions such as the ejecting amount and ejecting position when ejecting.

If, in the above description, curable resin is replaced by curable charge transport material, then a concentration gradient of curable charge transport material may be formed.

FIGS. 7 and 8 are schematic images for explaining the pattern when the charge-transporting layer 3 of the present exemplary embodiment is formed by an inkjet method, and, of course, the present exemplary embodiment is not limited to the schematic images, in which there is a continuous presence of the liquid droplet state at the photoreceptor layer.

In order to achieve the curved increases in the ratio contained of the curable resin in the layer thickness direction, as shown in FIGS. 2B and 2C, the ejecting proportions of two kinds of coating liquid that have different ratios of curable resin contained therein may by changed along the curved lines, or plural kinds of coating liquid may be prepared with different concentrations of curable resin to match the curved lines, and the these liquids ejected in order of concentration.

It is preferable to adjust the thickness of the charge-transporting layer 3 in consideration of the resolution of the ejecting of the liquid droplets, the way in which the liquid droplets spread out on impact, the size of the liquid droplets on ejecting, and the solvent evaporation speed that stems from the concentration of coating solvent and the coating solvent and the like.

Figure 9:
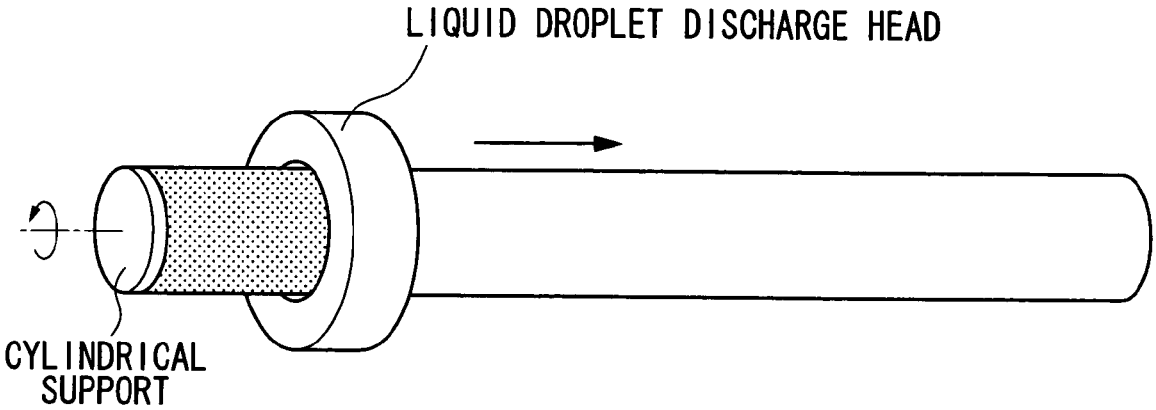
FIG. 9 is an example of an inkjet method using a liquid droplet discharge head designed so as to surround the circumference of a cylindrical support.

FIG. 9 shows a design such that a liquid droplet discharge head surrounds the circumference of a base material to be coated. Ejection nozzles are normally formed at a uniform spacing in the circumferential direction. By using a cylindrical liquid droplet discharge head, there is less unevenness of the layer thickness in the circumferential direction, and it is possible to form a layer without noticeable spiral stripes.

Figure 10:
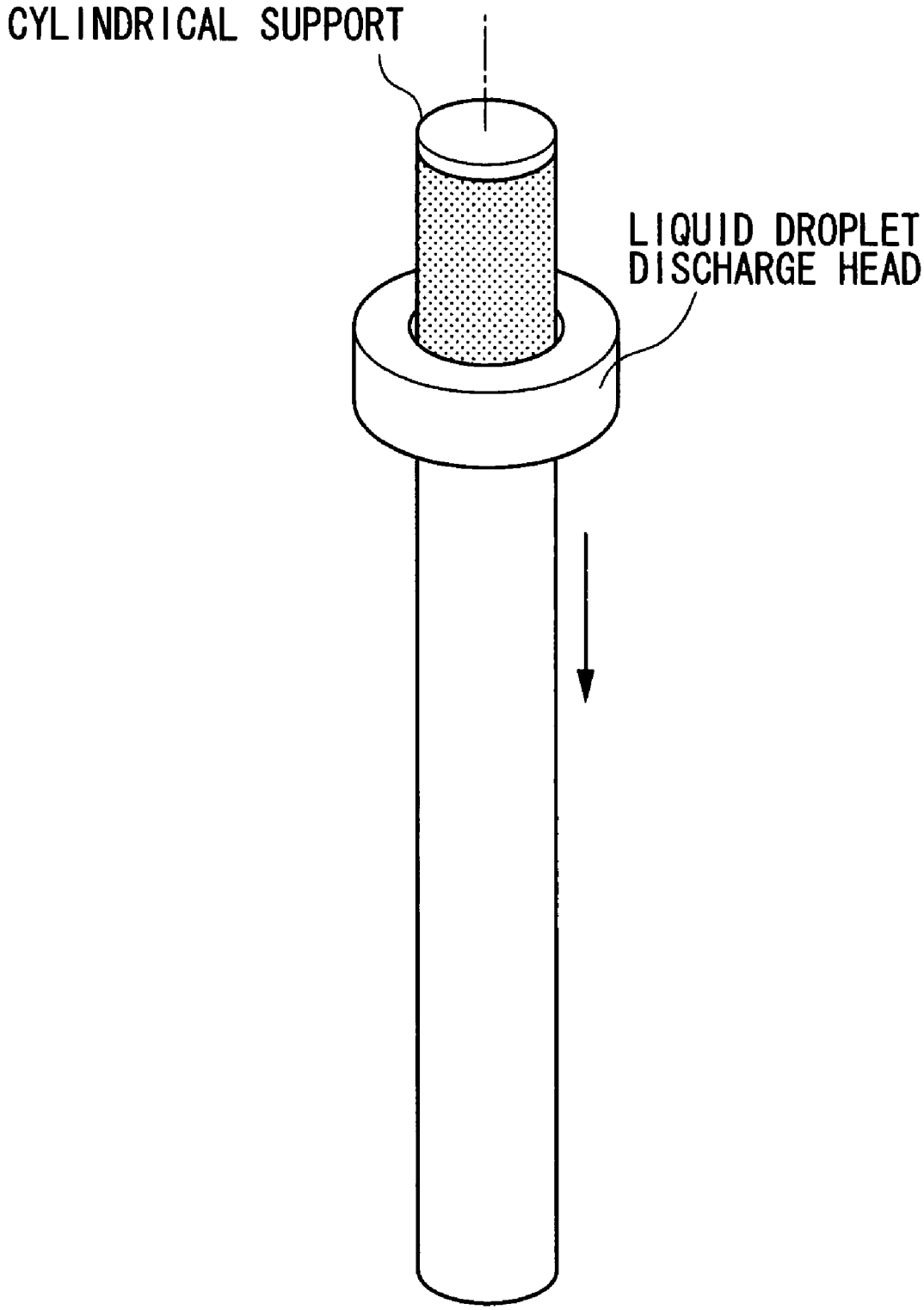
FIG. 10 is an example of an inkjet method in the case where the constitution of FIG. 9 is displaced in the vertical direction.

FIG. 10 is the configuration of FIG. 9 placed in an upright direction. Here, "upright" does not just mean at 90°, and the configuration may be at an angle to the 90°.

Figure 11:
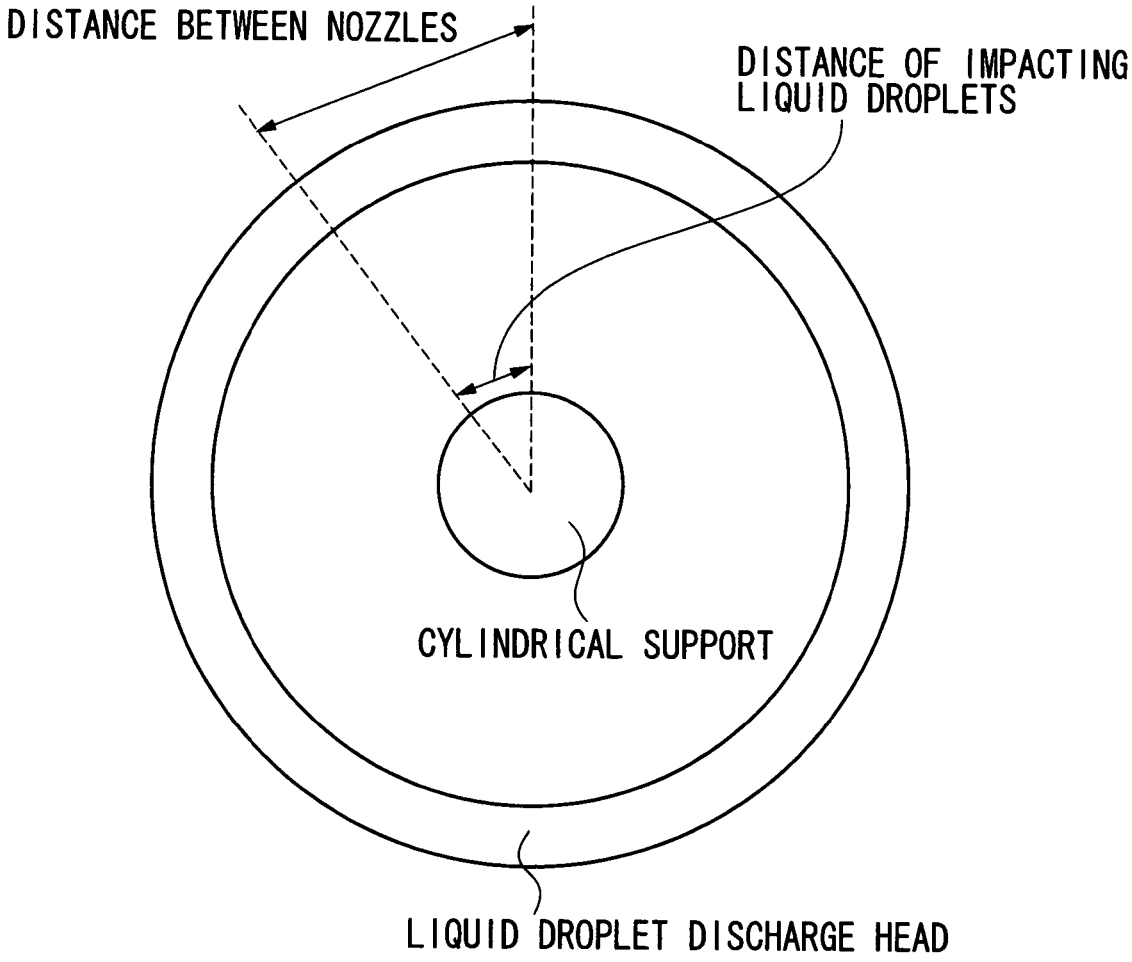
FIG. 11 is an illustration showing a method so that an apparent resolution is improved in case of a cylindrical Liquid droplet discharge head.

In FIG. 9 and FIG. 10, a layer may be formed without rotating the base material to be coated. However, it is not possible to apply this to the method shown in FIG. 5, in which the apparent resolution is raised by having the nozzle rows at an angle to the rotational axis. But, as shown in FIG. 11, in the case of a cylindrical liquid droplet discharge head, by making the diameter of the liquid droplet discharge head larger, the separation distance at liquid droplet impact is narrowed, and it is possible to increase the resolution on the base material. By doing so, a high quality layer may be formed using a cylindrical Liquid droplet discharge head.

Figure 12:
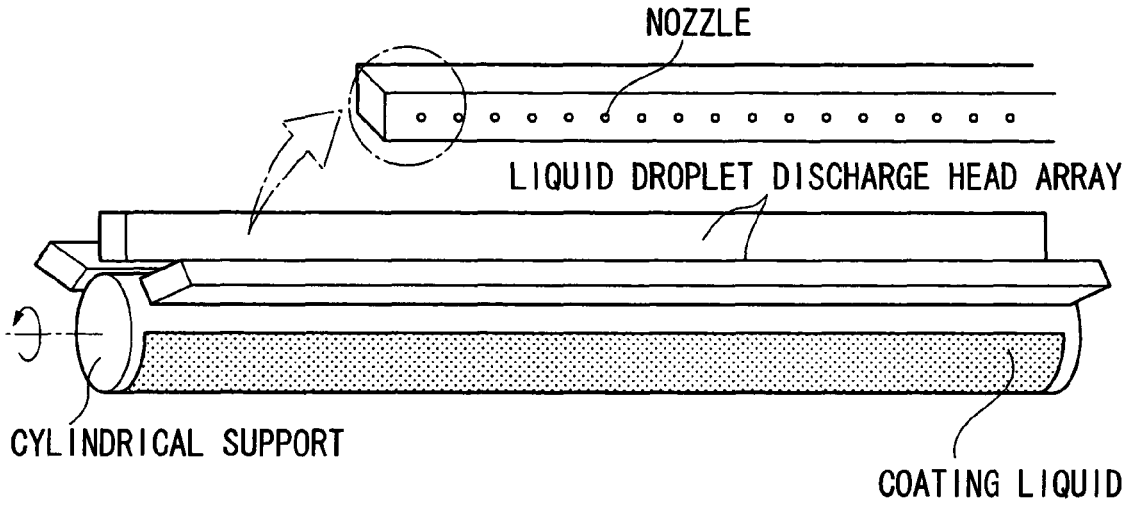
FIG. 12 is an illustration of an inkjet method in the case where a width of the droplet discharge head is equal to or longer than a length of a cylindrical support, and the droplet discharge head may coat the entire length of the cylindrical support at once.

FIG. 12 shows an example of an inkjet method in which Liquid droplet discharge heads are the same width or greater than the width of the cylindrical support, and the whole axial length of the cylindrical support is coated at once. When the axis of the cylindrical support is placed horizontally, normally coating is carried out as the cylindrical support is rotated. While it is difficult to shorten the separation distance of the nozzles of a piezo inkjet liquid droplet discharge head as above, the resolution may be increased by providing two or more liquid droplet discharge heads, as shown in FIG. 12. Furthermore, even with just a single liquid droplet discharge head, by scanning by a very small distance in the axial direction, and ejecting so that the spaces between the nozzles are filled in, continuous layer forming becomes possible.

When using a continuous type liquid droplet discharge head as the liquid droplet discharge head, control of the amount of coating liquid reaching the base material may be achieved by deflecting the direction of progression of the liquid droplets with an electric field. Liquid droplets that do not coat may be recovered through a gutter.

A continuous type inkjet liquid droplet discharge head that applies pressure to a coating liquid is suitable when using a high concentration coating liquid, that is to say a coating liquid that has a high viscosity. However, in intermittent type liquid droplet discharge heads, high viscosity materials may be used by providing a heater used in commercially available bar code printers for heating the coating liquid, and reducing the viscosity in the ejecting portion. Although a kind of coating solutions selected is limited, an electrostatic intermittent ink jet droplet discharge head may cope with a highly viscous coating solution.

4-2. Coating Liquid

The coating liquid for forming the charge-transporting layer 3 includes charge transport material, and, as resins, a thermoplastic resin and a curable resin. The charge transport material may be a combination of a curable-type charge transport material and a non-curable-type charge transport material.

In each of the coating liquids for forming the charge-transporting layer 3, the compounding ratio (ratio by weight) of the above charge transport material to the resins is preferably 10:1 to 1:5, more preferably 8:1 to 1:4, and still more preferably 6:1 to 1:2.

Preparation of the coating liquid for the charge-transporting layer 3 may be undertaken without using a solvent, or if required, an ordinary organic solvent may be used, such as, for example: methanol, ethanol, n-propanol, n-butanol, benzyl alcohol, methyl cellosolve, ethyl cellosolve, 3-hydroxy- 3-methyl-2 butanone, diacetone alcohol, γ-ketobutanol, acetol, butylcarbitol, glycerin, acetone, methyl ethyl ketone, cyclohexanone, methyl acetate, n-butyl acetate, dioxane, tetrahydrofuran, methylene chloride, chloroform, chlorobenzene, and toluene. These organic solvents may be used singly, or in combinations of two or more.

In the present exemplary embodiment, for forming a construction with an inclined concentration gradient of the curable resin in the charge-transporting layer 3, so that plural prepared coating liquids may be mixed together, it is preferable that the solvents of each of the coating liquids are either the same kind of solvent, or are closely related types of solvent.

When used in an intermittent type inkjet liquid droplet discharge head, the amount of the solvent used is from about 0.2 parts by weight to about 30 parts by weight with respect to the 100 parts by weight of resin, and is preferably from about 1 part by weight to about 20 parts by weight.

Furthermore, when reacting the above components to obtain a coating liquid, the reaction may be carried out by simple mixing or dissolving, but raising of the temperature may be carried out to about 20° C. to about 100° C., preferably about 30° C. to about 80° C., for about 10 minutes to about 100 hours, preferably about 1 hour to about 50 hours.

In the intermittent type inkjet liquid droplet discharge head it is preferable that the coating liquid has a viscosity within the range of about 0.8 mPa·s to about 20 mPa·s, and more preferably within the viscosity range of about 1 mPa·s to about 10 mPa·s.

The viscosity determined in the present exemplary embodiment is a value measured at 25° C., using an E-type viscometer (Trade Name: RE550L; manufactured by Toki Sangyo Co., Ltd., using a standard cone rotor, at a rotation speed of 60 rpm).

The surface tension of the coating liquid in the inkjet system of intermittent type is preferably from about 15 mN/m to about 75 mN/m, and more preferably from about 25 mN/m to about 65 mN/m.

The volume of the liquid droplets ejected in the intermittent type inkjet liquid droplet discharge head is preferably from about 1 pL to about 200 pL. The preferable liquid droplet volume range is from about 1 pL to about 100 pL, more preferably from about 1 pL to about 60 pL, and particularly preferably from 2 pL to 50 pL.

In the present exemplary embodiment the size of the liquid droplets is measured by off-line visual inspection evaluation. LED is illuminated towards the liquid droplets in synchrony to the ejecting timing, and observations are made of images using a CCD camera.

Explanation is given of the layer forming method by an inkjet method, with charge-transporting layer 3 as the layer being formed, but an inkjet method may also be used for forming a charge-generating layer or other layer.

The liquid droplet discharge head of the present exemplary embodiment may have a cleaning function, in preparation for when coating liquid solidifies by drying, blocking the nozzles of the inkjet liquid droplet discharge head. For example, a head cleaning function is suitable and cleaning may be suitably carried out with an organic solvent that is used in the coating liquid. Furthermore, in preparation for blockages, there may be a suctioning mechanism and a mechanism for bombarding ultrasound.

<Electrophotographic Photoreceptor>

Next, each of the layers configuring an electrophotographic photoreceptor of the present exemplary embodiment will be explained.

(Cylindrical Support 4)

In this exemplary embodiment, a cylindrical support 4 is used as base material.

The cylindrical support 4 may be, for example, a metal plate, a metal drum or a metal belt formed of a metal such as aluminum, copper, zinc, stainless steel, chromium, nickel, molybdenum, vanadium, indium, gold or platinum, or their alloy, as well as paper, plastic films or belts coated, deposited or laminated with a polymer with a volume resistivity of $10^{-5}$ Ω·cm or less or indium oxide or with a metal such as aluminum, palladium or gold or their alloy.

The volume resistivity of the cylindrical support is preferably about $10^{-5}$ Ω·cm or less.

The surface of the cylindrical support 4 may be roughened so that the central line average surface roughness Ra of the support is preferably from about 0.04 μm to about 0.5 μm in order to prevent interference fringes generated upon irradiation with a laser light.

For roughening the surface of the support, for example, employable is a wet-honing method of ejecting an abrasive suspension in water to a support; a centerless grinding method of pressing a support against a rotating grindstone for continuously grinding it; or a method of anodic oxidation, and it is also preferable to use a method wherein a layer, in which a powder having a volume resistivity of $10^{-5}$ Ω·cm or less is dispersed in a resin layer, is formed on the surface of the support without roughened, and the surface is roughed by the particles dispersed in the layer.

When non-interference light is used as a light source, roughening for prevention of interference pattern may be not particularly necessary.

As one method of roughening the surface of the support, the anodic oxidation includes processing the aluminum surface of a support in an electrolytic solution in which the aluminum acts as an anode for anodic oxidation to form an oxide film on the aluminum surface. The electrolytic solution includes sulfuric acid solution, oxalic acid solution or the like. More preferably, the pores of the anodic oxidation film is sealed.

Preferably, the thickness of the oxide film by anodic oxidation is preferably from about 0.3 μm to about 15 μm for sealing the fine pores thereof.

The treatment with an acid solution, such as phosphoric acid, chromic acid and hydrofluoric acid, may be effected as follows. The ratio of phosphoric acid, chromic acid and hydrofluoric acid to form an acid solution is preferably as follows: Phosphoric acid is from about 10 wt % to about 11 wt %, chromic acid is from about 3 wt % to about 5 wt %, and hydrofluoric acid is from about 0.5 wt % to about 2 wt %. The total acid concentration of these is preferably from about 13.5 wt % to about 18 wt %. The processing temperature is preferably from about 42° C. to about 48° C.

Preferably, the thickness of the film is from about 0.3 μm to about 15 μm.

The boehmite treatment may be attained by dipping the support in pure water at about 90° C. to about 100° C. for about 5 to about 60 minutes, or by contacting the support with heated steam at about 90° C. to about 120° C. for about 5 to about 60 minutes. Preferably, the thickness of the film is from about 0.1 μm to about 5 μm. This may be further processed for anodic oxidation with an electrolytic solution having low film dissolution ability, such as a solution of adipic acid, boric acid, borate, phosphate, phthalate, maleate, benzoate, tartrate or citrate.

(Undercoat Layer 1)

An undercoat layer 1 may also be formed on the cylindrical support, or between a layer formed on the cylindrical support and the photosensitive layer. In particularly, the undercoat layer 1 that is an intermediate layer is preferably formed.

The material used in forming the undercoat layer 1 includes organozirconium compounds such as zirconium chelate compound, zirconium alkoxide compound and zirconium coupling agent; organotitanium compounds such as titanium chelate compound, titanium alkoxide compound and titanate coupling agent; organoaluminum compounds such as aluminum chelate compound and aluminum coupling agent; or organometallic compounds such as antimony alkoxide compound, germanium alkoxide compound, indium alkoxide compound, indium chelate compound, manganese alkoxide compound, manganese chelate compound, tin alkoxide compound, tin chelate compound, aluminum silicon alkoxide compound, aluminum titanium alkoxide compound and aluminum zirconium alkoxide compound. Among which the organozirconium compounds, organotitanium compounds or organoaluminum compounds are particularly preferably used.

Further, silane coupling agents such vinyl trichlorosilane, vinyl trimethoxy silane, vinyl triethoxy silane, vinyl tris-2-methoxy ethoxy silane, vinyl triacetoxy silane, γ-glycidoxy propyl trimethoxy silane, γ-methacryloxy propyl trimethoxy silane, γ-aminopropyl triethoxy silane, γ-chloropropyl trimethoxy silane, γ-2-aminoethyl aminopropyl trimethoxy silane, γ-mercaptopropyl trimethoxy silane, γ-ureidopropyl triethoxy silane and β-3,4-epoxy cyclohexyl trimethoxy silane may be used in the undercoat layer.

As another constituent component generally used in the undercoat layer 1, it is also possible to use known binder resins, for example polyvinyl alcohol, polyvinyl methyl ether, poly-N-vinylimidazole, polyethylene oxide, ethyl cellulose, methyl cellulose, ethylene-acrylic acid copolymer, polyamide, polyimide, casein, gelatin, polyethylene, polyester, phenol resin, vinyl chloride-vinyl acetate copolymer, epoxy resin, polyvinyl pyrrolidone, polyvinyl pyridine, polyurethane, polyglutamic acid and polyacrylic acid.

The resin may be used alone or in combination of two or more thereof, and the mixing ratio of these materials may be suitably established depending on necessity.

An electron transportable pigment may be mixed or dispersed in the undercoat layer 1. The electron transportable pigment include organic pigments such as perylene pigment described in JP-A No. 47-30330, bisbenzimidazole perylene pigment, polycyclic quinone pigment, indigo pigment and quinacridone pigment; organic pigments such as bisazo pigment and phthalocyanine pigment having an electron attractive substituent group such as a cyano group, a nitro group, a nitroso group and a halogen atom; and inorganic pigments such as zinc oxide and titanium oxide.

Among these pigments, perylene pigment, bisbenzimidazole perylene pigment, polycyclic quinone pigment, zinc oxide and titanium oxide are preferably used.

The surfaces of these pigments may be treated with the above-mentioned coupling agent, binder or the like. The electron transportable pigment is used in an amount of 95 wt % or less, and preferably 90 wt % or less.

As the method of mixing/dispersing the constituent component of the undercoat layer 1, a usual method of using a ball mill, a roll mill, a sand mill, an attritor or supersonic waves is used. Mixing/dispersion is carried out in an organic solvent. The organic solvent may be any organic solvent, as long as the organic solvent dissolves an organic metallic compound and resin and don't cause gelation or aggregation upon mixing/dispersion of the electron transportable pigment.

For example, the organic solvent includes an usual organic solvent such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene or toluene. The organic solvent may be used alone or in combination of two or more thereof.

Various organic compound powder or inorganic compound powder may be added to the undercoat layer 1. In particular, white pigments such as titanium oxide, zinc oxide, zinc white, zinc sulfide, lead white or lithopone; inorganic pigments as body pigments such as alumina, calcium carbonate or barium sulfate; Teflon (trade name) resin particles, benzoguanamine resin particles or styrene particles are effective.

Preferably, the particle size of the additive powder is preferably from about 0.01 μm to about 2 μm in terms of volume-average particle diameter. The additive powder is optionally added to the layer. When the additive powder is added, its amount is preferably from about 10 wt % to about 90 wt %, and more preferably from about 30 wt % to about 80 wt %, with regard to the total solid content of the undercoat layer 1.

An electron-transporting substance, an electron-transporting pigment or the like may include in the undercoat layer 1.

The thickness of the undercoat layer 1 is preferably from about 0.01 μm to about 30 μm, and more preferably from about 0.05 μm to about 25 μm. A powdery substance, when added in preparing a coating solution for forming the undercoat layer 1, is added to and dispersed in a solution of the resin component.

As a dispersing method, any ordinary method may be employed by using, for example, a roll mill, a ball mill, a vibrating ball mill, an attritor, a sand mill, a colloid mill, a paint shaker or the like. The undercoat layer 1 may be formed by applying a coating solution for forming the undercoat layer 1 on or above the cylindrical support 4 and drying it.

The coating method may be any ordinary one, including, for example, a blade coating method, a wire bar coating method, a spray coating method, a dip coating method, a bead coating method, an air knife coating method and a curtain coating method.

<Charge-Generating Layer 2>

The charge-generating layer 2 will be explained.

The charge-generating layer contains at least a charge-generating material and a resin.

The charge-generating materials used include those known in the art, for example azo pigments such as bisazo and trisazo; condensed ring aromatic pigments such as dibromoanthanthrone; organic pigments such as perylene pigment, pyrroropyrrole pigment and phthalocyanine pigment; and inorganic pigments such as triclinic selenium and zinc oxide. In particularly, metal or nonmetal phthalocyanine pigments, triclinic selenium, and dibromoanthanthrone are preferable when using an exposure wavelength of about 380 nm to about 500 nm.

Particularly preferable among these are hydroxy gallium phthalocyanine disclosed in JP-A Nos. 5-263007 and 5-279591, chlorogallium phthalocyanine in JP-A No. 5-98181, dichlorotin phthalocyanine in JP-A Nos. 5-140472 and 5-140473, and titanyl phthalocyanine in JP-A Nos. 4-189873 and 5-43813.

The resin may be selected from a wide variety of resins, and preferable resins include, but are not limited to, polyvinyl butyral resins, polyarylate resins (polycondensate product of bisphenol A and phthalic acid, etc.), polycarbonate resins, polyester resins, phenoxy resin, vinyl chloride-vinyl acetate copolymers, polyamide resins, acryl resins, polyacrylamide resins, polyvinyl pyridine resins, cellulose resins, urethane resins, epoxy resins, caseins, polyvinyl alcohol resins and polyvinyl pyrrolidone resins.

These resins may be used alone or in combination of two or more thereof.

A material having both the function of the resin and the function of the charge-generating material, such as a poly-N-vinyl carbazole, a polyvinyl anthracene, a polyvinyl pyrene or a polysilane may also be used.

The compounding ratio (weight ratio) of the charge-generating material to the resin is preferably in a range of 10:1 to 1:10 (=charge-generating material:resin). As the method of dispersing them, usual methods such as a ball mill dispersion method, an attritor dispersion method or a sand mill dispersion method may be used.

In dispersion, it is effective for the size of the particle to be reduced to a size of 0.5 μm or less, preferably about 0.3 μm or less, and more preferably about 0.15 μm or less. As the solvent used in dispersion, an usual organic solvent such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene may be used. These solvents may be used alone or in combination of two or more thereof.

The thickness of the charge-generating layer 2 is generally preferably from about 0.1 μm to about 5 μm, and more preferably from about 0.2 μm to about 2.0 μm.

The coating method of the charge-generating layer 2 may be any ordinary one, including, for example, a blade coating method, a wire bar coating method, a spray coating method, a dip coating method, a bead coating method, an air knife coating method and a curtain coating method.

<Image-Forming Apparatus>

Figure 13:
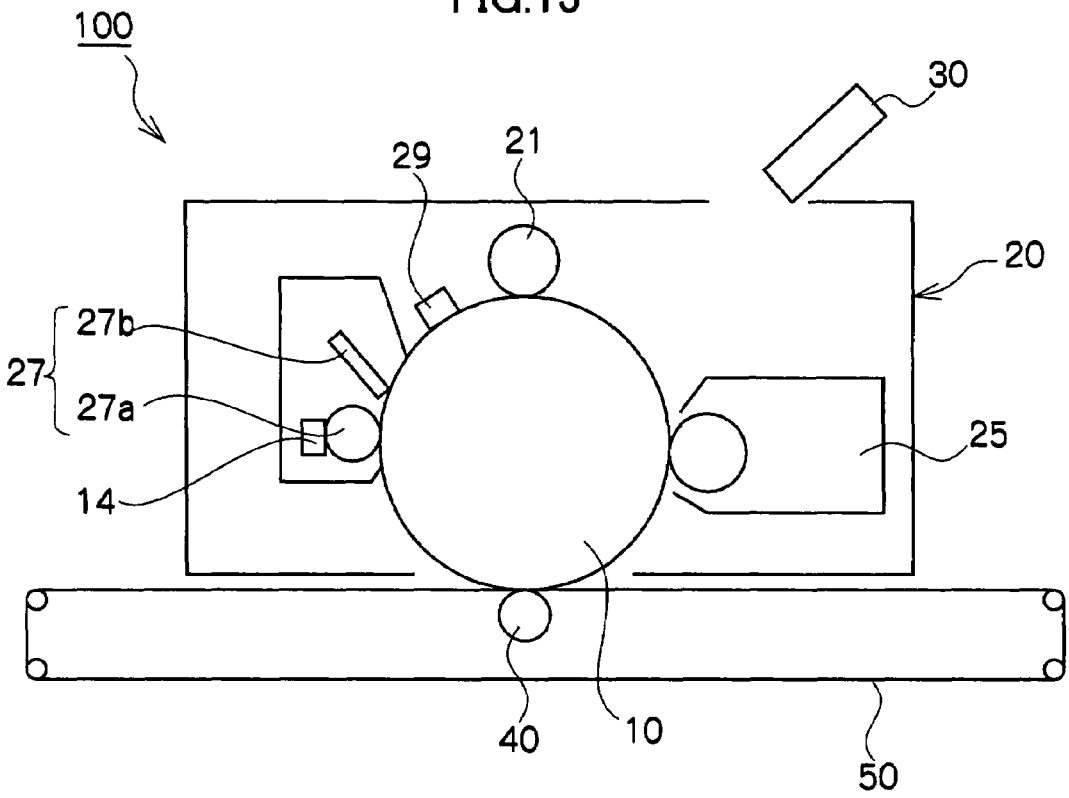
FIG. 13 is an illustration showing a preferred exemplary embodiment of an image-forming apparatus according to the present invention.

FIG. 13 is an illustration showing a preferable exemplary embodiment of the image-forming apparatus. The image-forming apparatus shown in FIG. 13 comprises, in the main body of an image-forming apparatus (not shown), a process cartridge 20 provided with the electrophotographic photoreceptor 10 described above, an exposure unit (latent image-forming unit) 30, a transfer unit 40, and an intermediate transfer medium 50. In the image-forming apparatus 100, the irradiating device 30 is arranged in such a position that the electrophotographic photoreceptor 10 can be irradiated with light through an opening of the process cartridge 20, and the transfer device 40 is arranged in a position opposed, via the intermediate transfer medium 50, to the electrophotographic photoreceptor 10, and the intermediate transfer medium 50 is arranged to be contacted with the electrophotographic photoreceptor 10.

The process cartridge 20 comprises, in a casing, the electrophotographic photoreceptor 10 integrated with a charger 21, a developer 25, a cleaner 27 and a fibrous member (flat brush) 29 and fitted via a fitting rail to the main body of the image-forming apparatus. The casing is provided with an opening for light exposure.

The charger 21 is to charge the electrophotographic photoreceptor 10 by a contact system, however, the charger 21 may be one of non-contact system. The developer 25 is to form a toner image by developing an electrostatic latent image on the photographic photoreceptor 10.

The cleaner 27 have a fibrous member (roll shape) 27*a* and a cleaning blade (blade member) 27*b*. In the cleaner 27 shown in FIG. 13, there are both a fibrous member 27*a* and a cleaning blade 27*b*. However, the cleaner may have any one of these. The fibrous member 27*a* may be a roll, a tooth brush-like member or the like. The fibrous member 27*a* may be fixed to the body of the cleaner, or may be rotatably supported by the body, or may be supported by it in such a manner that it may oscillate in the axial direction of the photoreceptor.

The cleaning blade and the cleaning brush of the cleaner 27 remove the adhered substances (e.g., discharged substances) from the surface of the photoreceptor, and it is desirable that a lubricant substance (lubricant component) 14 such as metal soap, higher alcohol, wax or silicone oil is contacted with the fibrous member 27*a*, to supply the lubricant component to the surface of the electrophotographic photoreceptor.

The cleaning blade 27*b* may be an ordinary rubber blade.

The process cartridge 20 described above is detachably fitted to the main body of the image-forming apparatus, and constitutes the image-forming apparatus, together with the main body of the image-forming apparatus.

The exposure unit 30 may be any one capable of exposing the charged electrophotographic photoreceptor 10 so as to form an electrostatic latent image thereon. The light source of the exposure unit 30 is preferably a multi-beam surface-emitting laser.

The transfer unit 40 is not limited insofar as it may transfer a toner image on the electrophotographic photoreceptor 10 onto a transfer medium (which may be a paper retained on a paper delivery belt (not shown) used in place of the intermediate transfer medium 50 as transfer medium shown in FIG. 13, or a paper for directly transferring an image thereon without using the intermediate transfer medium 50), and for example, a usual roll-shaped transfer material is used.

The intermediate transfer medium 50 has a volume resistivity of $10^2$ Ω·cm to $10^{11}$ Ω·cm, and is a belt-shaped medium (intermediate transfer belt) containing polyimide, polyamidimide, polycarbonate, polyarylate, polyester, rubber or the like as the constituent component. The intermediate transfer medium 50 may be in the form of a drum in addition to the form of a belt.

The transfer medium is not particularly limited insofar as it is a medium capable of transferring a toner image formed on the electrophotographic photoreceptor 10. For example, in the case where the electrophotographic photoreceptor 10 is transferred directly onto a paper, the paper is a transfer medium, and when the intermediate transfer medium 50 is used, the intermediate transfer medium is a transfer medium.

Figure 14:
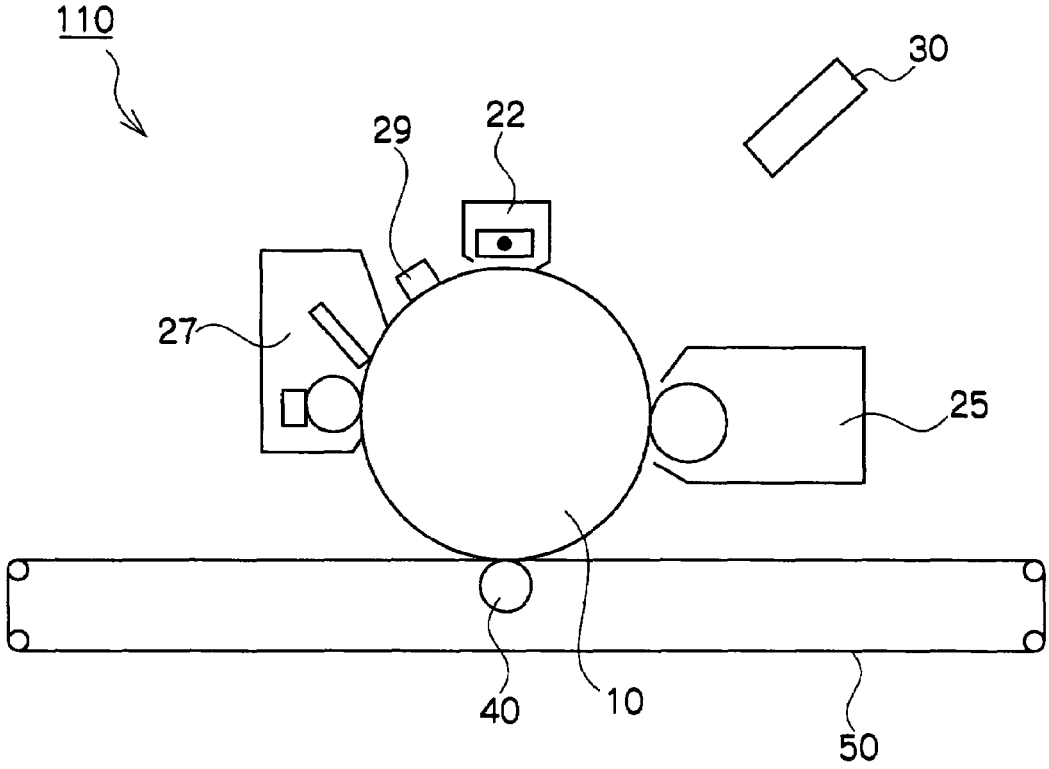
FIG. 14 is an illustration showing another preferred exemplary embodiment of an image-forming apparatus according to the present invention.

FIG. 14 is a schematic view showing another exemplary embodiment of the image-forming apparatus. In the image-forming apparatus 110 of FIG. 14, the electrophotographic photoreceptor 10 is fixed to the body of the image-forming apparatus, and a charger 22, a developer 25 and a cleaner 27 are fitted thereto independently of each other, to constitute a charging cartridge, a developing cartridge and a cleaning cartridge respectively. The charger 22 is a corona discharging charger in the exemplary embodiment, however, the charger 22 may be one of contact system.

In the image-forming apparatus 110, the electrophotographic photoreceptor 10 and the other units are separated from one another, and the charger 22, the developer 25 and the cleaner 27 may be detachably fitted to the body of the image-forming apparatus by leading or extrusion.

In the electrophotographic photoreceptor of this exemplary embodiment, formation of the cartridge is not necessary in some cases. Accordingly, the charger 22, the developer 25 and the cleaner 27 may be detachably fitted to the body of the image-forming apparatus by leading or extrusion, whereby the apparatus cost per one print with it may be reduced. Two or more of these units may be manufactured as one integrated cartridge to detachably fix to the body.

The image-forming apparatus 110 has the same structure as the image-forming apparatus 100 except that the charger 22, the developer 25 and the cleaner 27 are formed as cartridges respectively.

Figure 15:
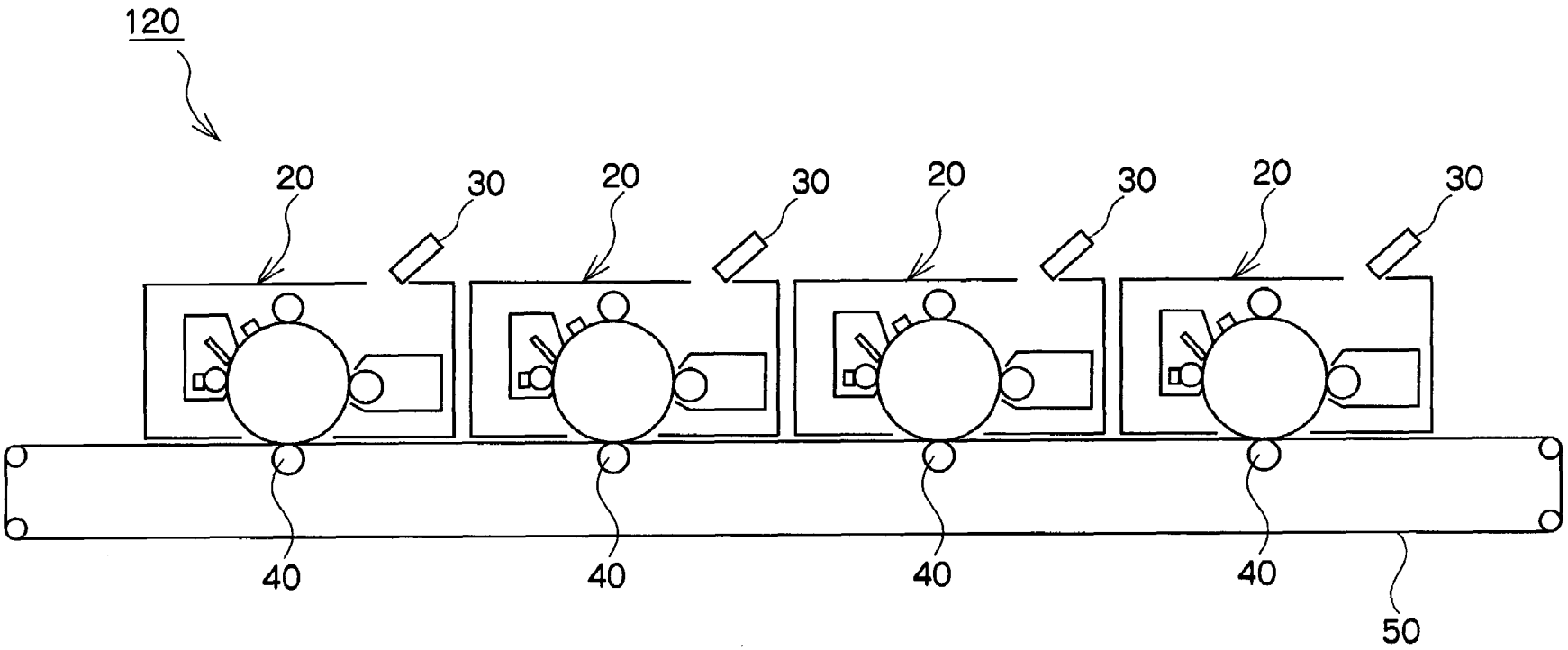
FIG. 15 is an illustration showing still another preferred exemplary embodiment of an image-forming apparatus according to the present invention.

FIG. 15 is a schematic view showing still another exemplary embodiment of the image-forming apparatus. The image-forming apparatus 120 is a tandem-type full-color image-forming apparatus equipped with four process cartridges 20. The image-forming apparatus 120 is so designed that four process cartridges 20 are disposed in parallel to each other on an intermediate transfer medium 50 and one electrophotographic photoreceptor is used for one color. Except that it is a tandem-system apparatus, the image-forming apparatus 120 has the same constitution as that of the image-forming apparatus 100.

EXAMPLES

Hereinafter, the exemplary embodiment of the present invention is described in more detail with reference to the Examples, to which, however, the present invention is not limited.

Example 1

Production of Photoreceptor 1

(Preparation of Photoreceptor A)

A 0.1 μm thick undercoat layer is formed on a cylindrical Al substrate of 30 mm ϕ, which has had a honing process carried out thereon, by: dip coating in a solution containing 100 parts by weight of a zirconium compound (trade name: ORGATICS ZC540; manufactured by: Matsumoto Chemical Industry Co., Ltd.), 10 parts by weight of a silane compound (trade name: A1100; manufactured by: Nippon Unicar Co., Ltd.), 400 parts by weight of isopropanol, and 200 parts by weight of butanol; and heat drying at 150° C. for 10 minutes.

The charge-generating layer of 0.15 μm thickness is then formed on this aluminum base material by: mixing 10 parts by weight of hydroxygallium phthalocyanine, having strong diffraction peaks of Bragg angles (2 θ±0.2°) in an X-ray diffraction spectrum at 7.5°, 9.9°, 12.5°, 16.3°, 18.6°, 25.1°, and 28.3°, into 10 parts by weight of polyvinyl butyral (Trade Name: S-LEC BM-S; manufactured by Sekisui Chemical Co., Ltd.) and 1000 parts by weight of n-butyl acetate; and, after dispersing by processing for 1 hour in a paint shaker with the glass beads, dip coating is carried out onto the above undercoat with the obtained coating liquid; and heat drying for 10 minutes at 100° C. This is photo conductor A.

(Production of Photoreceptor 1)

A charge-transporting layer coating liquid (1) is prepared by dissolving 500 parts by weight of a benzidine compound (non-curable charge transport material) of Compound 1 below, 500 parts by weight of a polymer compound of Compound 2 below (viscosity average molecular weight: 39,000; thermoplastic resin) in 4000 parts by weight of tetrahydrofuran (THF).

An 18 μm portion of the charge-transporting layer is formed by dip coating the photoreceptor A in the coating liquid (1), and heat drying for 40 minutes at 130° C.

Compound 1

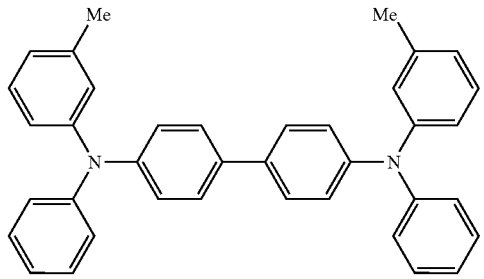

Compound 2

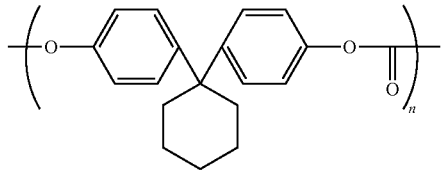

100 parts by weight of phenol, 175 parts by weight of formalin, and 2 parts by weight of $Ba(OH)_2.8H_2O$ are placed in a side-arm flask, and heating and stirring is carried out for 100° C. for 3 hours under nitrogen atmosphere. The solvent is removed at reduced pressure. Phenol resin (1) is thus obtained.

Next, a charge-transport layer coating liquid (2) is prepared by dissolving 50 parts by weight of compound III-3, as a curable charge-transporting material, 50 parts by weight of the phenol resin (1), as a thermosetting resin, and 0.1 parts by weight of a catalyst NACURE 2500 (Trade Name, from Kusumoto Chemicals, Ltd.), in 39.9 parts by weight of tetrahydrofuran.

Then the charge-transporting layer coating liquids (A) to (D) are prepared by mixed together the coating liquids (1) and (2) in the proportions shown in Table 1. The concentrations (wt %) of the components in the prepared charge-transporting layer coating liquids (A) to (D) are shown in Table 2.

TABLE 1

| | Mixing proportion of coating liquid (1) (parts by weight) | Mixing proportion of coating liquid (2) (parts by weight) | *THF (parts by weight) | Total (parts by weight) |
|---|---|---|---|---|
| Charge-transporting layer coating liquid (A) | 50 | 0 | 50 | 100 |
| Charge-transporting layer coating liquid (B) | 40 | 2.8 | 57.2 | 100 |
| Charge-transporting layer coating liquid (C) | 25 | 28 | 47 | 100 |
| Charge-transporting layer coating liquid (D) | 0 | 35 | 65 | 100 |

*THF: tetrahydrofuran

TABLE 2

| | Charge transport material | | Resin | | | | |
|---|---|---|---|---|---|---|---|
| | Non-curable (wt %) | Curable (wt %) | Thermo-plastic (wt %) | Curable (wt %) | *Catalyst (wt %) | **THF (wt %) | Total (wt %) |
| Charge-transporting layer coating liquid A | 5.00 | 0.00 | 5.00 | 0.00 | 0.00 | 90.00 | 100.00 |
| Charge-transporting layer coating liquid B | 4.00 | 1.00 | 4.00 | 1.00 | 0.00 | 90.00 | 100.00 |
| Charge-transporting layer coating liquid C | 2.50 | 10.00 | 2.50 | 10.00 | 0.02 | 74.98 | 100.00 |
| Charge-transporting layer coating liquid D | 0.00 | 12.50 | 0.00 | 12.50 | 0.03 | 74.97 | 100.00 |

*Catalyst: Nacure 2500 (from Kusumoto Chemicals, Ltd.)
**THF: tetrahydrofuran

Four inkjet heads (Trade Name: PIXELJET 64; manufactured by TRIDENT Co., Ltd.) are readied, corresponding to the types of prepared charge-transporting layer coating liquids, and the charge-transporting layer coating liquids (A) to (D) are filled therein. The photoreceptor A is mounted in an apparatus that is able to rotate the photoreceptor A horizontally, and the heads respectively filled with the charge-transporting layer coating liquids (A) to (D) are lined up so that they ejected directly downward, from directly above the photoreceptor A onto the base material.

The arrangement is made with each of the heads inclined at an angle to the axial direction of the photoreceptor as shown in FIG. 5, such that coating liquid is ejected from 10 nozzles of one row from the 64 nozzles in the head, and the droplets, after being ejected from the nozzles and impacting, touch together with the adjacent droplets as shown in FIG. 4. The diameters of the droplets on just ejecting, shown by dotted lines, are of the same order as the diameter of the nozzles, but after impacting on the surface of the photoreceptor A the droplets spread out to touch neighboring droplets, as shown by the solid lines, and form a layer. Furthermore, each of the heads is set such that the separation distance from each of the heads to the surface of the photoreceptor A is 10 mm.

The photoreceptor A is rotated at 115 rpm, coating liquid is ejected from the nozzles at 2000 Hz, and the heads are horizontally moved from one end portion of the photoreceptor A to the other end portion at a linear velocity of 80 mm/min.

The coating layer of the charge-transporting layer is formed by ejecting the charge-transporting layer coating liquids (A), (B), (C) and (D), in this sequence from the charge-generating layer, as shown in FIG. 6. It is to be noted that while FIG. 6 shows 3 inkjet heads, in this Example there are 4 types of coating liquid used and so there are 4 inkjet heads, as stated above.

Then the 5 μm charge-transporting layer is formed by carrying out drying at 160° C. for 40 minutes, and the photoreceptor-1 is obtained.

<Measurement of the Proportions Contained of the Curable Resin in the Charge-Transporting Layer>

Layers are prepared, in advance, using the coating liquids of each of the charge-transporting layer coating liquids (A) to (D) having known proportions of the curable resin contained therein. The presence of Ba atoms in the outermost surface layer of these layers is detected using a Secondary Ion Mass Spectrometer (SIMS), and based on these detection results a calibration curve is produced showing the relationship between the proportion of the content of curable resin and the detected results of Ba (barium) atoms.

Next, the outermost surface layer of the photoreceptor of Example 1 is peeled off, and Ba atoms in the outermost surface layer of this outermost surface layer are detected using a Secondary Ion Mass Spectrometer (SIMS), and the proportion of the content of the curable resin in the charge-transporting layer of the photoreceptor-1 is determined by converting the detection result into the proportion of the content of curable resin by comparing the result to the calibration curve produced in advance.

As a result it is possible to confirm that the charge-transporting layer of the photoreceptor-1 is formed as a layer with a concentration gradient of the curable resin in the layer thickness direction from the proportion of the content of curable resin in the charge-transporting layer coating liquid (A) up to the proportion of the content of curable resin in the charge-transporting layer coating liquid (D), and furthermore, that the charge-transporting layer of the photoreceptor-1 is formed as a layer with a concentration gradient of the curable charge transport material in the layer thickness direction from the proportion of the content of curable resin in the charge-transporting layer coating liquid (A) up to the proportion of the content of curable resin in the charge-transporting layer coating liquid (D).

<Evaluation of Image Degradation>

The photoreceptor-1 is installed in a printer (Trade Name: DOCUCENTRE COLOR F450; manufactured by Fuji Xerox). Evaluation is by visual inspection carried out of the image quality of the first sheet, the 10,000$^{th}$ sheet, and after leaving in the printer for one day (24 hours), for 3-point and 6-point character (letter) images that are output under conditions of high temperature and humidity (30° C., 80% RH) and low temperature and humidity (10° C., 20% RH) respectively. The results are shown in Table 6.

(Evaluation Criteria)

A: Characters are easily able to be recognized, with no bleeding

B: Characters are able to be recognized, but there is some bleeding

C: Characters are unrecognizable

<Evaluation of Ghosting>

The photoreceptor in a DOCUPRINT C1616 (Trade name, manufactured by Fuji Xerox) is replace with the photoreceptor-1, and test images are formed on 100 sheets in conditions of high temperature and humidity (20° C., 50% RH), and ghosting is evaluated.

Figure 16A:
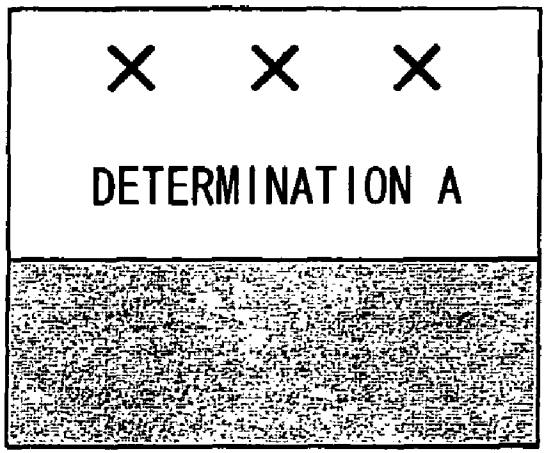
FIGS. 16A to 16C are charts used for evaluating ghosting in the Examples.
Figure 16B:
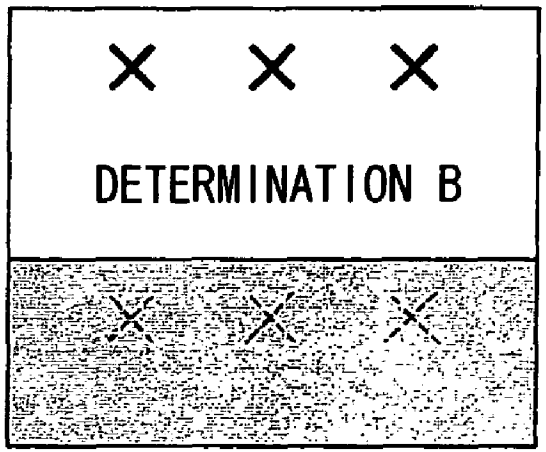
Figure 16C:
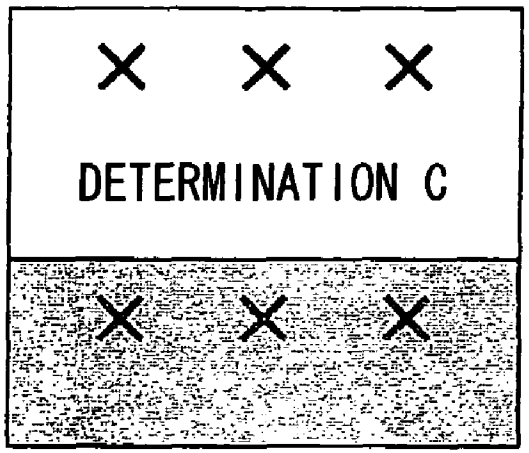

Ghosting is evaluated as shown below by printing charts of a 100% image output pattern and "X" characters, and, as shown in FIGS. 16A to 16C, by looking at the condition of the appearance of the character "X" in the 100% image output pattern. The results are shown in Table 6.

(Evaluation Criteria)

A: Good

B: Slightly visible

C: Clearly recognizable

<Evaluation of Graininess>

The image used in the above ghosting evaluation is evaluated when it is output as a 20% half-tone image.

(Evaluation Criteria)

A: No recognizable unevenness in density, uniform

B: Unevenness of density with graininess of 0.3 mm but less than 1.0 mm

C: Unevenness of density with graininess of 1.0 mm or above.

The results are shown in Table 6.

<Evaluation of Abrasion Rate>

After using for 100,000 revolutions in conditions of low temperature and low humidity (10° C., 20% RH) the layer thickness of the charge-transporting layer is measured, and the abrasion rate per 1000 revolutions is determined. The results are shown in Table 6.

Example 2

A photoreceptor-2 is obtained by the same method as that for obtaining the photoreceptor-1, except that, in the method of producing photoreceptor-1 of Example 1: the compound III-3 that is used as the curable charge transport material is replaced by compound III-11; and resol-type phenol resin (Trade name: PL-2211; manufactured by Gunei Chemical Industries Co., Ltd) is used as the curable resin instead of.

The same evaluations are carried out on the photoreceptor-2 as are carried out in Example 1. The results are shown in Table 6.

Example 3

A photoreceptor-3 is produced by the same method as that for producing photoreceptor-1, except that, charge-transporting layer coating liquids (E) to (N), as shown in Table 3 and Table 4 below, are used in place of the charge-transporting layer coating liquids (A) to (D) used in the method of producing photoreceptor-1 of Example 1.

The same evaluations are carried out on the photoreceptor-3 as are carried out in Example 1. The results are shown in Table 6.

TABLE 3

| | Coating liquid (1) [parts by weight] | Coating liquid (2) [parts by weight] | *THF [parts by weight] | Total [parts by weight] |
|---|---|---|---|---|
| Charge-transporting layer coating liquid E | 50.0 | 0.0 | 50.0 | 100 |
| Charge-transporting layer coating liquid F | 45.0 | 1.4 | 53.6 | 100 |
| Charge-transporting layer coating liquid G | 44.0 | 3.1 | 52.9 | 100 |
| Charge-transporting layer coating liquid H | 42.0 | 5.0 | 53.0 | 100 |
| Charge-transporting layer coating liquid I | 39.0 | 7.3 | 53.7 | 100 |
| Charge-transporting layer coating liquid J | 36.0 | 15.1 | 48.9 | 100 |
| Charge-transporting layer coating liquid K | 33.0 | 21.6 | 45.4 | 100 |
| Charge-transporting layer coating liquid L | 24.0 | 26.9 | 49.1 | 100 |
| Charge-transporting layer coating liquid M | 12.5 | 31.5 | 56.0 | 100 |
| Charge-transporting layer coating liquid N | 0.0 | 35.0 | 65.0 | 100 |

*THF: tetrahydrofuran

TABLE 4

| | Charge transport material | | Resin | | | | |
|---|---|---|---|---|---|---|---|
| | Non-curable (wt %) | Curable (wt %) | Thermo-plastic (wt %) | Curable (wt %) | *Catalyst (wt %) | **THF (wt %) | Total (wt %) |
| Charge-transporting layer coating liquid E | 5.00 | 0.00 | 5.00 | 0.00 | 0.00 | 90.00 | 100.00 |
| Charge-transporting layer coating liquid F | 4.50 | 0.50 | 4.50 | 0.50 | 0.00 | 90.00 | 100.00 |
| Charge-transporting layer coating liquid G | 4.40 | 1.11 | 4.40 | 1.11 | 0.00 | 88.98 | 100.00 |
| Charge-transporting layer coating liquid H | 4.20 | 1.79 | 4.20 | 1.79 | 0.00 | 88.02 | 100.00 |
| Charge-transporting layer coating liquid I | 3.90 | 2.61 | 3.90 | 2.61 | 0.01 | 86.97 | 100.00 |
| Charge-transporting layer coating liquid J | 3.60 | 5.39 | 3.60 | 5.39 | 0.01 | 82.01 | 100.00 |
| Charge-transporting layer coating liquid K | 3.30 | 7.71 | 3.30 | 7.71 | 0.02 | 77.96 | 100.00 |
| Charge-transporting layer coating liquid L | 2.40 | 9.61 | 2.40 | 9.61 | 0.02 | 75.96 | 100.00 |
| Charge-transporting layer coating liquid M | 1.25 | 11.25 | 1.25 | 11.25 | 0.02 | 74.98 | 100.00 |
| Charge-transporting layer coating liquid N | 0.00 | 12.50 | 0.00 | 12.50 | 0.03 | 74.97 | 100.00 |

*Catalyst: Nacure 2500 (from Kusumoto Chemicals, Ltd.)

**THF: tetrahydrofuran

Example 4

A photoreceptor A is prepared by the same method as Example 1. Furthermore, the charge-transporting layer coating liquids (A) and (D) prepared in Example 1 are readied and an 18 μm portion of the charge-transporting layer is formed by coating the coating liquid (A) on the photoreceptor A using a dip coating method, at 130° C. for 40 minutes.

Two inkjet heads (Trade Name: PIXELJET 64; manufactured by TRIDENT ITW) are readied, and the charge-transporting layer coating liquids (A) and (D) are filled respectively therein. The photoreceptor A is mounted in an apparatus that could rotate the photoreceptor A horizontally, and the heads filled with the charge-transporting layer coating liquids (A) and (D) are lined up so that they ejected directly downward, from directly above the base material toward the base material, with the distance between each of the heads and the surface of the photoreceptor A being set at 10 mm.

The arrangement is made such that coating liquid is ejected from 10 nozzles of the 64 nozzles of each of the heads, and the proportions ejected of the charge-transporting layer coating liquid (A) to the charge-transporting layer coating liquid (D) are varied for each layer as follows: 0:5, 1:4, 4.5:0.5, 5:0.

The photoreceptor A is rotated at 115 rpm and coating liquid is ejected from the nozzles with the frequencies shown in Table 5, while horizontally moving the heads from one end portion of the photoreceptor A to the end portion at the other side at a speed of 125 mm/min.

TABLE 5

| | Ejecting frequency (Hz) | |
|---|---|---|
| | Coating liquid A | Coating liquid D |
| First layer | 2000 | 0 |
| Second layer | 1500 | 500 |
| Third layer | 500 | 1500 |
| Fourth layer | 0 | 2000 |

Then, drying is carried out at 160° C. for 40 minutes, and by doing so the charge-transporting layer of a thickness of 5 μm is formed, and the photoreceptor-4 is obtained. The photoreceptor-4 is evaluated by the same methods as in Example 1. The results are shown in Table 6.

Comparative Example 1

The charge-transporting layer coating liquids (A) to (D) are coated in sequence onto the charge-generating layer of photoreceptor A by using a dip coating apparatus, to attempt to form steps in the gradient of the proportion of curable resin. Then, drying is carried out at 160° C. for 40 minutes, to form the charge-transporting layer with a thickness of 5 μm, and the comparative example photoreceptor-1 is obtained.

Figure 17:
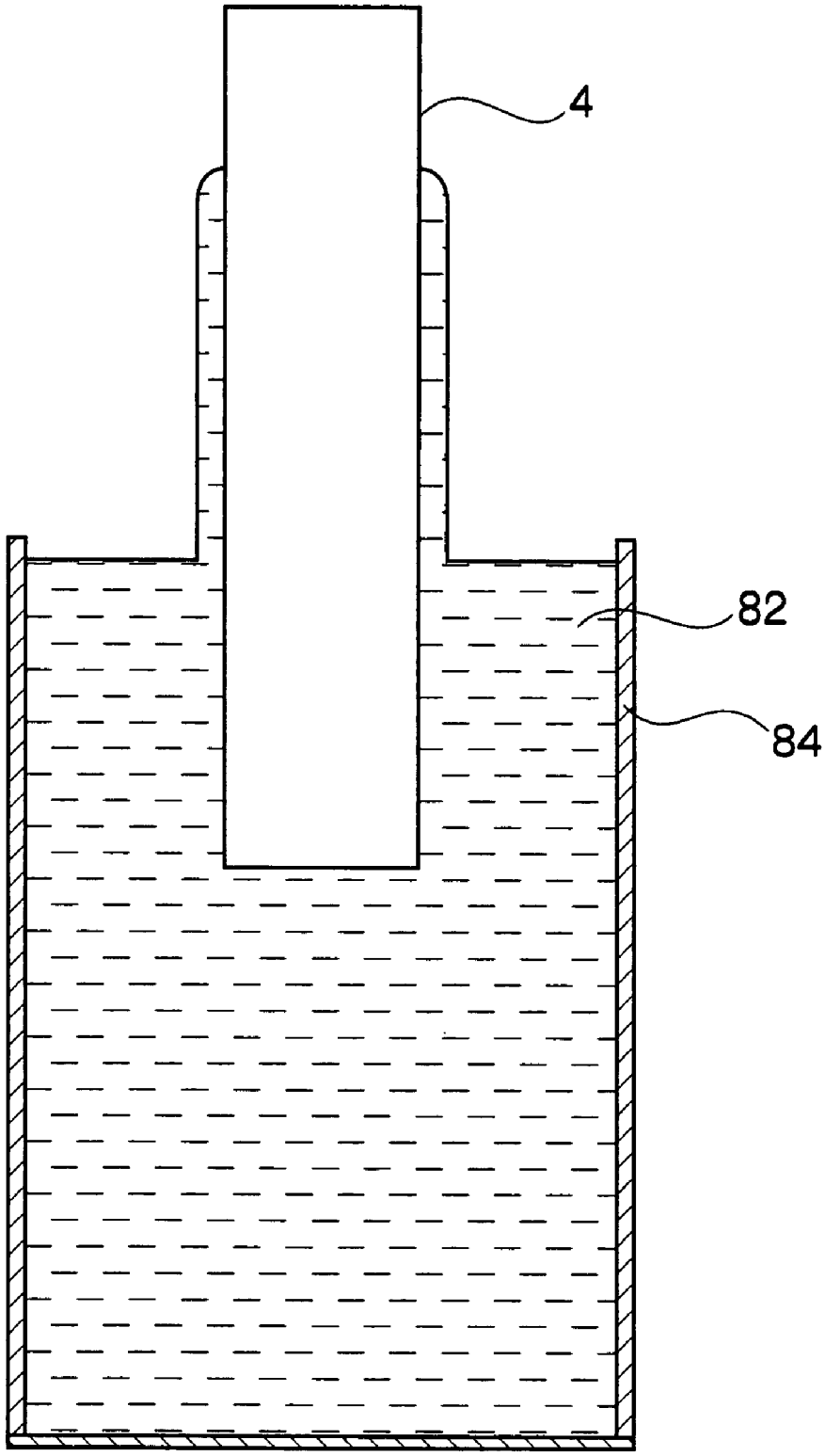
FIG. 17 is an outline diagram of a dip coating apparatus used for manufacturing photoreceptors of the Comparative Examples.

The dip coating apparatus of Comparative Example 1 is configured as shown in FIG. 17, and is an apparatus in which coating is carried out by coating liquid 82 being placed in the coating vessel 84, and the cylindrical support 4 being immersed and then withdrawn from, pulled up out of, the vessel. In the Comparative Example 1, the charge-transporting layer coating liquids (A) to (D) are exchanged in sequence for the coating liquid 82 in the coating vessel 84. The charge-transporting layer of the Comparative Example 1 is formed by arranging the photoreceptor A that is obtained in the same way as in Example 1 in a vertical orientation, as shown in FIG. 17, and the photoreceptor A is immersed in the coating liquid, and then withdrawn at a constant speed of 200 mm/minute.

The comparative example photoreceptor-1 is evaluated by the same methods as in Example 1. The results are shown in Table 6.

When the proportions contained of curable resin in the charge-transporting layer of the Comparative Example 1 are measured in the same way as in Example 1, it is found to match the proportion contained in the coating liquid D, and that no distribution of proportion contained could be made in the layer thickness direction. This is presumed to be because, when dip coating, the coating film that has already been coated is eluted when the next coating is carried out, and mixes therewith, and then is finally coated.

TABLE 6

| | | Evaluation Result | | | | | | | | |
|---|---|---|---|---|---|---|---|---|---|---|
| | | | Image degradation (High Temp/Humidity) | | | Image degradation (Low Temp/Humidity) | | | | Abrasion Rate |
| | Photoreceptor | Graininess | 1st sheet | 10,000th sheet | After 1 day | 1st sheet | 10,000th sheet | After 1 day | Ghosting | [nm/kcy] |
| Example 1 | Photoreceptor-1 | A | A | A | A | A | A | A | A | 1.1 |
| Example 2 | Photoreceptor-2 | A | A | A | A | A | A | A | A | 1.3 |
| Example 3 | Photoreceptor-3 | A | A | A | A | A | A | A | A | 1.0 |
| Example 4 | Photoreceptor-4 | A | A | A | A | A | A | A | A | 1.5 |
| Comparative Example 1 | Comp. Example Photoreceptor-1 | C | A | A | A | A | A | A | C | 1.4 |

In photoreceptors produced such that in the charge-transporting layer the proportion of the curable resin increases with the distance from the charge-generating layer side, such as in the Examples 1 to 4, delamination and the occurrence of ghosting, and image degradation may be controlled, the graininess suppressed, and also the resistance to abrasion increased.

Other exemplary embodiments of the present invention are shown below.

A method of producing an electrophotographic photoreceptor, the method including: ejecting from liquid droplet discharge head(s) two or more of charge-transporting layer coating liquids that have different proportions of curable resin and thermoplastic resin contained therein onto the charge-generating layer surface of a cylindrical support; controlling the ejecting amount of the charge-transporting layer coating liquids from the liquid droplet discharge head(s) and/or controlling the scanning velocity of the liquid droplet discharge head(s) in the axial direction; and forming the charge-transporting layer, wherein:

(a) by disposing, for the liquid droplet discharge head(s), cylindrical liquid droplet discharge head(s) around the outer periphery of the cylindrical support, irregularities in the circumferential direction of the layer thickness of the charge-transporting layer may be suppressed;

(b) by providing the liquid droplet discharge head(s) having a width that is wider than the axial direction length of the cylindrical support, high speed coating may be carried out; and/or (c) by providing, for the liquid droplet discharge head(s), continuous-type liquid droplet discharge head(s) that continuously apply pressure to the charge-transporting layer coating liquids, high viscosity charge-transporting layer coating liquids may be used.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

All publications, patent applications, and technical standards mentioned in this specification are herein incorporated by reference to the same extent as if each individual publication, patent application, or technical standard was specifically and individually indicated to be incorporated by reference.

What is claimed is:

1. An electrophotographic photoreceptor having a cylindrical support, a charge-generating layer and a charge-transporting layer that are layered on or above the cylindrical support in this sequence;

the charge-transporting layer comprising a charge transport material, and resins that comprise a curable resin and a thermoplastic resin; and the proportion of the content of the curable resin with respect to the total amount of the resins in the charge-transporting layer increases first order linearly or by curved increase in the layer thickness direction with distance from the side of the charge-generating layer toward the external surface.

2. The electrophotographic photoreceptor according to claim 1, wherein the proportion of the content of the thermoplastic resin with respect to the total amount of the resins at a surface of the charge-transporting layer that is on the far side of the charge-transporting layer from the charge-generating layer is less than about 10 wt %.

3. The electrophotographic photoreceptor according to claim 1, wherein the proportion of the content of the thermoplastic resin with respect to the total amount of the resins at a surface of the charge-transporting layer that is on the far side of the charge-transporting layer from the charge-generating layer is less than about 1 wt %.

4. The electrophotographic photoreceptor according to claim 1, wherein the curable resin has a phenolic hydroxyl group.

5. The electrophotographic photoreceptor according to claim 4, wherein the curable resin is a phenol derivative having a methylol group.

6. The electrophotographic photoreceptor according to claim 1, wherein the thermoplastic resin is a polycarbonate resin.

7. The electrophotographic photoreceptor according to claim 1, wherein:

the charge-transporting layer further comprises charge transport materials that comprise a non-curable charge transport material and a curable charge transport material; and the proportion of the content of the curable charge transport material with respect to the total amount of the charge transport materials in the charge-transporting layer increases in the layer thickness direction with distance from the charge-generating layer side.

8. The electrophotographic photoreceptor according to claim 7, wherein the proportion of the content of the curable charge transport material with respect to the total amount of the charge transport materials in the charge-transporting layer at a interface with the charge-generating layer is less than about 10 wt %.

9. The electrophotographic photoreceptor according to claim 7, wherein the proportion of the content of the curable charge transport material with respect to the total amount of the charge transport materials in the charge-transporting layer at a interface with the charge-generating layer is less than about 1 wt %.

10. The electrophotographic photoreceptor according to claim 7, wherein the proportion of the content of the non-curable charge transport material with respect to the total amount of the charge transport materials at a surface of the charge-transporting layer that is on the far side of the charge-transporting layer from the charge-generating layer is less than about 10 wt %.

11. The electrophotographic photoreceptor according to claim 7, wherein the proportion of the content of the non-curable charge transport material with respect to the total amount of the charge transport materials at a surface of the charge-transporting layer that is on the far side of the charge-transporting layer from the charge-generating layer is less than about 1 wt %.

12. A process cartridge comprising:

the electrophotographic photoreceptor according to claim 1; and at least one of a charger that charges the electrophotographic photoreceptor, a latent image formation unit that forms a latent image on the charged electrophotographic photoreceptor, a developer that develops the latent image with a toner, or a cleaner that cleans a surface of the developed electrophotographic photoreceptor.

13. An image-forming apparatus comprising:

the electrophotographic photoreceptor according to claim 1;

a charger that charges the electrophotographic photoreceptor;

a latent image formation unit that forms a latent image on the charged electrophotographic photoreceptor;

a developer that develops the latent image with a toner; and a transfer unit that transfers the toner image onto a recording medium.

14. A method of producing the electrophotographic photoreceptor according to claim 1, the method comprising:

preparing two or more of charge-transporting layer coating liquids that have different proportions of a curable resin and a thermoplastic resin contained therein;

ejecting the two or more charge-transporting layer coating liquids from a liquid droplet discharge head to form, on or above the charge-generating layer on or above the cylindrical support, the charge-transporting layer such that in the layer thickness direction there are different proportions of content of the curable resin by controlling ejecting proportions of the two or more charge-transporting layer coating liquids, or by superimposing in a sequence the two or more charge-transporting layer coating liquids.

15. The method of producing the electrophotographic photoreceptor according to claim 14, wherein charge-transport ing layer coating liquids are ejected from the liquid droplet discharge head by an inkjet method.

16. The method of producing the electrophotographic photoreceptor according to claim 15, wherein the inkjet method is a method that uses a piezoelectric element.

17. The method of producing the electrophotographic photoreceptor according to claim 14, wherein a plurality of the liquid droplet discharge heads is disposed.

* * * * *